US005573898A

United States Patent [19]

Sakai

[11] Patent Number: 5,573,898

[45] Date of Patent: Nov. 12, 1996

[54] SILVER HALIDE COLOR PHOTOGRAPHIC MATERIAL

[75] Inventor: Hidekazu Sakai, Kanagawa, Japan

[73] Assignee: Fuji Photo Film Co., Ltd., Kanagawa, Japan

[21] Appl. No.: 313,587

[22] Filed: Sep. 29, 1994

[30] Foreign Application Priority Data

Sep. 30, 1993 [JP] Japan ..... 5-265477

[51] Int. Cl.[6] ..... G03C 1/46

[52] U.S. Cl. ..... 430/503; 430/531; 430/533; 430/538; 430/558; 430/551

[58] Field of Search ..... 430/531, 533, 430/538, 551, 503, 558, 384, 385, 505

[56] References Cited

U.S. PATENT DOCUMENTS

| | | | |
|---|---|---|---|
| 5,024,932 | 6/1991 | Tanji et al. | 430/567 |
| 5,256,526 | 10/1993 | Suzuki et al. | 430/384 |
| 5,270,153 | 12/1993 | Suzuki et al. | 430/384 |
| 5,342,747 | 8/1994 | Morigaki et al. | 430/551 |
| 5,364,748 | 11/1994 | Yoneyama | 430/505 |
| 5,429,916 | 7/1995 | Ohshima | 430/538 |

FOREIGN PATENT DOCUMENTS 4-256948 9/1992 Japan .

*Primary Examiner*—Geraldine Letscher
*Attorney, Agent, or Firm*—Birch, Stewart, Kolasch & Birch, LLP

[57] ABSTRACT

Disclosed is a silver halide color photographic material having plural light-sensitive layers on a reflective support, in which the reflective support is composed of a base and two or more waterproof resin coat layers each having a different white pigment content in such a way that the resin coat layers are sandwiched between the base and the light-sensitive layers, the cyan coupler-containing silver halide emulsion layer contains a particular pyrroloazole cyan dye-forming coupler, and the pH of the coated film of the material is from 4.0 to 6.5. The material is low-priced and has a good coloring property, excellent color reproducibility and high sharpness. As the material has sufficient pressure resistance, it has few stress marks even after stored. Also disclosed is a method for forming a color image, using the photographic material.

13 Claims, No Drawings

SILVER HALIDE COLOR PHOTOGRAPHIC MATERIAL

FIELD OF THE INVENTION

The present invention relates to a color photographic material and to a method for forming a color image using the material. More precisely, it relates to a color photographic material which has a good coloring property with excellent color reproducibility and sharpness, which is low-priced and which is resistant to pressure causing stress marks when stored, and to a method for forming a color image using the material.

BACKGROUND OF THE INVENTION

Color photographs which have been widely popularized in these days have much improved to be easily and rapidly available anywhere due to the improvement in photographic materials themselves and developing and processing techniques. For color printing papers to be used to produce viewing color prints, in particular, the realization of photographic materials containing high silver chloride emulsions has brought about highly-rapid processing of the materials. The market where highly-rapid processing of photographic materials is being promoted needs the improvement in the sharpness and the color reproducibility of photographic materials to give high-quality photographic images and, in addition, further needs the provision of such high-quality photographic products at low costs.

The color image forming method which is most generally employed in processing silver halide color photographic materials is such that the exposed silver halides in the material are reacted with, as the oxidizing agent, an oxidized, aromatic primary amine color developing agent to form indophenol, indoaniline, indamine, azomethine, phenoxazine, phenazine and the like dyes. According to the method, employed is subtractive color photography to reproduce color images. In general, color images are formed by varying the amounts of three dyes comprised of yellow, magenta and cyan dyes to be formed in the processed photographic material.

To form cyan color images, generally used are phenol or naphthol cyan couplers. However, since these couplers have unfavorable absorption in the green light range and the blue light range, these have a serious problem in that they noticeably worsen the blue and green color reproducibility. Therefore, it is strongly desired to solve the problem.

As one means for solving the problem, it has been proposed to employ 2,4-diphenylimidazole cyan couplers. The dyes to be formed from these couplers have more reduced unfavorable absorption in the green and blue ranges than those to be formed from conventional couplers, and the color reproducibility of these couplers has surely been improved in some degree. However, it is difficult to say that the color reproducibility of these couplers is satisfactory and further improvement in their color reproducibility is desired. In particular, these couplers have serious problems in that their reactivity with oxidation products of developing agents or, that is, their coupling activity is low and that the heat resistance and the light fastness of the dyes to be formed from these couplers are extremely low. For these reasons, these couplers cannot be put to practical use.

Pyrazoloazole cyan couplers are better than conventional cyan couplers in that the unfavorable absorption of the dyes to be formed from the pyrazoloazole cyan couplers in the green and blue ranges is less than that of the dyes to be formed from the conventional cyan couplers, but the pyrazoloazole cyan couplers still have problems in that their color reproducibility is not satisfactory and that their coloring property is extremely bad.

As couplers of forming dyes with excellent color hue, pyrrolopyrazole cyan couplers are known. These couplers are better than the above-mentioned pyrazoloazole cyan couplers with respect to their color reproducibility but are not still satisfactory. They have a drawback in that they give much color fog in the non-exposed area. In addition, their coloring property is not still in a satisfactory level.

As cyan couplers which are free from the above-mentioned problems or, that is, those having a good coloring property and giving dyes with reduced unfavorable absorption in the green and blue ranges, European Patents 0,491,197 and 0,488,248 have proposed pyrroloazole cyan couplers having particular substituents. These cyan couplers form dyes having an excellent absorbing characteristic or, that is, dyes having a large molar extinction coefficient and having a sharp spectral profile in the short wavelength range (characterized in that the unfavorable absorption in the green range and the blue range has been reduced), and their coloring property or, that is, their reactivity with oxidation products of developing agents is high while the heat resistance and the light fastness of the dyes to be formed from them are excellently high. From these viewpoints, the cyan couplers are favorable.

On the other hand, the support in color printing papers is designed in such a way that the base of the support is coated with a polyolefin layer containing titanium dioxide that has been kneaded and dispersed thereinto, on its surface side where photographic emulsions are to be coated thereover, in order to improve its water-proofness and its light reflectivity. Various means have heretofore been known to improve the sharpness of silver halide photographic materials having such a reflective support. Such means include, for example, (1) anti-irradiation by the use of water-soluble dyes, (2) anti-halation by the use of colloidal silvers, mordant dyes, fine grains of solid dyes, etc., (3) protection of the support from light by increasing the amount of the white pigment to be in the laminate resin on a paper support or by additionally coating a gelatin dispersion of a white pigment on the support, etc.

Of these means, however, (1) and (2) have serious problems in that they result in noticeable decrease in the sensitivity of photographic materials and result in increase in the color stains in the processed photographic materials. According to the means (3), the sharpness of photographic materials may be improved noticeably by coating a gelatin dispersion containing a white pigment on the support, but the coating of the white pigment-containing gelatin dispersion worsens the storability of non-exposed photographic materials and increases the total thickness of photographic materials, thereby causing various new problems in that the stability of photographic materials during their processing is lowered, the drying speed thereof is lowered so that the materials are not applicable to rapid processing, the production costs of the materials are elevated, etc.

On the other hand, it is known that the sharpness of photographic materials may be remarkably improved by increasing the content of the white pigment in the polyolefin laminate on the support. However, such increase results in the elevation of the production costs of photographic materials so that it is impracticable. JP-A 49-30446, 2-58042, 1-142549, 4-256947, 4-256948, etc. have disclosed reflective supports having two or more polyolefin layers having different white pigment contents. (The term "JP-A" as used herein means an "unexamined published Japanese patent application".) According to these constitutions, it has been known that the amount of the white pigment to be used may be reduced while the sharpness of photographic materials is kept high and therefore the proposed constitutions are advantageous in view of the production costs.

However, it has been found that when pressure is applied to a photographic material having a support comprising such a multi-layered resin layer before its development, the area of the material to which pressure was applied is fogged during its processing or, that is, the processed material is to have stress marks around the area. This problem is not so significant when the photographic material contains conventional phenol or naphthol cyan couplers, but is serious when the material contains cyan couplers of a general formula (Ia) which will be mentioned hereinafter so as to have an improved coloring property and improved color reproducibility. In addition, it has been found that the above-mentioned stress marks appear noticeably in stored photographic materials though appearing in some degree in fresh photographic materials. Moreover, it has been found that this problem is more serious in silver halide emulsion grains having an extremely high silver chloride content.

SUMMARY OF THE INVENTION

The object of the present invention is to provide a color photographic material which has a good coloring property with excellent color reproducibility and sharpness, which is low-priced and which is resistant to pressure causing stress marks when stored, and also to provide a method for forming a color image using the material.

The present inventor assiduously studied so as to solve the above-mentioned problems and to attain the above-mentioned object and, as a result, has found that the problems may be solved and the object may be attained by a silver halide color photographic material having, on a reflective support, at least one yellow dye-forming coupler-containing silver halide emulsion layer, at least one magenta dye-forming coupler-containing silver halide emulsion layer and at least one cyan dye-forming coupler-containing silver halide emulsion layer each having a different color sensitivity, which is characterized in that said reflective support is composed of a base and two or more waterproof resin coat layers each having a different white pigment content, the resin coat layers being provided on the surface side of the base where the silver halide emulsion layers are coated thereover, that said cyan dye-forming coupler-containing silver halide emulsion layer contains at least one cyan dye-forming coupler compound of the following general formula (Ia) and that the pH of the coated film of the photographic material falls within the range of from 4.0 to 6.5.

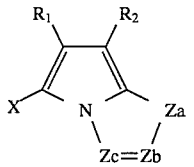

(Ia)

wherein Za represents —NH— or —CH($R_3$)—;

Zb and Zc each represent —C(R4)= or —N=;

$R_1$, $R_2$ and $R_3$ each represent an electron-attracting group having a Hammett's substituent constant σp of 0.20 or more, provided that the sum of the σp values of $R_1$ and $R_2$ is 0.65 or more;

$R_4$ represents a hydrogen atom or a substituent, provided that when the formula has two $R_4$'s, they may be the same or different;

X represents a hydrogen atom or a group capable of splitting off from the compound by the coupling reaction with an oxidation product of an aromatic primary amine color developing agent; and when $R_1$, $R_2$, $R_3$, $R_4$ or X is a divalent group, the compound may be a dimer or a higher polymer, or the divalent group may be bonded to a polymer chain to form a homopolymer or copolymer.

As one embodiment of the present invention, the cyan dye-forming coupler of formula (Ia) in the silver halide color photographic material is a cyan dye-forming coupler represented by a general formula (Ib):

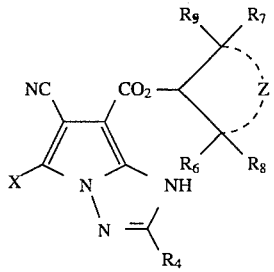

(Ib)

wherein $R_5$, $R_6$, $R_7$, $R_8$ and $R_9$ each represent a hydrogen atom or a substituent;

Z represents a non-metallic atomic group necessary for forming a ring, which may optionally be substituent(s), the ring to be formed by Z may be an aromatic ring or a heterocyclic ring, but when the ring is an aromatic ring or an aromatic heterocyclic ring, the formula does not have $R_7$, $R_8$ and Rg;

$R_5$, $R_6$, $R_7$, $R_8$, $R_9$ and the substituent(s), if any, on Z may be bonded to each other to form ring(s); and $R_4$ and X have the same meanings as those in formula (Ia).

As another embodiment of the present invention, of the two or more of the waterproof resin coat layer each having a different white pigment content, one of the layers that is nearest to the base has a lower white pigment content than at least one of the upper positioned water proof resin coat layers.

As still another embodiment of the present invention, the waterproof resin coat layer that is nearest to the light-sensitive layers has a highest white pigment content.

As still another embodiment of the present invention, the reflective support has, on the base, at least three or more waterproof resin coat layers each having a different white pigment content in such a way that the interlayer between the layer nearest to the light-sensitive layers and the layer nearest to the base has a highest white pigment content.

As still another embodiment of the present invention, the white pigment in the waterproof resin coat layers constituting the reflective support is titanium dioxide and the ratio by weight of the white pigment to the resin is 15/85 (titanium dioxide/resin) or more in the waterproof resin coat layer having the highest white pigment content.

As still another embodiment of the present invention, the silver halide color photographic material is exposed by scanning exposure for a period of time shorter than $10^{-4}$ second per one pixcel, and thereafter the thus-exposed material is processed for color development to form a color image.

According to the present invention characterized in that the support has two or more waterproof resin coat layers, that the material contains at least one cyan coupler of formula (Ia) and that the film coated on the material has pH of from 4.0 to 6.5, the stress marks increased by the combination of the support having plural resin coat layers each having a different white pigment content and the cyan coupler of formula (Ia) may be inhibited and a photographic material having good sharpness, coloring property and color reproducibility and a method for forming a color image using the material may be obtained. In addition, the photographic material of the present invention having the support having two or more waterproof resin coat layers may have much more improved sharpness than conventional photographic materials, even though the content of the white pigment to be in the support of the present invention is the same as that to be added to the conventional support so as to improve the sharpness of the photographic material having it. In particular, the support of the present invention having three or more resin coat layers gives a more favorable result, when the coat layers each have a different white pigment content and the interlayer of these has a highest white pigment content.

The support of the present invention having plural waterproof resin coat layers each having a different white pigment content gives sharpness of the same degree comparable to that attainable by a support having one waterproof resin coat layer or a support having plural waterproof resin coat layers all having the same white pigment content, even when the total content of the white pigment in the former is less than that in the latter.

DETAILED DESCRIPTION OF THE INVENTION

The present invention will be explained in detail hereunder.

The waterproof resin to be used in preparing the reflective support of the present invention includes polyolefins such as polyethylene, polypropylene, polyethylenic polymers, etc. It is especially preferably polyethylene. As polyethylene, usable are high-density polyethylene, low-density polyethylene, linear low-density polyethylene and polyethylene blends of them. Before being processed, the polyolefin resin is desired to have a melt flow rate (hereinafter referred to as MFR) falling within the range of from 1.2 g/10 min to 12 g/10 min, in terms of the value measured according to JIS K 7210 (Table 1, Condition 4). MFR of the non-processed polyolefin resin as referred to herein indicates MFR of the same resin not blended with a bluing agent and a white pigment and MFR of the same resin not blended with a diluting resin.

The white pigment to be added to and dispersed in the waterproof resin of the reflective support of the present invention includes, for example, inorganic pigments such as titanium dioxide, barium sulfate, lithopone, aluminium oxide, calcium carbonate, silicon oxide, antimony trioxide, titanium phosphate, zinc oxide, white lead, zirconium oxide, etc., and fine powders of organic substances such as polystyrene, styrene-divinylbenzene copolymer, etc.

Of these pigments, titanium dioxide is especially effective. As titanium dioxide, usable is either rutile-type or anatase-type one. However, if the photographic material is intended to preferentially have a high level of whiteness, anatase-type titanium dioxide is preferred, but if it is intended to preferentially have a high level of sharpness, rutile-type titanium dioxide is preferred. Considering both the whiteness and the sharpness, a blend comprising anatase-type titanium dioxide and rutile-type titanium dioxide may be used. It is also preferred to incorporate anatase-type titanium dioxide into one or more of the waterproof resin coat layers constituting the multi-layer support while incorporating rutile-type titanium dioxide into the other(s) of them. Titanium dioxide of these types may be produced by any of a sulfate method and a chloride method. As commercial products of such titanium dioxide, mentioned are KA-10 and KA-20 of Titanium Industrial Co., A-220 of Ishihara Sangyo KK, etc.

The surfaces of titanium dioxide grains to be used in the present invention may be processed with inorganic substances such as aluminium hydroxide, silicon hydroxide, etc., or organic substances such as polyalcohols, polyamines, metallic soap, alkyl titanates, polysiloxanes, etc., or mixtures of such inorganic and organic substances, so as to retard the activity of titanium dioxide and to prevent it from yellowing. The amount of the surface-treating agent to be applied to titanium dioxide is preferably from 0.2% by weight to 2.0% by weight for the inorganic substances and from 0.1% by weight to 1.0% by weight for the organic substances.

The mean grain size of titanium dioxide grains to be used in the present invention is preferably from 0.1 to 0.8 μm. If it is less than 0.1 μm, the grains are difficult to uniformly mix and disperse in resins and therefor such fine grains are unfavorable. If, however, it is more than 0.8 μm, the photographic material cannot have a sufficient degree of whiteness and, in addition, such large grains will make small hills on the coated surface to have a bad influence on the image quality of images to be formed.

It is indispensable that the reflective support to be used in the present invention has two or more waterproof resin coat layers on its surface to be coated with light-sensitive layers and that the plural waterproof resin coat layers each have a different white pigment content. One preferred embodiment of the reflective support for use in the present invention is such that the waterproof resin coat layer nearest to the base of the support has a lower white pigment content than at least one of the upper positioned waterproof resin coat layer. A more preferred embodiment of the reflective support for use in the present invention is such that the waterproof resin coat layer nearest to the light-sensitive layers has a highest white pigment content. Another more preferred embodiment of the reflective support for use in the present invention has at least three waterproof resin coat layers in such a way that the interlayer between them has a highest white pigment content. The number of the waterproof resin coat layers each having a different white pigment content is preferably from 2 to 7, more preferably from 2 to 5, most preferably from 3 to 5.

The white pigment content in each of these plural waterproof resin coat layers may be from 0% by weight to 45% by weight, preferably from 0% by weight to 40% by weight, relative to the total weight of the white pigment and the resin of being 100% by weight. The white pigment content in the waterproof resin coat layer having a highest white pigment content may be from 9% by weight to 45% by weight, preferably from 15% by weight to 40% by weight, more preferably from 20% by weight to 40% by weight. If it is less than 9% by weight, the sharpness of images to be formed will be poor; but if it is more than 45% by weight, the melt-extruded film will be cracked.

The reflective support for use in the present invention may have a waterproof resin coat layer having a white pigment content of 0% by weight (or containing no white pigment), by which the total content of the white pigment in the support may be reduced. Even if the total content of the white pigment in the support is reduced as above, the sharpness of the photographic material of the present invention is comparable to that of a photographic material having a reflective support composed of plural resin coat layers having large white pigment content in total and the white pigment is uniformly dispersed in a resin coat layer.

The plural waterproof resin coat layers constituting the reflective support for use in the present invention each have "a different white pigment content", which means that the effective ratio of the white pigment content in the layer having a lower white pigment content to that in the layer having a higher white pigment content may be more than 1 up to infinity, preferably from 1.1 up to infinity.

To mix a waterproof resin and a white pigment so as to prepare the white pigment-containing waterproof resin coat layers for the reflective support of the present invention, the pigment is kneaded into the resin using a mixing and kneading device such as a two-roll or three-roll kneader, a Bumbury's mixer, etc. and using a dispersing agent chosen from among metal salts of higher fatty acids, esters of higher fatty acids, higher fatty acid amides, higher fatty acids, etc. and formed into a master batch comprising pellets. The white pigment content in these pellets is, in general, approximately from 30% by weight to 75% by weight; and the dispersing agent is, in general, approximately from 0.5% by weight to 10% by weight, relative to the white pigment.

The waterproof resin layers preferably contain a bluing agent. As the bluing agent, usable are generally-known ultramarine, cobalt blue, cobalt phosphate oxide, quinacridone pigments, etc., and their mixtures. The grain size of the grains of the bluing agent is not specifically defined. The grain size of the grains of commercial bluing agents is, in general, approximately from 0.3 μm to 10 μm, which is employable in the present invention with no problem. The preferred content of the bluing agent is from 0.1% by weight to 0.5% by weight in the uppermost layer and is from 0 to 0.7% by weight in the lower layer(s) relative to the waterproof resin.

The bluing agent is kneaded into a waterproof resin, using a mixing and kneading device such as a two-roll or three-roll kneader, a Bumbury's mixer, etc. and shaped into pellets to be a master batch. The content of the bluing agent in the pellets may be from 1% by weight to 30% by weight.

Preparing the pellets containing the bluing agent, a white pigment may be kneaded thereinto along with the agent. If desired, a dispersing agent chosen from among low molecular waterproof resins, metal salts of higher fatty acids, esters of higher fatty acids, higher fatty acid amides, higher fatty acids, etc. may be used so as to promote the dispersion of the bluing agent.

The waterproof resin layers may contain an antioxidant. The content of the antioxidant is suitably from 50 to 1000 ppm, relative to the waterproof resin.

The thus-formed master batch containing a white pigment and/or a bluing agent is suitably diluted with a waterproof resin before use.

To coat the plural waterproof resin coat layers on a base to prepare the reflective support for use in the present invention, employable is any of a successive lamination method where the above-mentioned pellets containing a white pigment and/or a bluing agent are melted under heat, then optionally diluted with a waterproof resin and laminated successively on a running base, such as paper or a synthetic paper, or a co-extruding lamination method where the melts are simultaneously laminated on a running base through a feed-block-type, multi-manifold-type or multi-slot-type multi-layer extrusion die. The multi-layer extrusion die is generally a T-die, a coat hunger die, etc. and is not specifically defined. The temperature of the melt of the waterproof resin to be extruded is generally from 280° C. to 340° C., especially preferably from 310° C. to 330° C., at the outlet of the die. Before coating the base with the resins, the base is preferably activated by corona discharging, flame treatment, glow discharging, etc.

The total thickness of the plural white pigment-containing, waterproof resin coat layers to be formed on the base of the reflective support for use in the present invention is preferably from 5 to 100 μm, more preferably from 5 to 80 μm, especially preferably from 10 to 50 μm. If it is more than 100 μm, the properties of the layers will be problematic in that the layers are cracked due to the brittleness of the resin. If, however, it is less than 5 μm, the water-proofness which is the intrinsic object of the coating will be lost and, in addition, it is impossible to satisfy both the whiteness and the surface smoothness at the same time, and the layers will be unfavorably too soft in view of their physical properties.

The thickness of each of the plural waterproof resin coat layers is preferably from 0.5 μm to 50 μm. For instance, when the support has two waterproof resin coat layers, it is preferred that each layer has from 0.5 μm to 50 μm while the total thickness of the two layers falls within the above-mentioned range.

When the support has three waterproof resin coat layers, it is preferred that the thickness of the uppermost layer is from 0.5 μm to 10 μm, that of the interlayer is from 5 mm to 50 μm, and that of the lowermost layer (nearest to the base) is from 0.5 μm to 30 μm. If the thickness of the uppermost layer and that of the lowermost layer each are less than 0.5 μm, die lip streaks will be formed on the coated surface due to the action of the highly-densified white pigment in the interlayer. On the other hand, however, if the thickness of the uppermost layer and the lowermost layer, especially that of the uppermost layer is more than 10 μm, the sharpness of the photographic material will be lowered.

The thickness of the resin or resin composition layer to be coated on the surface of the base not coated with the emulsion layers is preferably from 5 to 100 μm, more preferably from 10 to 50 μm. If it is more than the range, the properties of the layer will be problematic in that the layer is cracked due to the brittleness of the resin. If, however, it is less than the range, the water-proofness which is the intrinsic object of the coating will be lost and, in addition, the layer will be unfavorably too soft in view of its physical properties.

The surface of the uppermost waterproof resin coat layer on which the emulsion layers are provided is made glossy, or is made fine in such a way as disclosed in JP-A 55-26507, or is shaped to be a matt or silky surface, while the back surface thereof is shaped to be non-glossy. After thus-shaped, the surface of the support may be activated by corona discharging, flame treatment, etc. In addition, after the activation, the support may be coated with subbing layer(s) in such a way as disclosed in JP-A 61-84643.

The base of the reflective support for use in the present invention may be any of a natural pulp paper made of natural pulp as the essential raw material, a mixed paper composed of natural pulp and synthetic fibers, a synthetic fiber paper consisting essentially of synthetic fibers, and a so-called synthetic paper made of synthetic resin films such as polystyrene, polypropylene, etc. by papermaking. As a waterproof resin-coated paper base for the support of photographic printing papers, a natural pulp paper (hereinafter referred to as a base paper) is especially advantageously used. To the base paper, various chemicals may be added. Such chemicals include, for example, a filler such as clay, talc, calcium carbonate, fine grains of urea resins, etc.; a sizing agent such as rosin, alkylketene dimers, higher fatty acids, epoxydated higher fatty acid amides, paraffin wax, alkenylsuccinic acids, etc.; a paper reinforcing agent such as starch, polyamide-polyamine epichlorohydrins, polyacrylamides, etc.; and a fixing agent such as alumina sulfate, cationic polymers, etc. In addition, dyes, fluorescent dyes, a slime controlling agent, a defoaming agent, etc. may optionally be added to the base paper. Further, softening agents which will be mentioned below may also be added thereto, if desired.

Softening agents which may be added to the base paper are described in, for example, New Handbook for Paper Processing (edited by Shiyaku Times Co., 1980), pp. 554 to 555. Such compounds have hydrophobic group(s) with 10 or more carbon atoms along with amine salt(s) or quaternary ammonium salt(s) capable of self-fixing with cellulose. In particular, those having a molecular weight of 200 or more are preferred. As concrete examples of usable softening agents, mentioned are reaction products of maleic anhydride copolymers and polyalkylenepolyamines, reaction products of higher fatty acids and polyalkylene-polyamines, reaction products of urethane alcohols and alkylating agents, quaternay ammonium salts of higher fatty acids, etc. Of these, especially preferred are reaction products of maleic anhydride copolymers and polyalkylene-polyamines, and reaction products of urethane alcohols and alkylating agents.

The surface of the pulp paper may be sized with a film forming polymer such as gelatin, starch, carboxymethyl cellulose, polyacrylamide, polyvinyl alcohol, modified products of polyvinyl alcohol, etc. As examples of modified products of polyvinyl alcohol usable for the purpose, mentioned are carboxyl-modified products, silanol-modified products, copolymers with acrylamides, etc. The amount of the film forming polymer to be coated on the surface of the pulp paper so as to size it with the polymer may be from 0.1 $g/m^2$ to 5.0 $g/m^2$, preferably from 0.5 $g/m^2$ to 2.0 $g/m^2$. If desired, the film forming polymer may contain an antistatic agent, a brightening agent, pigments, a defoaming agent, etc.

The base for the support of the present invention may be produced by making the above-mentioned pulp or pulp slurry comprising pulp and a filling agent, a sizing agent, a paper reinforcing agent, a fixing agent, etc. optionally added thereto into paper, using a papermaking machine such as a Fourdrinier papermaking machine or the like, and then drying and winding up the thus-made paper. Before or after the drying step, the paper is treated with the above-mentioned sizing agent. It is preferred that the paper is calendered between the drying step and the winding-up step. If the surface-sizing treatment is effected after drying, the calendering treatment may be effected either before or after the surface-sizing treatment. It is preferred that the calendering treatment is effected in the final finishing step after all the necessary treatments. To conduct the calendering treatment, used are known metal rolls and elastic rolls which are used in general papermaking.

The thickness of the base of the support for use in the present invention is not specifically defined, but the weight thereof is desirably from 50 $g/m^2$ to 250 $g/m^2$ and the thickness thereof is desirably from 50 μm to 250 μm.

The support for use in the present invention may be coated with various backing layers so as to prevent it from being electrically charged and from being curled. Such backing layers may contain an inorganic antistatic agent, an organic antistatic agent, a hydrophilic binder, a latex, a hardening agent, pigments, surfactants, etc., as combined suitably, such as those described or illustrated in JP-B 52-18020, 57-9059, 57-53940, 58-56859, and JP-A 59-214849, 58-184144. (The term "JP-B" as used herein means an "examined Japanese patent publication".)

Cyan couplers of formula (Ia) for use in the present invention are concretely represented by the following general formulae (IIa) to (VIIIa):

(IIa)

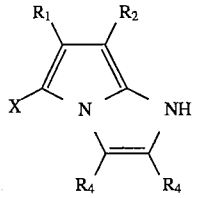

(IIIa)

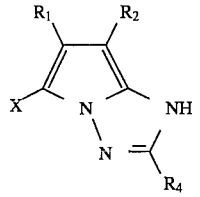

(IVa)

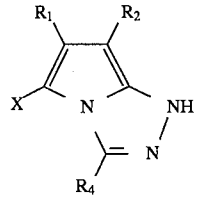

(Va)

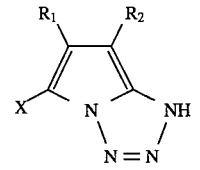

(VIa)

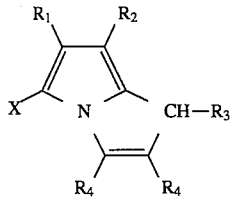

(VIIa)

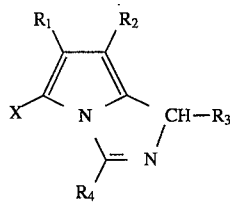

(VIIIa)

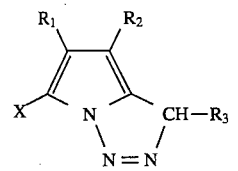

In these formulae (IIa) to (VIIIa), $R_1$, $R_2$, $R_3$, $R_4$ and X have the same meanings as those in formula (Ia).

Of these cyan couplers, those of formulae (IIa), (IIIa) and (IVa) are preferred, and those of formula (IIIa) are especially preferred.

Next, couplers of formula (Ib) for use in the present invention will be described below.

In formula (Ib), $R_4$ and X have the same meanings as those in formula (Ia).

In formula (Ib), $R_5$, $R_6$, $R_7$, $R_8$ and $R_9$ each represent a hydrogen atom or a substituent, having the same meaning as $R_4$ in formula (Ia).

Z represents a non-metallic atomic group necessary for forming a ring. The non-metallic atomic group of Z may optionally be substituted by substituent(s). The ring to be formed by Z may be either an aromatic ring or a hetero ring. When it is an aromatic ring or an aromatic hetero ring, the formula does not have $R_7$, $R_8$ and $R_9$. The ring to be formed by Z is preferably a 5-membered to 7-membered ring, for example including substituted or unsubstituted alicyclic hydrocarbons such as cyclohexane ring, cyclopentane ring, etc., and substituted or unsubstituted aromatic rings such as typically benzene ring. As the substituents for these rings, those mentioned for $R_4$ hereinabove are referred to. $R_5$, $R_6$, $R_7$, $R_8$, $R_9$ and the substituents on Z may be bonded to each other to form ring(s), preferably 3-membered to 7-membered ring(s). As one example of such condensed rings, mentioned is an adamantyl group.

In the cyan couplers of the present invention, $R_1$, $R_2$ and $R_3$ each represent an electron-attracting group having a Hammett's substituent constant σp of 0.20 or more. The sum of the σp values of $R_1$ and $R_2$ is 0.65 or more, preferably 0.70 or more. The uppermost limit of the sum is about 1.8.

$R_1$, $R_2$ and $R_3$ each represent an electron-attracting group having a Hammett's substituent constant σp of 0.20 or more, preferably 0.35 or more, more preferably 0.45 or more. The uppermost limit of the σp value of the electron-attracting group is preferably 1.0, more preferably 0.75. The Hammett's rule is an empirical rule that was proposed by L. P. Hammett in 1935 so as to quantitatively deal with the influence of substituents on the reaction or equilibrium of benzene derivatives and its reasonability has been widely admitted in this technical field in these days. The substituent constants to be obtained on the basis of the Hammett's rule are σp and σm values, which are described in various ordinary literatures. For example, the details thereof are described in J. A. Dean, Lange's Handbook of Chemistry, 12th Ed., 1979 (McGraw-Hill) in *Kaqaku no Ryoiki* (The Domain of Chemistry), Extra Edition, No. 122, pp. 96 to 103, 1979, published by Nankodo. In the present invention, $R_1$, $R_2$ and $R_3$ are defined by their Hammett's substituent constant σp values. However, these are not limited to only substituents whose σp values are known in published literatures but, as a matter of course, they include all substituents having σp values falling within the defined range when measured on the basis of the Hammett's rule even though their σp values are not described in published literatures.

As specific examples of the electron-attracting group having a σp value of 0.20 or more, for $R_1$, $R_2$ and $R_3$, mentioned are an acyl group, an acyloxy group, carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanato group, a thiocarbonyl group, a halogenoalkyl group, a halogenoalkoxy group, halogenoaryloxy group, a halogenalkylamino group, ha logenoalkyl thio group, an aryl group substituted by electron-attracting group(s) having an σp value of 0.20 or more, a heterocyclic group, a halogen atom, an azo group and a selenocyanato group. These groups may optionally be substituted by substituent(s) such as those for $R_4$ to be mentioned hereunder.

More precisely, $R_1$, $R_2$ and $R_3$ each represent an electron-attracting group having an σp value of 0.20 or more, such as an acyl group (e.g., acetyl, 3-phenylpropanoyl, benzoyl, 4-dodecyloxybenzoyl), an acyloxy group (e.g., acetoxy), a carbamoyl group (e.g., carbamoyl, N-ethylcarbamoyl, N-phenylcarbamoyl, N,N-dibutylcarbamoyl, N-(2-dodecyloxyethyl)carbamoyl, N-(4-n-pentadecanamido) phenylcarbamoyl, N-methyl-N-dodecylcarbamoyl, N-{3-(2,4-di-t-amylphenoxy)propyl}carbamoyl), an alkoxycarbonyl group (e.g., methoxycarbonyl, ethoxycarbonyl, isopropyloxycarbonyl, tert-butyloxycarbonyl, iso-butyloxycarbonyl, butyloxycarbonyl, dodecyloxycarbonyl, octadecyloxycarbonyl, diethylcarbamoylethoxycarbonyl, perfluorohexylethoxycarbonyl, 2-decyl-hexyloxycarbonylmethoxycarbonyl), an aryloxycarbonyl group (e.g., phenoxycarbonyl, 2,5-amylphenoxycarbonyl), a cyano group, a nitro group, a dialkylphosphono group (e.g., dimethylphosphono), a diarylphosphono group (e.g., diphenylphosphono), a dialkoxyphosphoryl group (e.g., dimethoxyphosphoryl), a diarylphosphinyl group (e.g., diphenylphosphinyl), an alkylsulfinyl group (e.g., 3-phenoxypropylsulfinyl), an arylsulfinyl group (e.g., 3-pentadecylphenylsulfinyl), an alkylsulfonyl group (e.g., methanesulfonyl, octanesulfonyl), an arylsulfonyl group (e.g., benzenesulfonyl, toluenesulfonyl), a sulfonyloxy group (e.g., methanesulfonyloxy, toluenesulfonyloxy), an acylthio group (e.g., acetylthio, benzoylthio), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a thiocyanato group, a thiocarbonyl group (e.g., methylthiocarbonyl, phenylthiocarbonyl), a halogenoalkyl group (e.g., trifluoromethyl, heptafluoropropyl), a halogenoalkoxy group (e.g., trifluoromethyloxy), a halogenoaryloxy group (e.g., pentafluorophenyloxy), a halogenoalkylamino group (e.g. , N,N-di(trifluoromethyl)amino), a halogenoalkylthio group (e.g., difluoromethylthio, 1,1,2,2-tetrafluoroethylthio), an aryl group substituted by other electron-attracting group(s) having a σp value of 0.20 or more (e.g., 2,4-dinitrophenyl, 2,4,6-trichlorophenyl, pentachlorophenyl), a heterocyclic group (e.g., 2-benzoxazolyl, 2-benzothiazolyl, 1-phenyl-2-benzimidazolyl, pyrazolyl, 5-chloro-1-tetrazolyl, 1-pyrrolyl), a halogen atom (e.g., chlorine, bromine), an azo group (e.g., phenylazo) or a selenocyanato group.

Typical electron-attracting groups will be mentioned along with their σp values as parenthesized: Cyano group (0.66), nitro group (0.78), trifluoromethyl group (0.54), acetyl group (0.50), trifluoromethanesulfonyl group (0.92), methanesulfonyl group (0.72), benzenesulfonyl group (0.70), methanesulfinyl group (0.49), carbamoyl group (0.36), methoxycarbonyl group (0.45), pyrazolyl group (0.37), methanesulfonyloxy group (0.36), dimethoxyphosphoryl group (0.60), sulfamoyl group (0.57).

Preferably, $R_1$, $R_2$ and $R_3$ each are an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenoalkyl group, a halogenoalkyloxy group, a halogenoalkylthio group, a halogenoaryloxy group, a halogenoaryl group, an aryl group substituted by two or more nitro groups, or a heterocyclic group. More preferably, they each are an acyl group, an alkoxycarbonyl group, an aryloxycarbonyl group, a nitro group, a cyano group, an arylsulfonyl group, a carbamoyl group or a halogenoalkyl group; especially preferably they each are a cyano group, an alkoxycarbonyl group, an aryloxycarbonyl group or a halogenoalkyl group.

Further preferably, they each are a cyano group, a fluoroalkyl group, a sulfamoyl group or an alkoxycarbonyl group. Preferred combinations of $R_1$ and $R_2$ are such that $R_1$ is a cyano group and $R_2$ is a fluoroalkyl group or an alkoxycarbonyl group. Especially preferably, $R_1$ is a cyano group and $R_2$ is an alkoxycarbonyl group. In such combinations, $R_2$ is preferably an alkoxycarbonyl group having a branched alkyl chain or an alkoxycarbonyl group having a cyclic alkyl chain, especially preferably an alkoxycarbonyl group having a cyclic alkyl chain.

$R_4$ represents a hydrogen atom or a substituent (including atoms). As examples of the substituent for $R_4$, mentioned are a halogen atom, an aliphatic group, an aryl group, a heterocyclic group, an alkoxy group, an aryloxy group, a heterocyclic-oxy group, an alkyl-, aryl- or heterocyclic-thio group, an acyloxy group, a carbamoyloxy group, a silyloxy group, a sulfonyloxy group, an acylamino group, an alkylamino group, an arylamino group, an ureido group, a sulfamoylamino group, an alkenyloxy group, a formyl group, an alkyl-, an aryl- or heterocyclic-acyl group, an alkyl-, aryl- or heterocyclic-sulfonyl group, an alkyl-, aryl- or heterocyclic-sulfinyl group, an alkyl-, aryl- or heterocyclic-oxycarbonyl group, an alkyl-, aryl- or heterocyclic-oxycarbonylamino group, a sulfonamido group, a carbamoyl group, a sulfamoyl group, a phosphonyl group, a sulfamido group, an imido group, a hydroxyl group, a cyano group, a carboxyl group, a nitro group, a sulfo group, and an unsubstituted amino group. The alkyl, aryl and heterocyclic moieties in these groups may optionally be substituted by substituent(s) such as those mentioned for $R_4$ hereinabove.

More precisely, $R_4$ represents a hydrogen atom, a halogen atom (e.g., chlorine, bromine), an aliphatic hydrocarbon residue, such as a linear or branched alkyl, aralkyl, alkenyl or alkynyl group having from 1 to 36 carbon atoms, or an alicyclic hydrocarbon residue such as a cycloalkyl or cycloalkenyl group (precisely, methyl, ethyl, propyl, isopropyl, t-butyl, tridecyl, 2-methanesulfonylethyl, 3-( 3-pentadecylphenoxy)propyl, 3-{4-{2-[4-(4-hydroxyphenylsulfonyl)phenoxy]dodecanamido}phenyl}propyl, 2-ethoxytridecyl, trifluoromethyl, cyclopentyl, 3-(2,4-di-t-amylphenoxy)propyl), or an aryl group (preferably having from 6 to 36 carbon atoms, such as phenyl, naphthyl, 4-hexadecyloxyphenyl, 4-t-butylphenyl, 2,4-di-t-amylphenyl, 4-tetradecanamidophenyl, 3-(2,4-tert-amylphenoxyacetamido)phenyl), a heterocyclic group (e.g., 3-pyridyl, 2-furyl, 2-thienyl, 2-pyridyl, 2-pyrimidinyl, 2-benzothiazolyl), an alkoxy group (e.g., methoxy, ethoxy, 2-methoxyethoxy, 2-dodecyloxyethoxy, 2-methanesulfonylethoxy), an aryloxy group (e.g., phenoxy, 2-methylphenoxy, 4-tert-butylphenoxy, 2,4-di-tertamylphenoxy, 2-chlorophenoxy, 4-cyanophenoxy, 3-nitrophenoxy, 3-t-butyloxycarbamoylphenoxy, 3-methoxycarbamoylphenoxy), an alkyl-, aryl- or heterocyclic-thio group (e.g. , methylthio, ethylthio, octylthio, tetradecylthio, 2-phenoxyethylthio, 3-phenoxypropylthio, 3-(4-tert-butylphenoxy)propylthio, phenylthio, 2-butoxy-5-tert-octylphenylthio, 3-pentadecylphenylthio, 2-carboxyphenyl thio, 4-tetradecanamidophenylthio, 2-benzothiaozlylthio, 2,4-di-phenoxy-1,3,4-triazol-6-thio, 2-pyridylthio), an acyloxy group (e.g., acetoxy, hexadecanoyloxy), a carbamoyloxy group (e.g., N-ethylcarbamoyloxy, N-phenylcarbamoyloxy), a silyloxy group (e.g. , trimethylsilyloxy, dibutylmethylsilyloxy), a sulfonyloxy group (e.g., dodecylsulfonyloxy), an acylamino group (e.g., acetamido, benzamido, tetradecanamido, 2-(2,4-di-tert-amylphenoxy-)acetamido, 2-[4-(4-hydroxyphenylsulfonyl)phenoxy]decanamido, isopentadecanamido, 2-(2,4-di-t-amylphenoxy)butanamido, 4-(3-t-butyl-4-hydroxyphenoxy)butanamido), an alkylamino group (e.g., methylamino, butylamino, dodecylamino, dimethylamino, diethylamino, methylbutylamino), an arylamino group (e.g., phenylamino, 2-chloroanilino, 2-chloro-5-tetradecanamidoanilino, N-acetylanilino, 2-chloro-5-[α-2-tert-butyl-4-hydroxyphenoxy)dodecanamido]anilino, 2-chloro-5-dodecyloxycarbonylanilino), an ureido group (e.g., methylureido, phenylureido, N,N-dibutylureido, dimethylureido), a sulfamoylamino group (e.g., N,N-dipropylsulfamoylamino, N-methyl-N-decylsulfamoylamino), an alkenyloxy group (e.g., 2-propenyloxy), a formyl group, an alkyl-, aryl- or heterocyclic-acyl group (e.g., acetyl, benzoyl, 2,4-di-tert-amylphenylacetyl, 3-phenylpropanoyl, 4dodecyloxybenzoyl), an alkyl-, aryl- or heterocyclicsulfonyl group (e.g., methanesulfonyl, octanesulfonyl, benzenesulfonyl, toluenesulfonyl), an alkyl-, aryl- or heterocyclic-sulfinyl group (e.g., octanesulfinyl, dodecanesulfinyl, phenylsulfinyl, 3-pentadecylphenylsulfinyl, 3-phenoxypropylsulfinyl), an alkyl-, aryl- or heterocyclic-oxycarbonyl group (e.g., methoxycarbonyl, butoxycarbonyl, dodecyloxycarbonyl, octadecyloxycarbonyl, phenyloxycarbonyl, 2-pentadecyloxycarbonyl), an alkyl-, aryl- or heterocyclic-oxycarbonylamino group (e.g., methoxycarbonylamino, tetradecyloxycarbonylamino, phenoxycarbonylamino, 2,4-di-tert-butylphenoxycarbonylamino), a sulfonamido group (e.g., methanesulfonamido, hexadecanesulfonamido, benzenesulfonamido, p-toluenesulfonamido, octadecanesulfonamido, 2-methoxy-5-tert-butylbenzenesulfonamido), a carbamoyl group (e.g., N-ethylcarbamoyl, N,N-dibutylcarbamoyl, N-(2-dodecyloxy-ethyl)carbamoyl, N-methyl-N-dodecylcarbamoyl, N-[3-(2,4-di-tert-amylphenoxy)propyl]carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a phosphonyl group (e.g., phenoxyphosphonyl, octyloxyphosphonyl, phenylphosphonyl), a sulfamido group (e.g., dipropylsulfamoylamino), an imido group (e.g., N-succinimido, hydantoinyl, N-phthalimido, 3-octadecenylsuccinimido), a hydroxyl group, a cyano group, a carboxyl group, a nitro group, a sulfo group, or an unsubstituted amino group.

Preferably, $R_4$ is an alkyl group, an aryl group, a heterocyclic group, a cyano group, a nitro group, an acylamino group, an arylamino group, an ureido group, a sulfamoylamino group, an alkylthio group, an arylthio group, a heterocyclic-thio group, an alkoxycarbonylamino group, an aryloxycarbonylamino group, a sulfonamido group, a carbamoyl group, a sulfamoyl group, a sulfonyl group, an alkoxycarbonyl group, an aryloxycarbonyl group, a heterocyclic-oxy group, an acyloxy group, a carbamoyloxy group, an imido group, a sulfinyl group, a phosphonyl group, an acyl group, or an azolyl group.

More preferably, $R_4$ is an alkyl group or an aryl group. Further preferably, it is an alkyl or aryl group having at least one substituent chosen from among an alkoxy group, a sulfonyl group, a sulfamoyl group, a carbamoyl group, an acylamido group and a sulfonamido group. Especially preferably, it is an aryl group having an ortho-positioned alkoxy or alkylamino group. In the alkoxy moiety in this group, the structure bonding to the oxygen atom may comprise a linear alkyl, branched alkyl, cyclic alkyl or substituted alkyl group. As specific examples of the structure, mentioned are methyl, ethyl, isopropyl, hexyl, 2-ethyl-hexyl, octyl, benzyl and 2,6-dimethylcyclohexyl groups, which, however, are not limitative. The alkylamino group may be either a monoalkylamino group or a dialkylamino group. The alkyl moiety in the group may be either linear or branched or may have substituent(s). As specific examples of the group, mentioned are monomethylamino, dimethylamino, diethylamino and diisopropylamino groups, which, however, are not limitative. The aryl group having an ortho-positioned alkoxy or alkylamino group may have other substituent(s) than the ortho-substituent. As examples of such additional substituents, mentioned are an acylamino group, a sulfonylamino group and a halogen atom.

In formula (Ia), X represents a hydrogen atom or a group capable of splitting off from the compound when the coupler reacts with an oxidation product of an aromatic primary amine color developing agent (hereinafter referred to as a "split-off group"). As examples of the split-off group, mentioned are a halogen atom, an aromatic azo group, or an alkyl, aryl or heterocyclic group bonded to the coupling position of the formula via a linking group containing, as a split-off atom, an oxygen, nitrogen, sulfur or carbon atom (including a nitrogen-containing heterocyclic group bonded to the coupling position via the nitrogen atom of the hetero ring in the group). The linking group includes, for example, —O—, —NH—, —S—, —SO—, —$SO_2$—, —CO—, —CON=, —$SO_2O$—, —OCOO—, —$SO_2NH$—, —OCO—, and combinations of two or more of these groups. Precisely, mentioned are a halogen atom, an alkoxy group, an aryloxy group, an acyloxy group, an alkyl- or aryl-sulfonyloxy group, an acylamino group, an alkyl- or aryl-sulfonamido group, an alkoxycarbonyloxy group, an aryloxycarbonyloxy group, an alkyl-, aryl- or heterocyclic-thio group, a carbamoylamino group, an arylsulfinyl group, an arylsulfonyl group, a 5-membered or 6-membered nitrogen-containing heterocyclic group, an imido group, and an arylazo group. The alkyl, aryl and heterocyclic moieties in these split-off groups may optionally be substituted by substituent(s) such as those mentioned for $R_4$ hereinabove. If these moieties are substituted by plural substituents, the plural substituents may be the same or different and may further be substituted by substituent(s) such as those mentioned for $R_4$ hereinabove.

More precisely, the split-off group for X is a halogen atom (e.g., fluorine, chlorine, bromine), an alkoxy group (e.g. , ethoxy, dodecyloxy, methoxyethylcarbamoylmethoxy, carboxypropyloxy, methylsulfonylethoxy, ethoxycarbonylmethoxy), an aryloxy group (e.g., 4-methylphenoxy, 4-chlorophenoxy, 4-methoxyphenoxy, 4-carboxyphenoxy, 3-ethoxycarboxyphenoxy, 3-acetylaminophenoxy, 2-carboxyphenoxy), an acyloxy group (e.g., acetoxy, tetradecanoyloxy, benzoyloxy), an alkyl- or aryl-sulfonyloxy group (e.g., methanesulfonyloxy, toluenesulfonyloxy), an acylamino group (e.g., dichloroacetylamino, heptafluorobutyrylamino), an alkyl- or aryl-sulfonamido group (e.g., methanesulfonamino, trifluoromethanesulfonamino, p-toluenesulfonylamino), an alkoxycarbonyloxy group (e.g., ethoxycarbonyloxy, benzyloxycarbonyloxy), an aryloxycarbonyloxy group (e.g. , phenoxycarbonyloxy), an alkyl-, aryl- or heterocyclic-thio group (e.g., ethylthio, 2-carboxyethylthio, dodecylthio, 1-carboxydodecylthio, phenylthio, 2-butoxy-5-t-octylphenylthio, tetrazolylthio), an arylsulfonyl group (e.g., 2-butoxy-5-tert-octylphenylsulfonyl), an arylsulfinyl group (e.g., 2-butoxy-5-tert-octylphenylsulfinyl), a carbamoylamino group (e.g., N-methylcarbamoylamino, N-phenylcarbamoylamino), a 5-membered or 6-membered nitrogen-containing heterocyclic group (e.g., imidazolyl, pyrazolyl, triazolyl, tetrazolyl, 1,2-dihydro-2-oxo-1-pyridyl), an imido group (e.g., succinimido, hydantoinyl), or an arylazo group (e.g., phenylazo, 4-methoxyphenylazo). As a matter of course, these split-off groups may optionally be substituted by substituent(s) such as those mentioned for $R_4$ hereinabove. As examples of the split-off group bonded thereto via a carbon atom, mentioned are residues derived from bis-type couplers to be obtained by condensation of 4-equivalent couplers with aldehydes or ketones. The split-off group as referred to herein may contain a photographically-useful group such as a residue of a development inhibitor or a development accelerator.

Preferably, X is a halogen atom, an alkoxy group, an aryloxy group, an alkyl- or aryl-thio group, an arylsulfonyl group, an arylsulfinyl group, or a 5-membered or 6-membered nitrogen-containing heterocyclic group bonded to the coupling position of the compound via a nitrogen atom. More preferably, X is an arylthio group.

Cyan couplers of formula (Ia) may be dimers or higher polymers, in which $R_1$, $R_2$, $R_3$, $R_4$ or X contains a residue of the cyan coupler of formula (Ia); or they may be homopolymers or copolymers in which $R_1$, $R_2$, $R_3$, $R_4$ or X contains polymer chain(s). As typical examples of homopolymers or copolymers containing polymer chain(s), mentioned are homopolymers or copolymers formed of addition-polymerizable ethylenic unsaturated compounds having a residue of the cyan coupler of formula (Ia). Such homopolymers or copolymers may contain one or more cyan-coloring repeating units containing a residue of the cyan coupler of formula (Ia). The copolymers may contain one or more non-coloring ethylenic comohomers that do not couple with an oxidation product of an aromatic primary amine developing agent, such as acrylates, methacrylates, maleates, etc.

Specific examples of the cyan couplers of the present invention are mentioned below, which, however, are not intended to restrict the scope of the present invention.

(1)
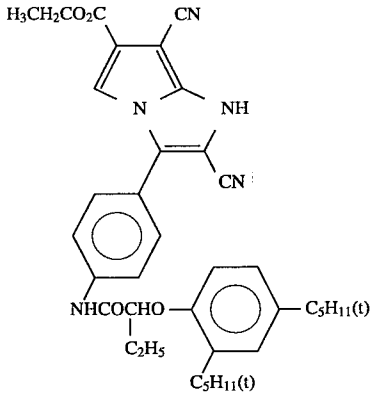
(2)
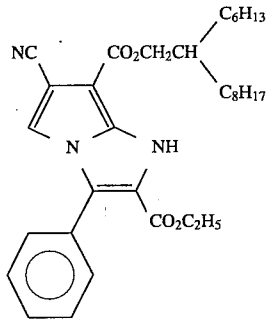
(3)
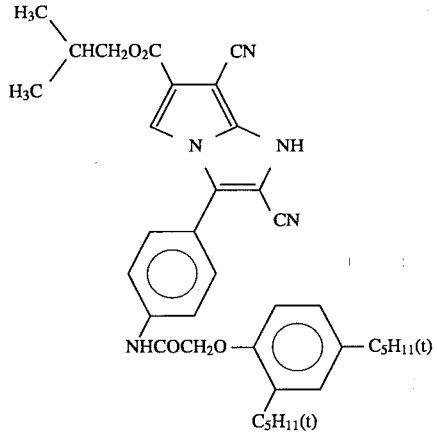
(4)
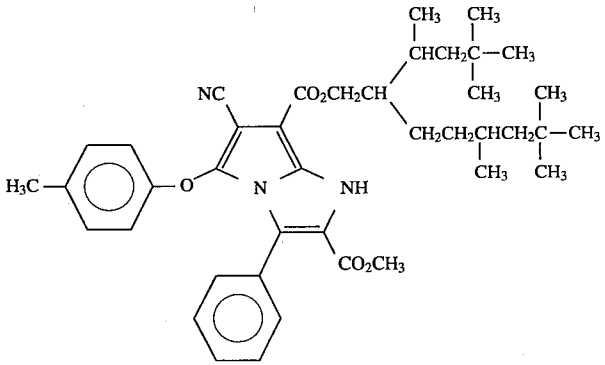
(5)
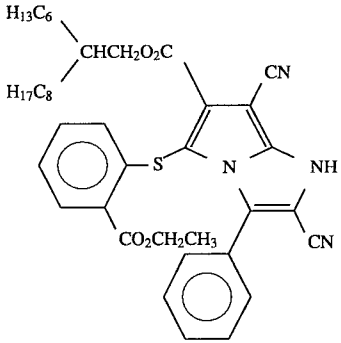

-continued
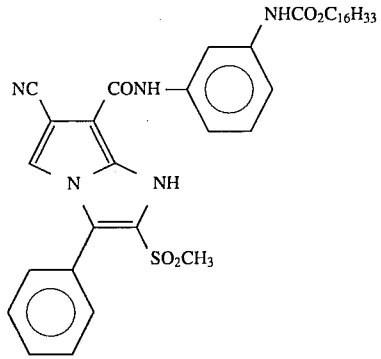
(6)
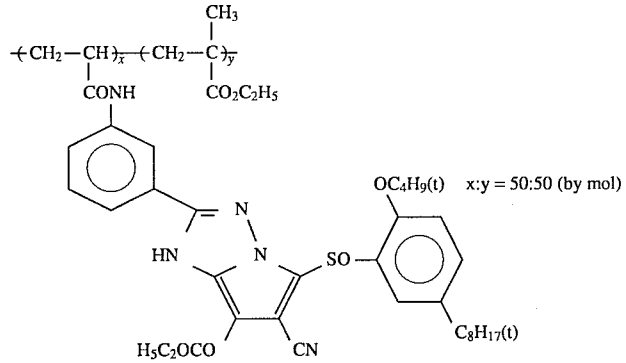
(7)
| No. | $R_1$ | $R_2$ | $R_4$ | X |
|---|---|---|---|---|
| | | 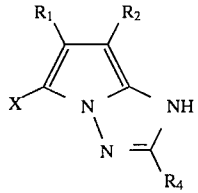 | | |
| 8 | $CO_2CH_3$ | CN | 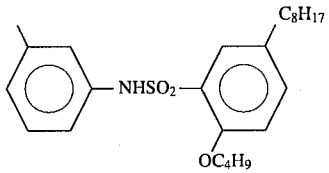 | H |
| 9 | CN | 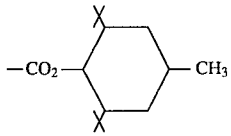 | 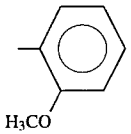 | H |

-continued
| | | | | |
|---|---|---|---|---|
| 10 | CN | 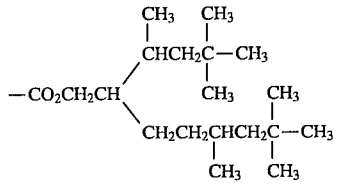 | 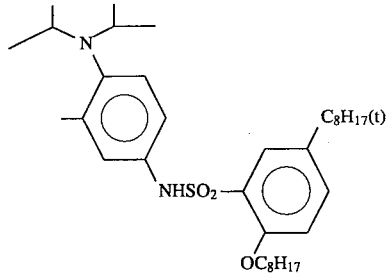 | H |
| 11 | CN | 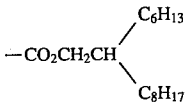 | 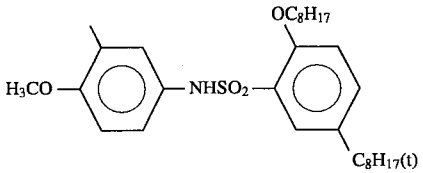 | Cl |
| 12 | CN | 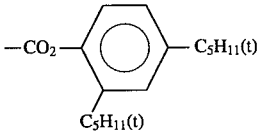 | 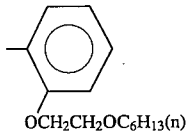 | H |
| 13 | CN | 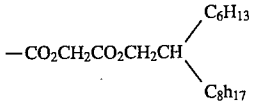 | 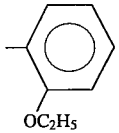 | Cl |
| 14 | CN | 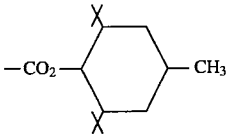 | 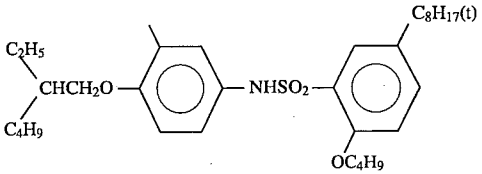 | Cl |
| 15 | CN | 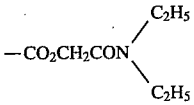 | 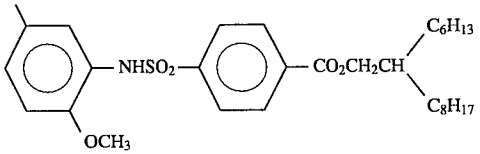 | 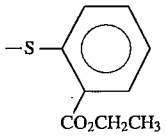 |

-continued
| | | | | |
|---|---|---|---|---|
| 16 | CN | $-CO_2CH_2CH_2(CF_2)_6F$ | 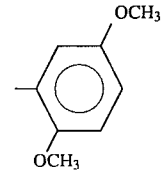 | 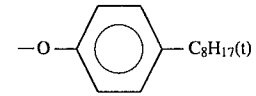 |
| 17 | CN | 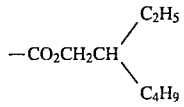 | 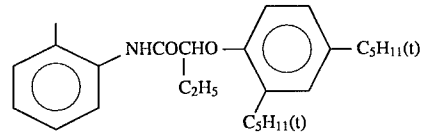 | 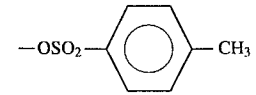 |
| 18 | CN | 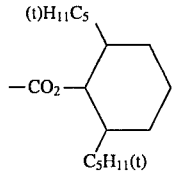 | 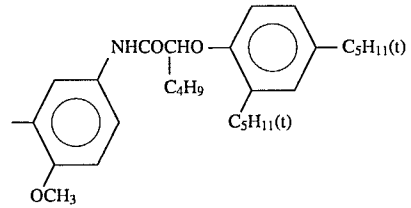 | 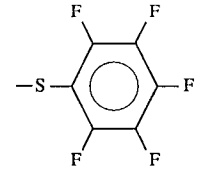 |
| 19 | CN | 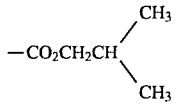 | 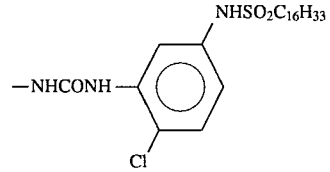 | 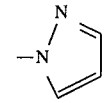 |
| 20 | CN | $-CO_2CH_2(CF_2)_4H$ | 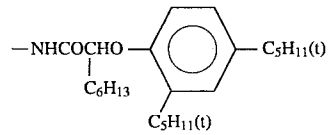 | 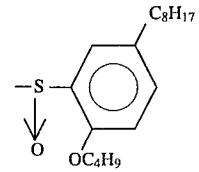 Cl |
| 21 | CN | 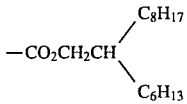 | 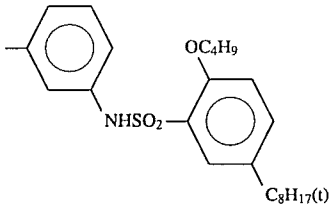 | |

-continued
| | | | | |
|---|---|---|---|---|
| 22 | 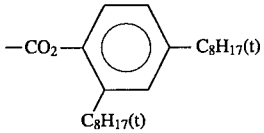 | CN | 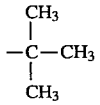 | 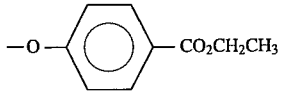 |
| 23 | $-CO_2CH_2C_6F_{13}$ | CN | 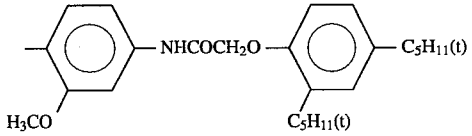 | Cl |
| 24 | 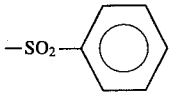 | 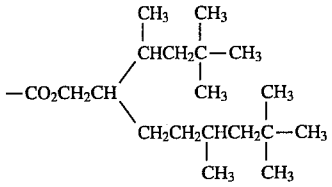 | $CH_3$ | $-OCOCH_3$ |
| 25 | CN | $-CO_2CH_2CO_2CH_3$ | 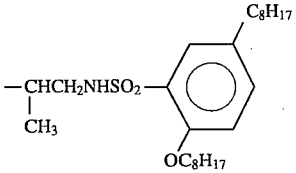 | 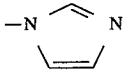 |
| 26 | CN | 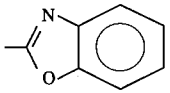 | 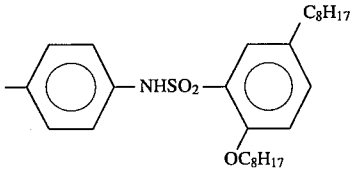 | 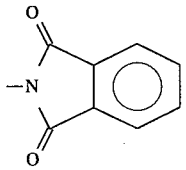 |

-continued
| | | | | |
|---|---|---|---|---|
| 27 | CN | 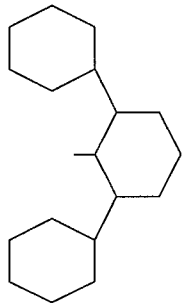 | 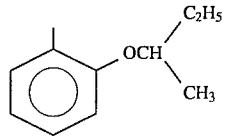 | Cl |
| 28 | 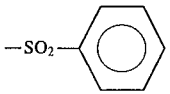 | $CF_3$ | 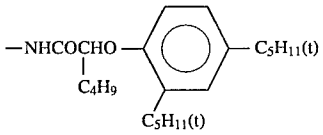 | F |
| 29 | CN | 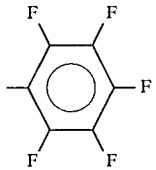 | 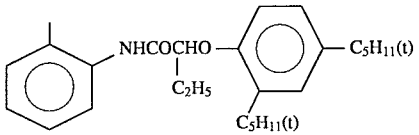 | 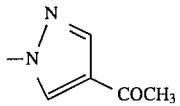 |
| 30 | 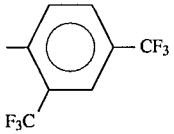 | 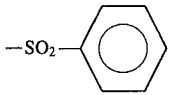 | 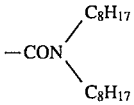 | 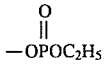 |
| 31 | CN | 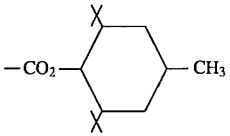 | 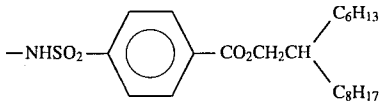 | 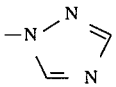 |
| 32 | CN | 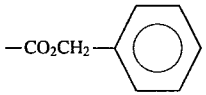 | 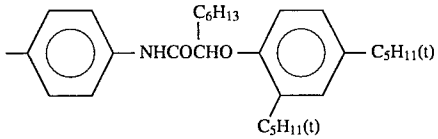 | H |

-continued
| | | | | |
|---|---|---|---|---|
| 33 | CN | $-SON(C_8H_{17})_2$ | $-NHCON(CH_2CH(C_4H_9)C_2H_5)_2$ | $-OSO_2CH_3$ |
| 34 | CN | $-COOC_{14}H_{29}$(sec) | 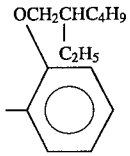 | Cl |
| 35 | CN | 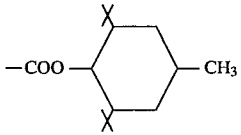 | 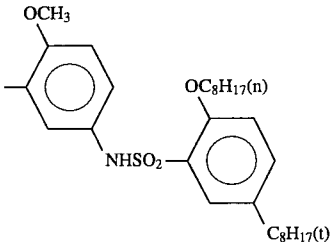 | Cl |
| 36 | CN | 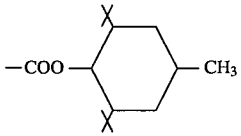 | 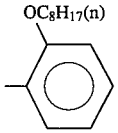 | Cl |
| 37 | CN | 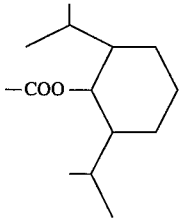 | 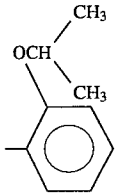 | Cl |

-continued
| | | | | |
|---|---|---|---|---|
| 38 | CN | 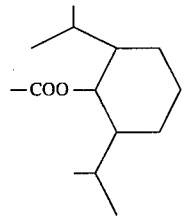 | 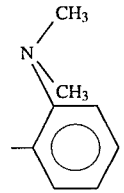 | Cl |
| 39 | CN | 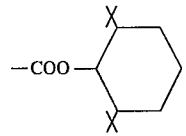 | 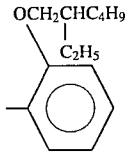 | Cl |
| 40 | CN | 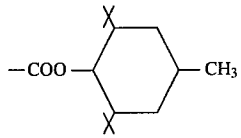 | 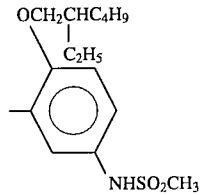 | Cl |
| 41 | CN | 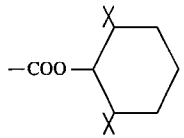 | 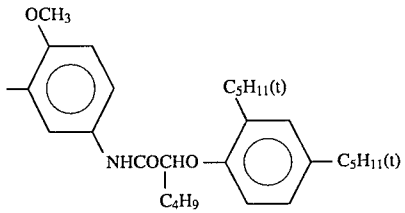 | 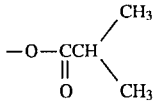 |
| 42 | CN | 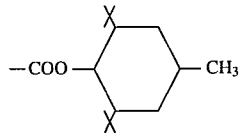 | 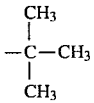 | Cl |

-continued
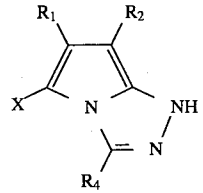
| | | | | |
|---|---|---|---|---|
| 43 | $-CO_2C_2H_5$ | CN | 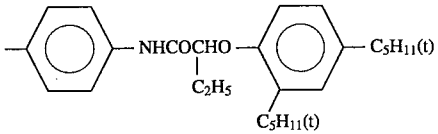 | Cl |
| 44 | CN | 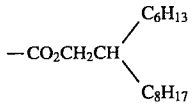 | 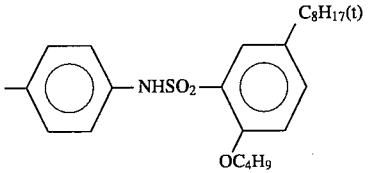 | H |
| 45 | CN | $-CO_2CH_2CH_2(CF_2)_6F$ | 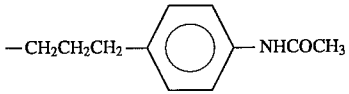 | 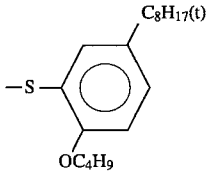 |
| 46 | CN | 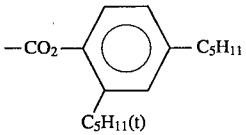 | 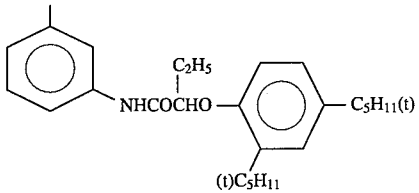 | 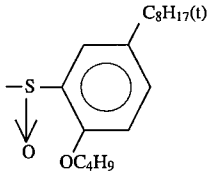 |
| 47 | CN | 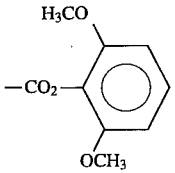 | 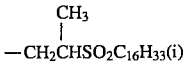 | 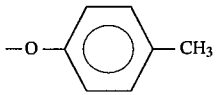 |

-continued
| | | | | |
|---|---|---|---|---|
| 48 | CN | 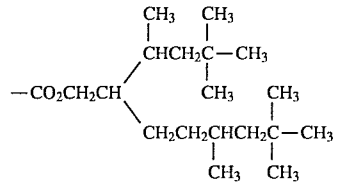 | 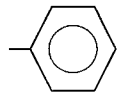 | H |
| 49 | CN | 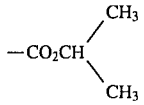 | 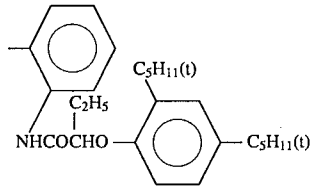 | Cl |
| 50 | CN | 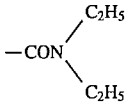 | 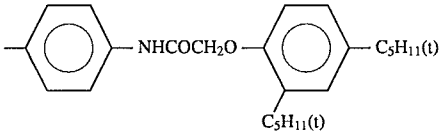 | $-OSO_2CH_3$ |
(51)
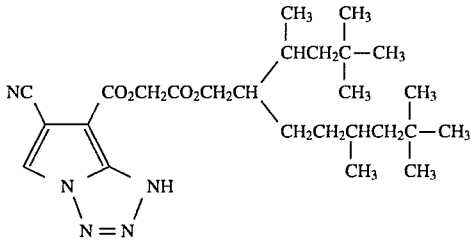
(52)
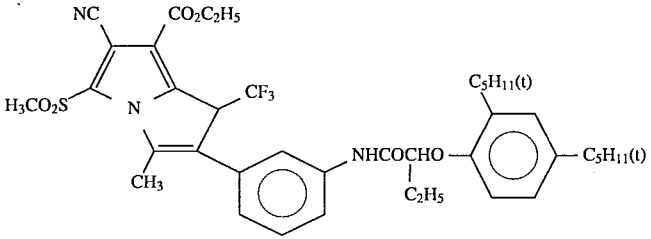
(53)
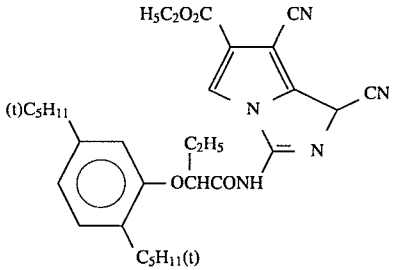
(54)
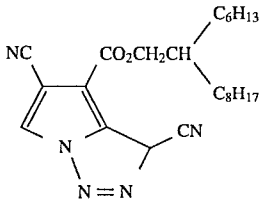
(55)
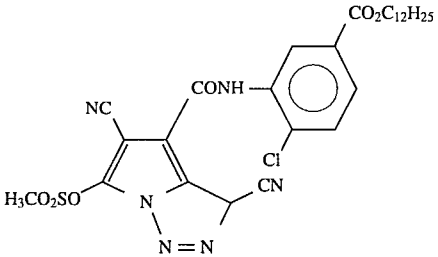

Compounds of the present invention and intermediates for producing them may be produced by known methods. For instance, they may be produced by the methods described in J. Am. Chem. Soc. No. 80, 5332 (1958); J. Am. Chem. Soc., No. 81, 2452 (1959); J. Am. Chem. Soc., No. 112, 2465 (1990); Org. Synth., I, 270 (1941); J. Chem. Soc., 5149 (1962); Heterocycles, No. 27, 2301 (1988); Rec. Trav. Chim., 80, 1075 (1961); or in the literatures referred to in these publications; or by methods similar to the described methods.

One production example will be mentioned below, which demonstrates the production of Cyan Coupler No. 9 illustrated hereinabove.

Production Example 1: Production of Compound No. 9:

Compound No. 9 was produced according to the reaction scheme mentioned below.

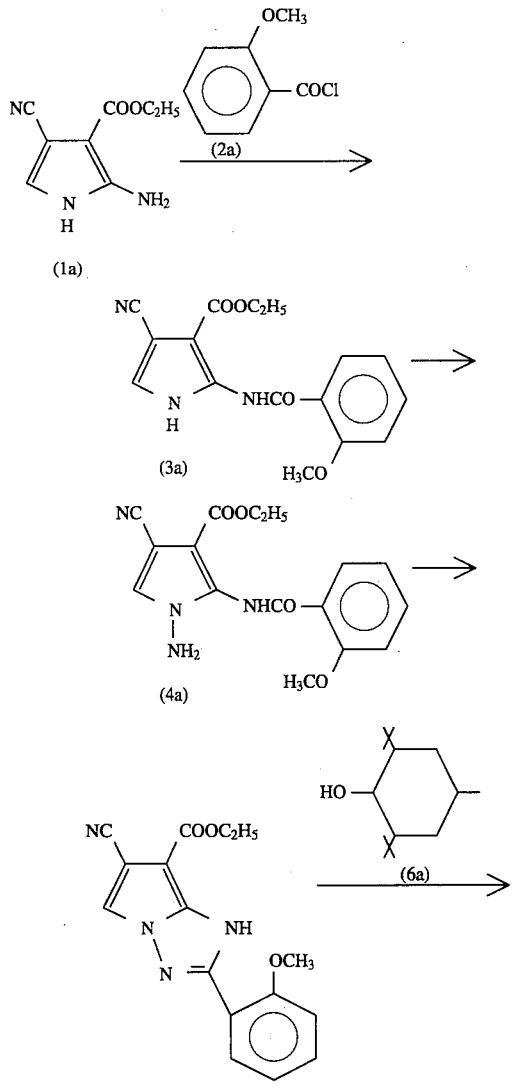

-continued

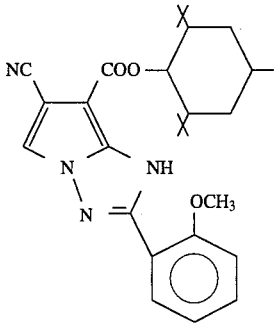

Coupler No. (9)

Precisely, 2-methoxybenzoyl chloride (2a) (83.2 g, 0.4 mol) was added to a dimethylacetamide (300 ml) solution containing 2-amino-4-cyano-3-ethoxycarbonylpyrrole (Ia) (66.0 g, 0.4 mol) at room temperature, and stirred for 30 minutes. Water was added to the reaction mixture, which was then extracted two times each with ethyl acetate. The organic layers were combined, washed with water and a saturated aqueous salt solution, and dried with anhydrous sodium sulfate. The solvent was removed by distillation under reduced pressure, and the residue was recrystallized from acetonitrile (300 ml) to obtain Compound (3*a*) (113 g, 84%).

Powder of potassium hydroxide (252 g, 4.5 mol) was added to a dimethylformamide (200 ml) solution containing Compound (3*a*) (101.1 g, 0.3 mol) at room temperature and well stirred. While cooling with water, hydroxylamine-o-sulfonic acid (237 g, 2.1 mol) was added thereto, little by little, in such a way that the reaction temperature was controlled so as not to rise too rapidly. After the addition, this was stirred for 30 minutes. An aqueous 0.1 N-hydrochloric acid solution was dropwise added thereto, by which this was neutralized while checking it using pH test papers. This was then extracted three times each with ethyl acetate. The organic layers were washed with water and a saturated aqueous salt solution and dried with anhydrous sodium sulfate. The solvent was removed by distillation under reduced pressure, and the residue was purified by column chromatography (using, as the developing solvent, hexane/ethyl acetate=2/1) to obtain Compound (4*a*) (9.50 g, 9%).

Carbon tetrachloride (9 cc) was added to an acetonitrile (30 ml) solution containing Compound (4*a*) (7.04 g, 20 mmol) at room temperature, and then triphenylphosphine (5.76 g, 22 mmol) was added thereto and heated under reflux for 8 hours. After cooled, water was added thereto. This was then extracted three times each with ethyl acetate. The organic layers were washed with water and a saturated aqueous salt solution, and dried with anhydrous sodium sulfate. The solvent was removed by distillation under reduced pressure, and the residue was purified by silica gel column chromatography (using, as the developing solvent, hexane/ethyl acetate=4/1) to obtain Compound (5*a*) (1.13 g, 17%).

The thus-obtained Compound (5*a*) (1.8 g) and Compound (6*a*) (12.4 g) were dissolved in sulforane (2.0 ml), and titanium isopropoxide (1.5 g) was added thereto. These were reacted for 1.5 hours, while the reaction temperature was maintained at 200° C. After thus reacted, ethyl acetate was added thereto. Then, this was washed with water. The ethyl acetate layer was dried and subjected to distillation. The resulting residue was purified by column chromatography to obtain 1.6 g of the intended Coupler No. 9. This had a melting point of 210° to 212° C.

To apply the cyan coupler of formula (Ia) of the present invention to a silver halide color photographic material, the material may have at least one layer containing the coupler on the support. The layer containing the coupler of the present invention may be a hydrophilic colloid layer to be on the support. In general, an ordinary color photographic material has at least one blue-sensitive silver halide emulsion layer, at least one green-sensitive silver halide emulsion layer and at least one red-sensitive silver halide emulsion layer on the support in this order. However, such constitution is not limitative. The photographic material of the present invention may have any other constitutions different from this. In view of the rapid processability of the photographic material, it is often preferred that the material has, as the uppermost layer, a light-sensitive layer containing silver halide grains having the largest mean grain size. In view of its storability in light, it is often preferred that the material has, as the lowermost layer, a magenta-coloring light-sensitive layer.

If desired, the photographic material may have an infrared-sensitive silver halide emulsion layer in place of at least one of the above-mentioned light-sensitive emulsion layers. These light-sensitive emulsion layers each may comprise a silver halide emulsion having a sensitivity to the respective wavelength ranges and a color coupler of forming a dye having a complementary color to the light to which the emulsion is sensitive, whereby color reproduction by subtractive color photography may be effected. The relationship between the light-sensitive emulsion layer and the color hue of the dye to be formed from the color coupler in the layer is not limited to the above-mentioned constitution but may be of any others.

The coupler of formula (Ia) of the present invention is especially preferably added to the red-sensitive silver halide emulsion layer.

The amount of the coupler of the present invention to be added to the photographic material is generally from $1\times10^{-3}$ mol to 1 mol, preferably from $2\times10^{-3}$ mol to $5\times10^{-1}$ mol, per mol of the silver halide in the layer to which the coupler is added.

The content of the cyan coupler(s) of the present invention in the photographic material is preferably such that the color difference between the cyan color area and the minimum density area in the material is 23 or more, more preferably 24 or more, when the density of the cyan color image formed is 0.4.

The color difference between the cyan color area and the minimum density area as referred to herein may be obtained by coating, on a reflective support having a smooth surface, a photographic constitutive layer containing a silver halide emulsion containing a varying amount of a cyan coupler, exposing the resulting photographic material to light having a suitable spectral composition, developing it to obtain cyan color patches having various color densities and a white background patch, and measuring the spectral absorption of each patch. The spectral absorption of each patch is effected under the condition (c) defined by JIS Z-8722 (1982) relating to the geometric conditions for radiation and light reception of photographic materials, whereupon the tristumulus values X, Y and Z under a D65 light source are obtained by the method defined by the same JIS Z-8722 (1982) are obtained from the measured data. From the thus-measured values, the values of L*, a* and b* of each sample are obtained by the method defined by JIS Z-8729 (1980), and the intended color difference is obtained according to the method defined by JIS Z-8730 (1980).

It is preferred that the silver halide color photographic material of the present invention contains, in its cyan coupler-containing silver halide emulsion layer, at least one chosen from among oleophilic compounds of the following general formulae (A), (B) and (C), that chemically bond to an aromatic primary amine color developing agent under the condition of pH 8 or less to give substantially colorless products, and/or at least one chosen from among oleophilic compounds of the following general formula (D) that chemically bond to an oxidation product of an aromatic primary amine color developing agent under the condition of pH 8 or less to give substantially colorless products.

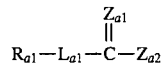

(A)

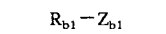

(B)

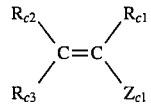

(C)

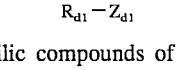

(D)

These oleophilic compounds of formulae (A), (B), (C) and (D) are effective for preventing cyan stains.

In formula (A), $L_{al}$ represents a single bond, —O—, —S—, —CO— or —N($R_{a2}$)—; $R_{a1}$ and $R_{a2}$ may be the same or different and each represents an aliphatic group, an aromatic group or a heterocyclic group, and $R_{a2}$ may also be a hydrogen atom, an acyl group, a sulfonyl group, a carbamoyl group or a sulfamoyl group; $Z_{a1}$ represents an oxygen atom or a sulfur atom; $Z_{a2}$ represents a hydrogen atom, —O—$R_{a3}$, —S—$R_{a4}$, —$L_{a2}$—C(=$Z_{z1}$'0$R_{z5}$, or a heterocyclic group bonding to the formula via a nitrogen atom; $R_{a3}$ and $R_{a4}$ may be the same or different and each represents a vinyl group, an aromatic group or a heterocyclic group, which may optionally be substituted; $L_{a2}$ represents —O— or —S—; $Z_{a1}$' has the same meaning as $Z_{a1}$; $R_{a5}$ represents an aliphatic group, an aromatic group or a heterocyclic group; and at least two of $R_{a1}$, $R_{a2}$ and $Z_{a2}$ may be bonded to each other to form a 5-membered to 7-membered ring.

In formula (B), $R_{b1}$ represents an aliphatic group; and $Z_{b1}$ represents a halogen atom.

In formula (C), $Z_{c1}$ represents a cyano group, an acyl group, a formyl group, an aliphatic-oxycarbonyl group, an aromatic-oxycarbonyl group, a carbamoyl group, a sulfamoyl group, or a sulfonyl group; $R_{c1}$, $R_{c2}$ and $R_{c3}$ may be the same or different and each represents a hydrogen atom, an aliphatic group, an aromatic group, a heterocyclic group or $Z_{c1}$; and at least two of $R_{c1}$, $R_{c2}$, $R_{c3}$ and $Z_{c1}$ may be bonded to each other to form a 5-membered to 7-membered ring.

In formula (D), $R_{d1}$ represents an aliphatic group or an aromatic group; $Z_{d1}$ represents a mercapto group or —$SO_2Y$; Y represents a hydrogen atom, an atom or atomic group for forming an inorganic or organic salt, —NHN=C($R_{d2}$)$R_{d3}$, —N($R_{d4}$)—N($R_{d5}$)—$SO_2R_{d6}$, —N($R_{d7}$)—N($R_{d8}$)—$COR_{d9}$ or —C($R_{d10}$) ($OR_{d11}$)—$COR_{d12}$; $R_{d2}$ and $R_{d3}$ may be the same or different and each represents a hydrogen atom, an aliphatic group, an aromatic group or a heterocyclic group, provided that $R_{d2}$ and $R_{d3}$ may be bonded to each other to form a 5-membered to 7-membered ring; $R_{d4}$, $R_{d5}$, $R_{d7}$ and $R_{d8}$ may be the same or different and each represents a hydrogen atom, an aliphatic group, an aromatic group, a heterocyclic group, an acyl group, an aliphatic-oxycarbonyl group, a sulfonyl group, an ureido group or an urethane group, provided that at least one of $R_{d4}$ and $R_{d5}$ and at least one of $R_{d7}$ and $R_{d8}$ are hydrogen atoms; $R_{d6}$ and $R_{d9}$ each represent a hydrogen atom, an aliphatic group, an aromatic group or a heterocyclic group; $R_{d6}$ may also be an aliphatic amino group, an aromatic amino group, an aliphatic-oxy group, an aromatic-oxy group, an acyl group, an aliphatic-oxycarbonyl group or an aromatic-oxycarbonyl group; at least two of $R_{d4}$, $R_{d5}$ and $R_{d6}$ may be bonded to each other to form a 5-membered to 7-membered ring, and at least two of $R_{d7}$, $R_{d8}$ and $R_{d9}$ may be bonded to each other to form a 5-membered to 7-membered ring; $R_{d12}$ represents a hydrogen atom, an aliphatic group, an aromatic group or a heterocyclic group; $R_{d10}$ represents a hydrogen atom, an aliphatic group, an aromatic group, a halogen atom, an acyloxy group or a sulfonyl group; and $R_{d11}$ represents a hydrogen atom or a hydrolyzable group.

Compounds of formulae (A), (B), (C) and (D) for use in the present invention will be explained in more detail hereunder.

$R_{a1}$ and $R_{a2}$ are referred to. The aliphatic group includes, for example, methyl, i-propyl, t-butyl, benzyl, 2-hydroxybenzyl, cyclohexyl, t-octyl, vinyl, allyl and n-pentadecyl groups. Preferably, it is an optionally substituted alkyl group having from 1 to 30 carbon atoms. The aromatic group includes, for example, phenyl and naphthyl groups. Preferably, it is an optionally substituted phenyl group having from 6 to 36 carbon atoms. The heterocyclic group includes, for example, thienyl, furyl, chromanyl, morpholinyl, piperazyl and indolyl groups. The acyl group for $R_{a2}$ includes, for example, acetyl, tetradecanoyl and benzoyl groups. It is preferably an optionally substituted acyl group having from 2 to 37 carbon atoms. The sulfonyl group includes, for example, methanesulfonyl and benzenesulfonyl groups. It is preferably an optionally substituted sulfonyl group having from 1 to 36 carbon atoms. The carbamoyl group includes, for example, methylcarbamoyl, diethylcarbamoyl, octylcarbamoyl, phenylcarbamoyl and N-methyl-N-phenylcarbamoyl groups. Preferably, it is an optionally substituted carbamoyl group having from 2 to 37 carbon atoms. The sulfamoyl group includes, for example, methylsulfamoyl, diethylsulfamoyl, octylsulfamoyl, phenylsulfamoyl and N-methyl-N-phenylsulfamoyl groups. It is preferably an optionally substituted sulfamoyl group having from 2 to 37 carbon atoms.

The heterocyclic group bonding to the formula via a nitrogen atom, for $Z_{a2}$, includes, for example, 1-pyrrolyl, 1-imidazolyl, 1-pyrazolyl, 2-indolyl, 1-indolyl and 7-purinyl groups. It is a preferably a heterocyclic group forming an aromatic ring. The aromatic group and the heterocyclic group for $R_{d3}$, $R_{d4}$ and $R_{d5}$ and the aliphatic group for $R_{d5}$ have the same meanings as the aromatic group, the heterocyclic group and the aliphatic group, respectively, for $R_{a1}$ and $R_{a2}$.

The aliphatic group for $R_{b1}$ has the same meaning as the aliphatic group for $R_{a1}$ and $R_{a2}$. The halogen atom for $Z_{b1}$ includes, for example, chlorine, bromine and iodine atoms.

$Z_{c1}$ is referred to. The acyl group, the carbamoyl group, the sulfamoyl group and the sulfonyl group have the same meanings as those for $R_{a2}$. The aliphatic-oxycarbonyl group includes, for example, methoxycarbonyl, ethoxycarbonyl, i-propoxycarbonyl, benzyloxycarbonyl, cyclohexyloxycarbonyl, n-hexadecyloxycarbonyl, allyloxycarbonyl and pentadecenyloxycarbonyl groups. Preferably, it is an optionally substituted alkyloxycarbonyl group having from 2 to 31 carbon atoms. The aromatic-oxycarbonyl group includes, for example, phenyloxycarbonyl and naphthyloxycarbonyl groups. Preferably, it is an optionally substituted phenyloxycarbonyl group having from 7 to 37 carbon atoms. The aliphatic group, the aromatic group and the heterocyclic group for $R_{c1}$, $R_{c2}$ and $R_{c3}$ have the same meaning as the aliphatic group, the aromatic group and the heterocyclic group, respectively, for $R_{a1}$ and $R_{a2}$.

The aliphatic group and the aromatic group for $R_{d1}$ to $R_{d10}$ and $R_{d12}$ and the heterocyclic group for $R_{d2}$ to $R_{d9}$ and $R_{d12}$ have the same meanings as the aromatic group, the heterocyclic group and the aliphatic group for $R_{a1}$ and $R_{a2}$. The atom or atomic group of forming an inorganic or organic salt for Y includes, for example, Li, Na, K, Ca, Mg, triethylamine, methylamine and ammonia. The acyl group and the sulfonyl group for $R_{d4}$, $R_{d5}$, $R_{d7}$ and $R_{d8}$ have the same meanings as those for $R_{a2}$; and the aliphatic-oxycarbonyl group for $Rd_4$, $Rd_5$, $Rd_7$ and $Rd_8$ has the same meaning as that for $Z_{c1}$. The ureido group for $R_{d4}$, $R_{d5}$, $R_{d7}$ and $R_{d8}$ includes, for example, phenylureido, methylureido, N,N-dibutylureido and N-phenyl-N-methyl-N'-methylureido groups. It is preferably an ureido group having from 2 to 37 carbon atoms. The urethane group for the same includes, for example, methylurethane and phenylurethane groups. It is preferably an urethane group having from 2 to 37 carbon atoms.

The acyl group for $R_{d6}$ has the same meaning as that for $R_{a2}$. The aliphatic-oxycarbonyl group and the aromatic-oxycarbonyl group for $R_{d6}$ has the same meanings as those for $Z_{c1}$.

The aliphatic amino group for $R_{d6}$ includes, for example, methylamino, diethylamino, octylamino, benzylamino, cyclohexylamino, dodecylamino, allylamino and hexadecylamino group. It is preferably an optionally substituted alkylamino group having from 1 to 30 carbon atoms. The aromatic amino group for $R_{d6}$ includes, for example, anilino, 2,4-dichloroanilino, 4-t-octylanilino, N-methylanilino, 2-methylanilino and N-hexadecylanilino groups. Preferably, it is an optionally substituted anilino group having from 6 to 37 carbon atoms. The aliphatic-oxy group for $R_{d6}$ includes, for example, methoxy, ethoxy, t-butyloxy, benzyloxy and cyclohexyloxy groups. Preferably, it is an optionally substituted alkoxy group having from 1 to 30 carbon atoms. The aromatic-oxy group for the same includes, for example, phenoxy, 2,4-di-t-butylphenoxy, 2-chlorophenoxy and 4-methoxyphenoxy groups. It is preferably an optionally substituted phenoxy group having from 6 to 37 carbon atoms.

The halogen atom for $R_{d10}$ includes, for example, chlorine, bromine and iodine atoms. The acyloxy group for $R_{d10}$ includes, for example, acetyloxy and benzoyloxy groups. It is preferably an optionally substituted acyloxy group having from 2 to 37 carbon atoms. The sulfonyl group for $R_{d10}$ has the same meaning as that for $R_{a2}$.

The hydrolyzable group for $R_{d11}$ includes, for example, an acyl group, a sulfonyl group, an oxalyl group and a silyl group.

The compounds of formulae (A) to (C) are preferably those having a secondary reaction speed constant $k_2$ (at 80° C.) with p-anisidine, which is measured by the method described in JP-A 63-158545, of falling within the range of from $1\times10^{-5}$ liter/mol.sec to 1.0 liter/mol.sec.

Of the compounds of formula (D), those where $R_{d1}$ is an aromatic group are preferred. In formula (D), when $Z_{d1}$ is $—SO_2Y$ and Y is a hydrogen atom, or an atom or atomic group of forming an inorganic or organic salt, then it is preferred that $R_{d1}$ is a phenyl group and that the sum of the Hammett's σ values of the substituent $—SO_2Y$ on the phenyl group is 0.5 or more. In this case, the σp value may be substituted for the σo value.

Of the compounds of formulae (A) to (D), preferred are those of formulae (A) and (D).

Of the compounds of formula (A), those of the following formulae (A-I) to (A-V) are preferred.

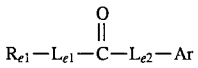

(A-I)

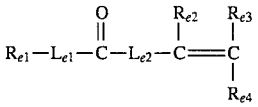

(A-II)

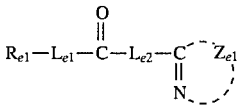

(A-III)

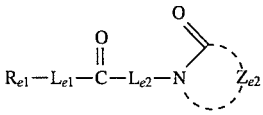

(A-IV)

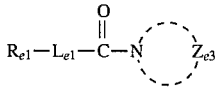

(A-V)

In formulae (A-I) to (A-V), $Re_1$ has the same meaning as $R_{a1}$ in formula (A); $Le_1$ represents a single bond or —O—; $Le_2$ represents —O— or —S—; Ar represents an aromatic group; $Re_2$ to $Re_4$ may be the same or different and each represents a hydrogen atom, an aliphatic group, an aromatic group, a heterocyclic group, an aliphatic-oxy group, an aromatic-oxy group, a heterocyclic-oxy group, an aliphatic-thio group, an aromatic-thio group, a heterocyclic-thio group, an amino group, an aliphatic amino group, an aromatic amino group, a heterocyclic amino group, an acyl group, an amido group, a sulfonamido group, a sulfonyl group, an aliphatic-oxycarbonyl group, an aromatic-oxycarbonyl group, a sulfo group, a carboxyl group, a formyl group, a hydroxyl group, an acyloxy group, an ureido group, an urethane group, a carbamoyl group or a sulfamoyl group; and at least two of $Re_2$ to $Re_4$ may be bonded to each other to form a 5-membered to 7-membered ring; $Ze_1$ and $Ze_2$ each represent a non-metallic atomic group necessary for forming a 5-membered to 7-membered ring; $Ze_3$ represents a non-metallic atomic group necessary for forming a 5-membered to 7-membered aromatic ring; the rings to be formed by $Ze_1$ to $Ze_3$ may optionally have substituent(s), or may form spiro rings or bicyclo rings or may be condensed with benzene ring(s), alicyclic ring(s) or heterocyclic ring(s).

Of the compounds of formulae (A-I) to (A-V), those of formulae (A-I) and (A-III) are preferred.

Specific examples of these compounds are mentioned below, which, however, are not limitative.

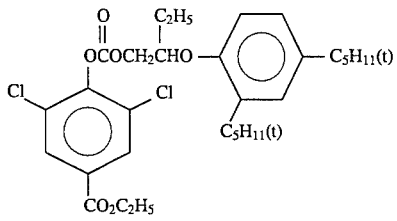

(ST-1)

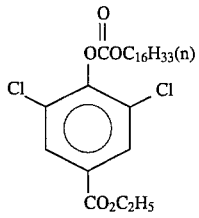

(ST-2)

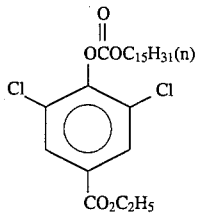

(ST-3)

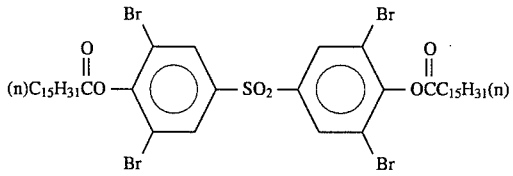

(ST-4)

-continued
(ST-5)
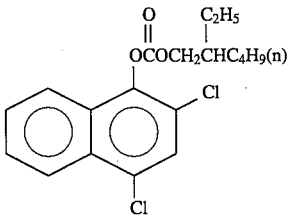
(ST-6)
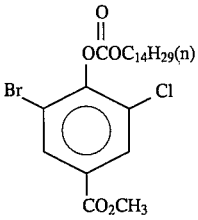
(ST-7)
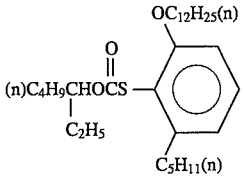
(ST-8)
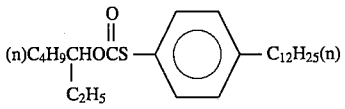
(ST-9)
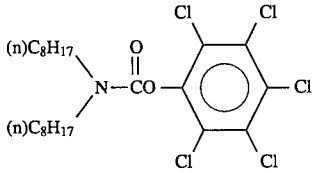
(ST-10)
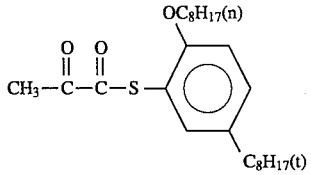
(ST-11)
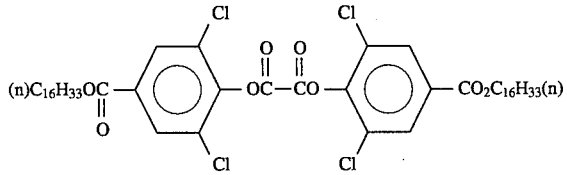
(ST-12)
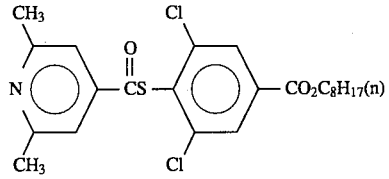
(ST-13)
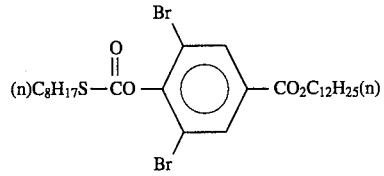

-continued
(ST-14)
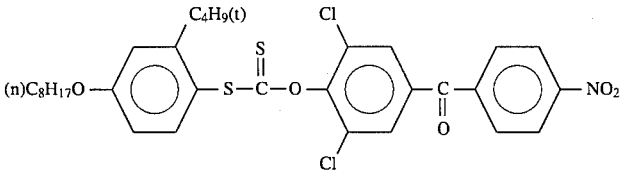
(ST-15)
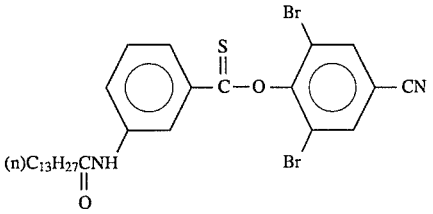
(ST-16)
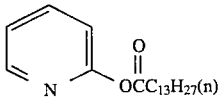
(ST-17)
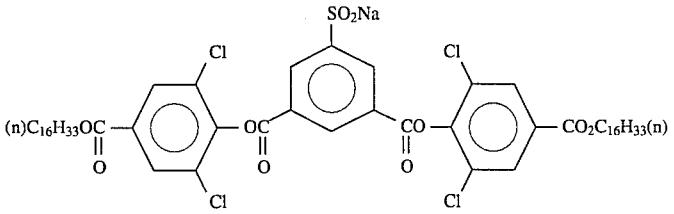
(ST-18)
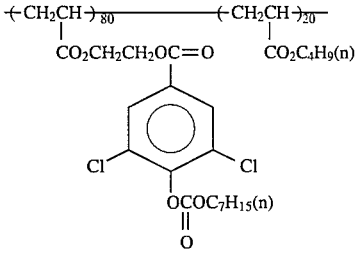
(ST-19)
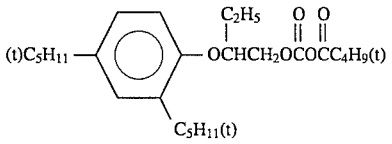
(ST-20)
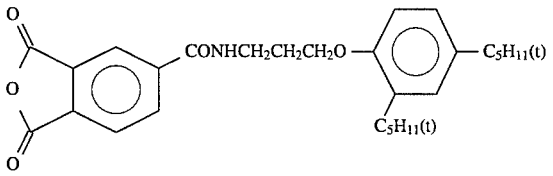
(ST-21)
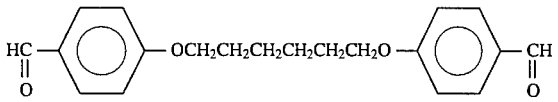
(ST-22)
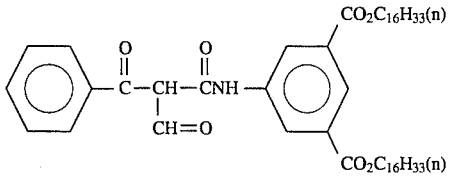

-continued
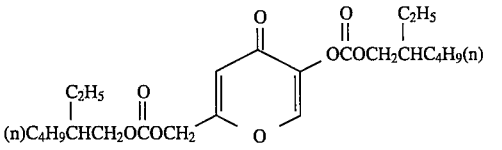
(ST-23)
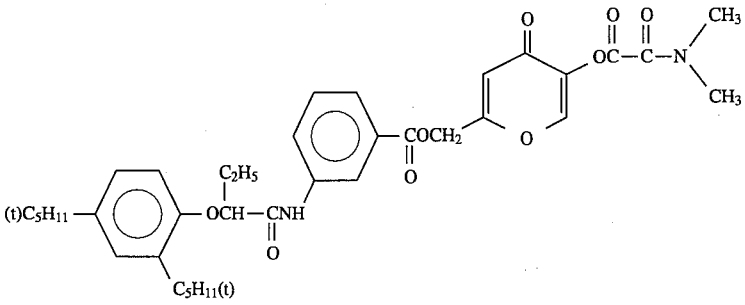
(ST-24)
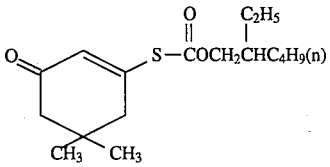
(ST-25)
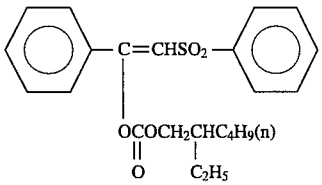
(ST-26)
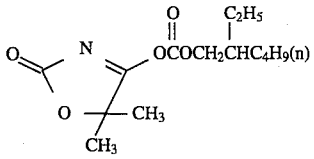
(ST-27)
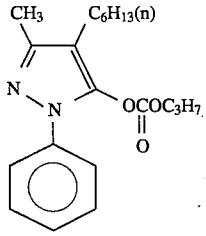
(ST-28)
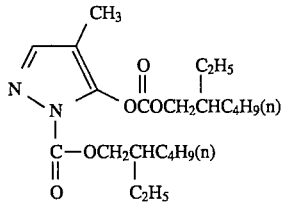
(ST-29)
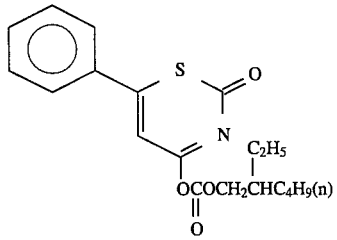
(ST-30)

-continued
(ST-31)
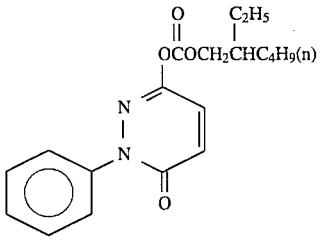
(ST-32)
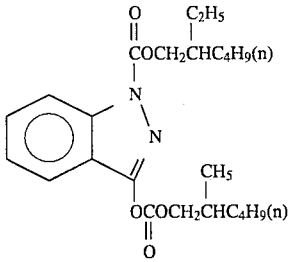
(ST-33)
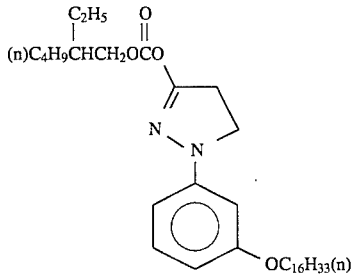
(ST-34)
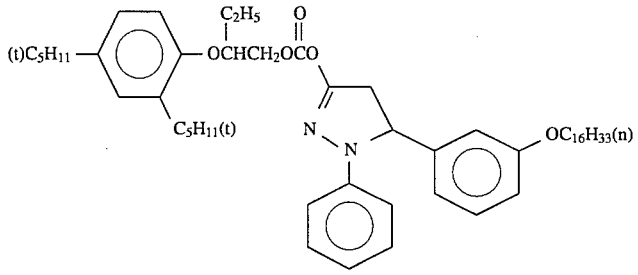
(ST-35)
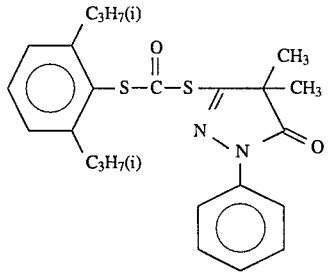
(ST-36)
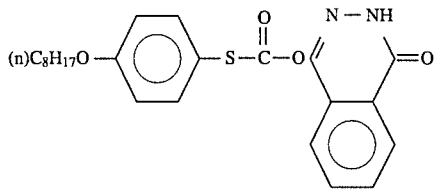

-continued
(ST-37)
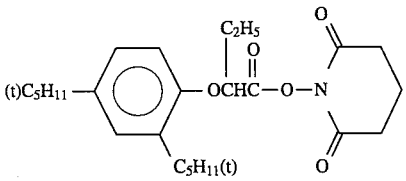
(ST-38)
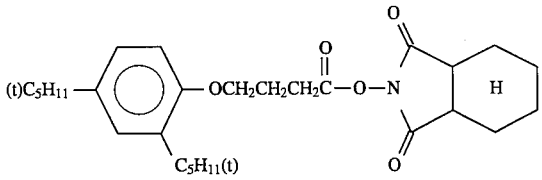
(ST-39)
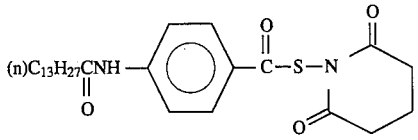
(ST-40)
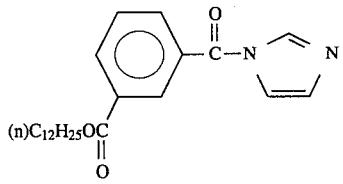
(ST-41)
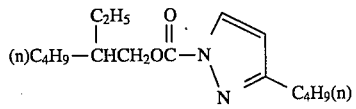
(ST-42)
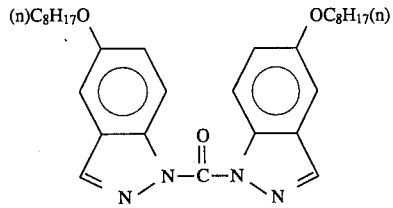
(ST-43)
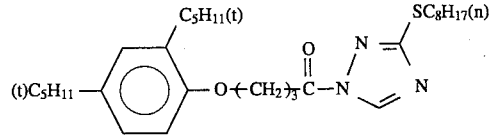
$(n)C_{18}H_{37}Br$ (ST-44)
$(n)C_{18}H_{37}I$ (ST-45)
(ST-46)
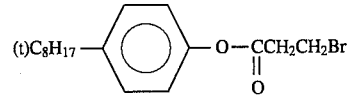
(ST-47)
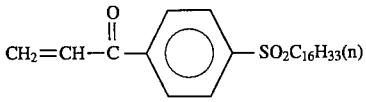
$CH_2{=}CH{-}SO_2{-}C_{18}H_{37}$ (ST-48)

-continued
(ST-49)
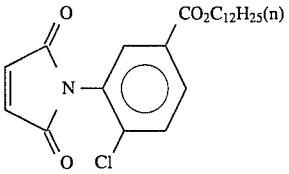
(ST-50)
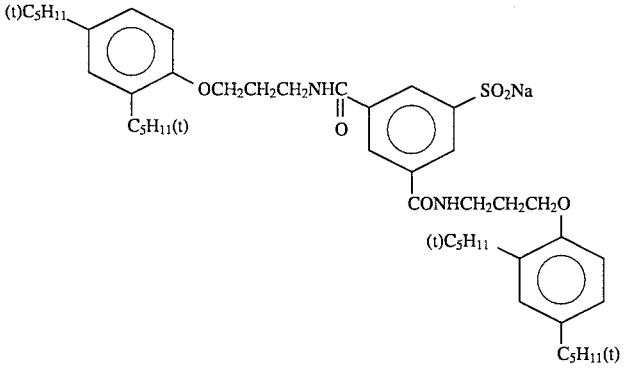
(ST-51)
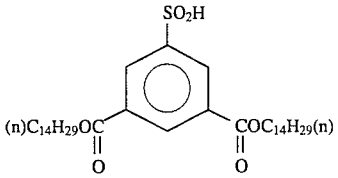
(ST-52)
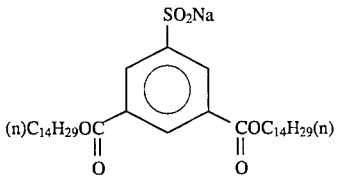
(ST-53)
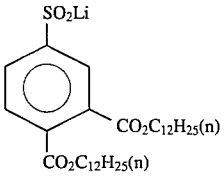
(ST-54)
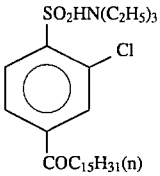
(ST-55)
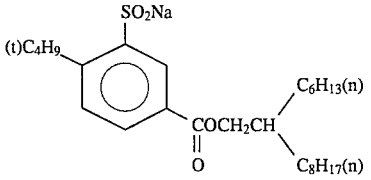
(ST-56)
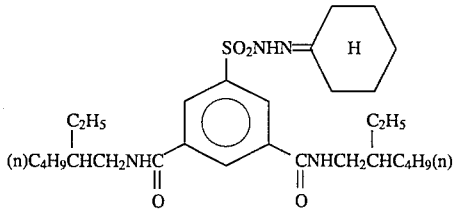

-continued
(ST-57)
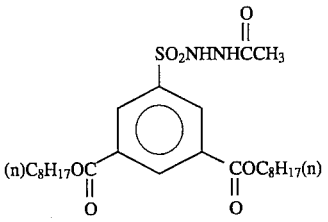
(ST-58)
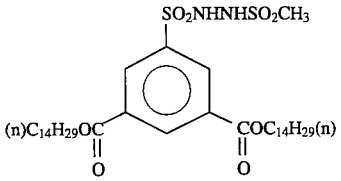
(ST-59)
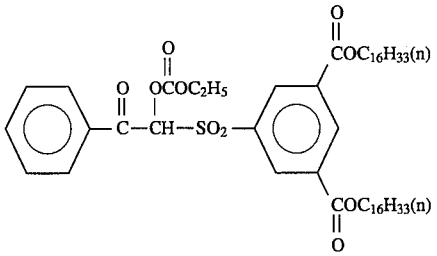
(ST-60)
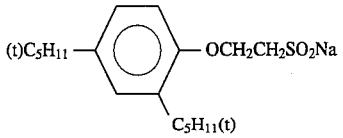
(ST-61)
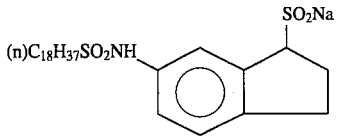
(ST-62)
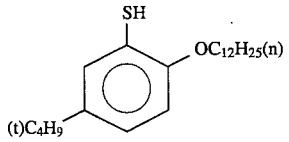
(ST-63)
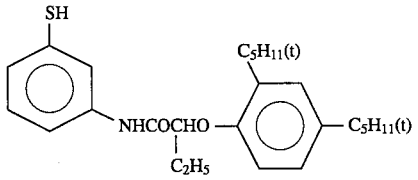
(ST-64)
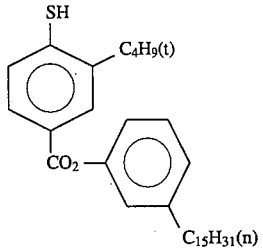
These compounds may be produced by the methods described in JP-A 62-143048, 63-115855, 63-115866, 63-158545, European Patent 255722, or by methods similar to them.
The preferred compounds mentioned above include the compounds concretely illustrated in the above-mentioned patent publications and also in JP-A 62-17665, 62-283338, 62-229145, 64-86139, 1-271748, Japanese Disclosure Bulletin 90-9416 (issued by the Invention Society of Japan).

The amount of the above-mentioned compound of formulae (A) to (C) to be used in the present invention varies, depending upon the kind of the coupler used. In general, it may be from 0.5 to 300 mol %, preferably from 1 to 200 mol %, most preferably from 5 to 150 mol %, relative to one mol of the coupler used.

The amount of the above-mentioned compound of formula (D) to be used in the present invention varies, depending upon the kind of the coupler used. In general, it may be from 0.01 to 200 mol %, preferably from 0.05 to 150 mol %, most preferably from 0.1 to 150 mol %, relative to one mol of the coupler used.

The above-mentioned compounds of formulae (A) to (D) are especially preferably used along with the couplers of formula (Ia) as their co-emulsions.

The above-mentioned compounds of formulae (A) to (D) may be used along with known anti-fading agents, whereby the anti-fading effect is much increased. Two or more of the compounds of formulae (A) to (D) may also be used, as combined.

As known anti-fading agents usable in the present invention, typically mentioned are hindered phenols such as hydroquinones, 6-hydroxychromans, 5-hydroxycoumarans, spirochromans, p-alkoxyphenols and bisphenols, as well as gallic acid derivatives, methylenedioxybenzenes, aminophenols, hindered amines, ultraviolet absorbents, and also ether or ester derivatives to be obtained by silylating or alkylating the phenolic hydroxyl group of these compounds. In addition, also usable are metal complexes such as (bis-salicylaldoximato)nickel complexes and (bis-N,N-dialkyldithiocarbamato)nickel complexes.

As examples of organic anti-fading agents usable in the present invention, mentioned are hydroquinones such as those described in U.S. Pat. Nos. 2,360,290, 2,418,613, 2,700,453, 2,701,197, 2,728,659, 2,732,300, 2,735,765, 3,982,944, 4,430,425, British Patent 1,363,921, U.S. Pat. Nos. 2,710,801, 2,816,028, etc.; 6-hydroxychromans, 5-hydroxycoumarans and spirochromans, such as those described in U.S. Pat. Nos. 3,432,300, 3,573,050, 3,574,627, 3,698,909, 3,764,337, JP-A 52-152225; spiroindanes such as those described in U.S. Pat. No. 4,360,589; p-alkoxyphenols such as those described in U.S. Pat. No. 2,735,765, British Patent 2,066,975, JP-A 59-10539, JP-B 57-19765; hindered phenols such as those described in U.S. Pat. Nos. 3,700,455, 4,228,235, JP-A 52-72224, JP-B 52-6623; gallic acid derivatives such as those described in U.S. Pat. No. 3,457,079; methylenedioxybenzenes such as those described in U.S. Pat. No. 4,332,886; aminophenols such as those described in JP-B 56-21144; hindered amines such as those described in U.S. Pat. Nos. 3,336,135, 4,268,593, British Patents 1,326,889, 1,354,313, 1,410,846, JP-B 51-1420, JP-A 58-114036, 59-53846, 59-78344; and metal complexes such as those described in U.S. Pat. Nos. 4,050,938, 4,241,155, British Patent 2,027,731(A).

The cyan couplers of the present invention and the above-mentioned oil-soluble compounds can be introduced into the photographic material by various known dispersion methods. Preferred is an oil-in-water dispersion method in which the coupler or the compound is dissolved in a high boiling point organic solvent (if desired, along with a low boiling point organic solvent) and the resulting solution is dispersed in an aqueous gelatin solution by emulsification and added to a silver halide emulsion.

Examples of high boiling point solvents to be used in an oil-in-water dispersion method which may be employed in the present invention are described in U.S. Pat. No. 2,322,027. As one polymer dispersion method, known is a latex dispersion method which may also be employed in the present invention. The process of such a latex dispersion method, the effect of the same and specific examples of latexes for impregnation to be used in the method are described in U.S. Pat. No. 4,199,363, German Patent OLS Nos. 2,541,274 and 2,541,230, JP-B 53-41091 and European Patent Laid-Open No. 029104. A dispersion method of using organic solvent-soluble polymers may also be employed in the present invention, which is described in PCT Laid-Open WO88/00723.

As examples of high boiling point organic solvents usable in the above-mentioned oil-in-water method, there are mentioned phthalates (e.g., dibutyl phthalate, dioctyl phthalate, dicyclohexyl phthalate, di-2-ethylhexyl phthalate, decyl phthalate, bis(2,4-di-t-amylphenyl) isophthalate, bis(1,1-diehtylpropyl)phthalate), phosphates or phosphonates (e.g., diphenyl phosphate, triphenyl phosphate, tricresyl phosphate, 2-ethylhexyldiphenyl phosphate, dioctylbutyl phosphate, tricyclohexyl phosphate, tri-2-ethylhexyl phosphate, tridodecyl phosphate, di-2-ethylhexylphenyl phosphate), benzoates (e.g., 2-ethylhexyl benzoate, 2,4-dichlorobenzoate, dodecyl benzoate, 2-ethylhexyl p-hydroxybenzoate), amides (e.g., N,N-diethyldodecanamide, N,N-diethyllaurylamide), alcohols or phenols (e.g., isostearyl alcohol, 2,4-di-tert-amylphenol), aliphatic esters (e.g., dibutoxyethyl succinate, di-2-ethylhexyl succinate, 2-hexyldecyl tetradecanoate, tributyl citrate, diethyl azelate, isostearyl lactate, trioctyl citrate), aniline derivatives (e.g., N,N-dibutyl-2-butoxy-5-tert-octylaniline), chlorinated paraffins (e.g., paraffins having chlorine content of from 10% to 80%), trimesates (e.g., tributyl trimesate), dodecylbenzene, diisopropylnaphthalene, phenols (e.g., 2,4-di-tert-amylphenol, 4-dodecyloxyphenol, 4-dodecyloxycarbonylphenol 4-(4-dodecyloxyphenylsulfonyl) phenol), carboxylic acids (e.g., 2-(2,4-di-tert-amylphenoxybutyric acid, 2-ethoxyoctanedecanoic acid), and alkylphosphoric acids (e.g., di-(2-ehtylhexyl)phosphoric acid, diphenylphosphoric acid). As auxiliary solvents usable along with the high boiling point organic solvents, there are mentioned, for example, organic solvents having a boiling point of approximately from 30° C. to 160° C., such as ethyl acetate, butyl acetate, ethyl propionate, methyl ethyl ketone, cyclohexanone, 2-ethoxyethyl acetate, and dimethylformamide.

The proportion of the high boiling point organic solvent to be used in this case may be from 0 to 2.0 times, preferably from 0 to 1.0 time, by weight to the coupler.

The pH value of the film coated on the silver halide color photographic material of the present invention must be from 4.0 to 6.5, preferably from 5.0 to 6.0. If it is higher than 6.5, the pressure resistance of the material will be bad; but if it is lower than 4.0, such will cause a problem in that the hardening of the material is retarded. The pH value of the film as referred to herein means that of the film composed of all the photographic layers to be formed by coating all the necessary coating compositions on the support. Therefore, it does not always correspond to the pH value of the coating compositions.

The pH value of the film in question may be measured by the method described in JP-A 61-245153, which is as follows:

The method comprises (1) dropping 0.05 cc of pure water onto the light-sensitive surface of the material coated with silver halide emulsions, followed by (2) measuring the pH value of the coated film with a film pH-measuring electrode device (GS-165F Model, made by Toa Dempa Co.) after 3 minutes.

The adjustment of the pH value of the film may be effected by adding, if desired, an acid (e.g., sulfuric acid, citric acid) or an alkali (e.g., sodium hydroxide, potassium hydroxide), to the coating compositions.

As the silver halide grains for use in the present invention, preferred are silver chloride, silver chlorobromide or silver chloroiodobromide grains having a silver chloride content of 95 mol % or more. Especially preferred are silver chlorobromide or silver chloride grains substantially not containing silver iodide, in order to shorten the developing time for processing the photographic material. Silver halide grains substantially not containing silver iodide as referred to herein means those having a silver iodide content of 1 mol % or less, preferably 0.2 mol % or less. On the other hand, in order to increase the high intensity sensitivity, to increase the color-sensitized sensitivity or to improve the storage stability of the photographic material, high-silver chloride grains containing from 0.01 to 3 mol % of silver iodide on their surfaces, such as those described in JP-A 3-84545 may also be preferably used as in some case. Regarding the halogen composition of grains of constituting an emulsion for use in the present invention, the grains may have different halogen compositions. Preferably, however, the emulsion contains grains each having the same halogen composition, as the property of the grains may easily be homogenized. Regarding the halide composition distribution of the grains of constituting a silver halide emulsion for use in the present invention, the grain may have a so-called uniform halogen composition structure where any part of the grain has the same halogen composition; or the grain may have a so-called laminate (core/shell) structure where the halogen composition of the core of the grain is different from that of the shell of the same; or the grain may have a composite halogen composition structure where the inside or surface of the grain has a non-layered different halogen composition part (for example, when such a non-layered different halogen composition part is on the surface of the grain, it may be on the edge, corner or plane of the grain as a conjugated structure). Any of such halogen compositions may properly be selected. In order to obtain a high sensitivity photographic material, the latter laminate or composite halogen composition structure grains are advantageously employed, rather than the first uniform halogen composition structure grains. Such laminate or composite halogen composition structure grains are also preferred for preventing generation of pressure marks. In the case of laminate or composite halogen composition structure grains, the boundary between the different halogen composition parts may be a definite one or may also be an indefinite one of forming a mixed crystal structure because of the difference in the halogen compositions between the adjacent parts. If desired, the boundary between them may positively have a continuous structure variation.

The high-silver chloride grains for use in the present invention are preferably those having layered or non-layered, localized phases of silver bromide in the inside and/or on the surface of the silver halide grain, in the manner as mentioned above. The halide composition in the localized phase is preferably such that the phase has a silver bromide content of at least 10 mol %, more preferably higher than 20 mol %. The silver bromide content in the localized phase may be analyzed by X-ray diffraction (for example, described in *Lecture on New Experimental Chemistry*, No. 6, Analysis of Structure, edited by Japan Chemical Society, published by Maruzen Publishing Co.). The localized phase may be in the inside of the grain and/or on the edges, corners and/or planes of the surface of the grain. As one preferred example, mentioned is an embodiment where the localized phase has grown on the corners of the grain by epitaxial growth.

In order to reduce the amount of the replenisher to the developer to be used in processing the photographic material of the present invention, it is effective to further increase the silver chloride content in the silver halide emulsions constituting the material. In this case, preferably used are almost pure silver chloride emulsions having a silver chloride content of from 98 mol % to 100 mol %.

The silver halide grains of constituting the silver halide emulsion of the present invention may have a mean grain size of preferably from 0.1 μm to 2 μm. (The grain size indicates a diameter of a circle having an area equivalent to the projected area of the grain, and the mean grain size indicates a number average value to be obtained from the measured grain sizes.)

Regarding the grain size distribution of the emulsion, a so-called monodispersed emulsion having a fluctuation coefficient (to be obtained by dividing the standard deviation of the grain size distribution by the mean grain size) of being 20% or less, preferably 15% or less, more preferably 10% or less is preferred. For the purpose of obtaining a broad latitude, two or more monodispersed emulsions may be blended to form a mixed emulsion for one layer, or they may be separately coated to form plural layers. Such blending or separate coating is preferably effected for this purpose.

Regarding the shape of the silver halide grains of constituting the photographic emulsion of the present invention, the grains may be regular crystalline ones such as cubic, tetradecahedral or octahedral crystalline ones, or irregular crystalline ones such as spherical or tabular crystalline ones, or may be composite crystalline ones composed of such regular and irregular crystalline ones. Mixtures of grains having different crystal forms may also be used in the present invention. Of these, preferred are mixtures containing the above-mentioned regular crystalline grains in a proportion of 50% or more, preferably 70% or more, more preferably 90% or more.

Apart from these, silver halide emulsions containing tabular grains having a mean aspect ratio (circle-corresponding diameter/thickness) of 5 or more, preferably 8 or more, in a proportion of 50% or more of the total grains in terms of their projected areas are also preferably used in the present invention.

The silver (bromo)chloride emulsions for use in the present invention may be prepared, for example, by the methods described in P. Glafkides, *Chemie et Phisique Photographique* (published by Paul Montel, 1967); G. F. Duffin, *Photographic Emulsion Chemistry* (published by Focal Press, 1966); and V. L. Zelikman et al., *Making and Coating Photographic Emulsion* (published by Focal Press, 1964). Briefly, they may be prepared by any of acid methods, neutral methods and ammonia methods. As the system of reacting soluble silver salts and soluble halides, employable is any of a single jet method, a double jet method and a combination of them. Also employable is a so-called reversed mixing method where silver halide grains are formed in an atmosphere having excess silver ions. As one system of a double jet method, employable is a so-called controlled double jet method, in which the pAg in the liquid phase where silver halide grains are being formed is kept constant. According to this method, silver halide emulsions comprising regular crystalline grains having nearly uniform grain sizes may be obtained.

It is preferred that the localized phase or the base of the silver halide grain of the present invention contains heterologous metal ions or complex ions. As preferred metal ions for this use, mentioned are metal ions belonging to the Group VIII and the Group IIb of the Periodic Table and their complexes, as well as lead ion and thallium ion. Specifically, the localized phase may contain ions chosen from among iridium ion, rhodium ion and iron ions and their complex ions while the base may contain ions chosen from among osmium ion, iridium ion, rhodium ion, platinum ion, ruthenium ion, palladium ion, cobalt ion, nickel ion and iron ion and their complex ions, optionally as combined. The localized phase and the base in one grain may have different contents of different metal ions. They may contain a plurality of such metal ions and complex ions. In particular, it is preferred that the localized phase of silver bromide contains iron and iridium compounds.

Compounds donating such metal ions may be incorporated into the localized phase and/or the other part (base) of the silver halide grains of the present invention, for example, by adding the compound to an aqueous gelatin solution which is to be a dispersing medium, or to an aqueous halide solution, an aqueous silver salt solution or other aqueous solutions at the step of forming the silver halide grains, or in the form of fine silver halide grains containing the metal ions which are dissolved in the system from which the silver halide grains are formed.

The incorporation of the metal ions into the silver halide grains of the present invention may be effected before, during or just after the formation of the grains. The time when the incorporation is effected may be determined, depending on the position of the grain into which the metal ion shall be incorporated.

The silver halide emulsions for use in the present invention is generally subjected to chemical sensitization and color sensitization.

The chemical sensitization includes, for example, chalcogen sensitization using a chalcogen sensitizing agent (such as typically sulfur sensitization using unstable sulfur compounds, selenium sensitization using selenium compounds, tellurium sensitization using tellurium compounds), noble metal sensitization (such as typically gold sensitization) and reduction sensitization, which may be employed singly or as combined. As the compounds to be used for such chemical sensitization, for example, preferred are those described in JP-A 62-215272, from page 18, right bottom column to page 22, right top column.

To more effectively attain the effect of the present invention, gold-sensitized, high-silver chloride emulsions are used in the present invention.

The emulsions to be used in the present invention are so-called surface latent image-type emulsions which form latent images essentially on the surfaces of the grains.

The silver halide emulsions for use in the present invention may contain various compounds or precursors, for the purpose of preventing the photographic material from being fogged during preparation, storage or photographic processing of the material and of stabilizing the photographic properties of the material. Specific examples of such compounds which are preferably used in the present invention are described in the above-mentioned JP-A 62-215272, pages 39 to 72. In addition, the 5-arylamino-1,2,3,4-thiatriazole compounds (where the aryl residue has at least one electron-attracting group) described in EP 0447647 are also preferably used in the present invention.

The color sensitization is effected so as to make the emulsions of the layers constituting the photographic material of the present invention sensitive to light falling within a desired wavelength range.

For the color sensitization, used are color-sensitizing dyes effective in making photographic emulsions sensitive to blue, green and red ranges. Such are described in, for example, F. M Harmer, Heterocyclic Compound—Cyanine Dyes and Related Compounds (John Wiley & Sons, New York, London, 1964). Specific examples of color-sensitizing compounds as well as color-sensitizing methods which are preferably employed in the present invention are described in, for example, the above-mentioned JP-A 62-215272, from page 22, right top column to page 38. In particular, the color-sensitizing dyes described in JP-A 3-123340 are especially preferred as red-sensitizing dyes to be applied to silver halide grains having a high silver chloride content, in view of the high stability of the dyes themselves, the high intensity of adsorption of the dyes to silver halide grains, and the low temperature dependence of the dyes during exposure of photographic materials.

Where the photographic material of the present invention is desired to be made highly sensitive to infrared range, preferably used are the sensitizing dyes described in JP-A 3-15049, from page 12, left top column to page 21, left bottom column; JP-A 3-20730, from page 4, left bottom column to page 15, left bottom column; EP 0420011, from page 4, line 21 to page 6, line 54; EP 0420012, from page 4, line 12 to page 10, line 33; and EP 0443466, U.S. Pat. No. 4,975,362.

To incorporate these color-sensitizing dyes into the silver halide emulsions of the present invention, for example, they may be directly dispersed thereinto, or alternatively, they are first dissolved in a single solvent such as water, methanol, ethanol, propanol, methyl cellosolve, 2,2,3,3-tetrafluoropropanol, etc. or a mixed solvent comprising them, and thereafter the resulting solution may be added to the emulsions. Alternatively, the dyes are formed into aqueous solutions in the presence of acids or bases in the manner such as those described in JP-B 44-23389, 44-27555, 57-22089, or are formed into aqueous solutions or colloidal dispersion in the presence of surfactants in the manner such as that described in U.S. Pat. Nos. 3,822,135, and 4,006,025, and the resulting solutions or dispersions may be added to the emulsions. Also, they may be first dissolved in solvents which are substantially immiscible with water, such as phenoxyethanol, etc. and then dispersed in water or hydrophilic colloids, and the resulting dispersions may be added to the emulsions. Also, they may be directly dispersed into hydrophilic colloids in the manner such as those described in JP-A 53-102733, 58-105141, and the resulting dispersions may be added to the emulsions. Anyhow, the color-sensitizing dyes may be added to the emulsions at any time when the emulsions are prepared. In other words, the time when the dyes are added to the emulsions may be any of before or during formation of the silver halide grains, immediately after formation of them and before rinsing them, before or during chemical sensitization of them, immediately after chemical sensitization of them and before cooling and solidifying them, and during preparation of coating compositions. More generally, the dyes are added to the emulsions after chemical sensitization of the emulsions and before coating them. If desired, however, the dyes may be added to the emulsions along with chemically-sensitizing dyes so as to effect the color sensitization and the chemical sensitization of the emulsions at the same time, in the manner such as that described in U.S. Pat. Nos. 3,628,969, and 4,225,666; or the dyes may be added to the emulsions prior to the chemical sensitization of the emulsions in the manner such as that described in JP-A 58-113928; or the color sensitization of the emulsions may be started before the completion of the formation of precipitates of silver halide grains. In addition, it is also possible to divide the color-sensitizing dye to be added into plural parts, which are added to the emulsions at several times, in the manner such as that taught by U.S. Pat. No. 4,225,666. According to the process, a part of the color-sensitizing dye is added to the emulsions prior to the chemical sensitization of them and the remaining part thereof is added thereto after the chemical sensitization. The addition of the color-sensitizing dyes to the photographic emulsions may be effected at any time when the silver halide grains are formed, for example, in accordance with the process taught by U.S. Pat. No. 4,183,756. Of the above-mentioned methods, especially preferred is the method where the dyes are added to the emulsions before the step of rinsing the emulsions or before the step of chemically sensitizing them.

The amount of the color-sensitizing dye to be added varies in a broad range, depending on the case of using it. Preferred is the range of from $0.5\times10^{-6}$ mol to $1.0\times10^{-2}$ mol, more preferably from $1.0\times10^{-6}$ mol to $5.0\times10^{-3}$ mol, relative to one mol of the silver halide to which the dye is added.

When the photographic material of the present invention contains color-sensitizing dyes capable of making it sensitive to light falling within a red to infrared range, it is preferred to incorporate into the photographic material the compounds described in JP-A 2-157749, from page 13, right bottom column to page 22, right bottom column, along with the dyes. Using these compounds, the storability of the photographic material, the stability during processing the material and the supercolor-sensitizing effect of the material may be specifically improved. Above all, the compounds of formulae (IV), (V) and (VI) described in said patent publication are especially preferred. The compound is added to the photographic material in an amount of from $0.5\times10^{-5}$ mol to $5.0\times10^{-2}$ mol, preferably from $5.0\times10^{-5}$ mol to $5.0\times10^{-3}$ mol, relative to one mol of the silver halide in the material. The preferred range of the amount of the compound to be added is from 0.1 to 10000 molar times, preferably from 0.5 to molar 5000 times the sensitizing dye to be combined with the compound.

The photographic material of the present invention may be applied to a printing system using an ordinary negative printer. In addition to this, the material is also preferably applied to digital scanning exposure using monochromatic high-density lights such as gas lasers, light-emitting diodes, semiconductor lasers, secondary high-harmonics generating light sources (SHG) comprising a combination of a semiconductor laser or a solid laser where a semiconductor laser is used as an exciting light source and non-linear optical crystals, etc. In order to make the system compact and low-priced, use of semiconductor lasers or secondary high-harmonics generating light sources (SHG) comprising a combination of a semiconductor laser or solid laser and non-linear optical crystals is preferred. In particular, in order to design a low-priced, long-life and highly-safe device, use of semiconductor lasers is preferred, and it is desired to use a semiconductor laser as at least one light source for exposure.

When the above-mentioned light sources for scanning exposure are used, the maximum color sensitivity of the photographic material of the present invention may be freely defined, depending on the wavelength of the light source to be used for scanning exposure of the material. Using SHG light sources to be obtained by combining a solid laser where a semiconductor is used as the exciting light source or a semiconductor and non-linear optical crystals, the oscillating wavelength of the laser may be halved so that blue light and green light may be obtained. Therefore, the maximum color sensitivity of the photographic material to be exposed with such light sources may fall within ordinary ranges of three colors of blue, green and red. When semiconductor lasers are used as light sources so as to make the exposure device low-priced, highly-safe and compact, it is preferred that at least two layers constituting the photographic material to be exposed to them have a maximum color sensitivity at 670 nm or longer. This is because the wavelength range of the light to be emitted by low-priced and stable III–V Groups semiconductor lasers which are available at present is only from red to infrared range. In a laboratory level, however, oscillation of II–VI Groups semiconductor lasers in green to blue range has been confirmed. Therefore, it is surely expected that such semiconductor lasers may be used stably at low costs, after further development of the technique of producing such semiconductor lasers. If so, the necessity of making the photographic material have at least two photographic emulsion layers that have a maximum color sensitivity at 670 nm or longer will be neglected.

In such scanning exposure, the period of time for which the silver halides in the photographic material are exposed means the period of time for which a certain small area of the material is exposed. As the small area, generally used is the minimum unit for which the quantity of light is controlled from the corresponding digital data. The minimum unit is referred to as a pixel. Therefore, the exposure time per pixel shall be varied, depending on the size of pixel. The size of pixel depends on the pixel density, and its actual range is from 50 to 2000 dpi. Where the exposure time is defined to be such that one pixel having a pixel density of 400 dpi is exposed for the defined time, the preferred exposure time may be $10^{-4}$ second or less, more preferably $10^{-6}$ second or less.

The photographic material of the present invention preferably contains dyes which are decolored by photographic processing, such as those described in EP 0337490A2, pages 27 to 76, especially oxonole dyes or cyanine dyes, in its hydrophilic colloid layers, for the purpose of anti-irradiation and anti-halation and of improving the safety of the material against safelight.

Some of these water-soluble dyes often worsen the color separation of processed photographic materials or the safety thereof against safelight, if their amounts added are increased. As dyes which can be used without worsening the color separation of processed photographic materials, preferred are the water-soluble dyes described in JP-A 5-127324, 5-127325 and 5-216185.

The photographic material of the present invention may have a colored layer, in place of or along with the water-soluble dyes, which may be decolored while the material is processed. The colored layer to be used, which may be decolored while the photographic material is processed, may be kept in direct contact with the emulsion layers or may be disposed in the material in such a way that it is kept in indirect contact with the emulsion layers via an interlayer containing gelatin or a color mixing preventing agent such as hydroquinone. It is preferred that the colored layer is disposed below the emulsion layer (nearer to the support than the emulsion layer), which colors to give a primary color of the same kind as the color of the colored layer. It is possible either to dispose the corresponding colored layer below each of all the emulsion layers in accordance with the primary color to be yielded by each emulsion layer or to dispose it below some of those freely selected from the emulsion layers. It is also possible to dispose a colored layer corresponding to plural emulsion layers yielding different colors. It is preferred that the optical reflective density of the colored layer falls from 0.2 to 3.0, more preferably from 0.5 to 2.5, especially preferably from 0.8 to 2.0, at the wavelength of the highest optical density in the wavelength range of the light to be used for exposing the photographic material. (The wavelength range is the range of visible rays, which is from 400 nm to 700 nm, for ordinary printer exposure, while, for scanning exposure, it corresponds to the wavelength range of the light source to be used for scanning exposure.)

To provide the colored layer in the photographic material of the present invention, any known method may be employed. For instance, employable are a method of incorporating a dispersion of fine grains of a solid dye, such as those described in JP-A 2-282244, from page 3, right top column to page 8 and those described in JP-A 3-7931, from page 3, right top column to page 11, left bottom column, into a hydrophilic colloid layer; a method of mordanting a cationic polymer with an anionic dye; a method of making a dye adsorb to fine grains of silver halides, etc. to thereby fix the dye in the colored layer; and a method of using a colloidal silver such as that described in JP-A 1-239544. As the method of dispersing fine grains of a solid dye into a hydrophilic colloid layer, for example, JP-A 2-308244 has disclosed, on pages 4 to 13, a method of incorporating fine grains of a dye which is substantially insoluble in water at least at pH 6 or lower but is substantially soluble in water at least at pH 8 or higher, into a colloid layer. One example of the method of mordanting a cationic polymer with an anionic dye has been described in JP-A 2-84637, pages 18 to 26. Methods for preparing colloidal silvers, which act as a light-absorbing agent, are disclosed in U.S. Pat. Nos. 2,688,601 and 3,459,563. Of these methods, preferred are the method of incorporating fine dye grains and the method of using a colloidal silver.

As the binder or protective colloid which may be used in the photographic material of the present invention, gelatin is preferred but any other hydrophilic colloid may also be used singly or along with gelatin. As the gelatin, preferred is a low-calcium gelatin having a calcium content of 800 ppm or less, more preferably 200 ppm or less. In order to prevent the growth of various fungi or bacteria, which grow in hydrophilic colloid layers to worsen the image quality of the images to be formed, it is preferred to add a fundicidal agent such as that described in JP-A 63-271247 to the hydrophilic colloid layers constituting the photographic material of the present invention.

Where the photographic material of the present invention is subjected to printer exposure, it is preferred to use a band-stop filter such as those described in U.S. Pat. No. 4,880,726. Using this, color mixing may be inhibited so that the color reproducibility of the photographic material is noticeably improved.

The exposed photographic material of the present invention is processed according to conventional color development. To rapidly process it, the material is, after having been subjected to color development, preferably blixed. In particular, when the material contains the above-mentioned high-silver chloride emulsions, the pH value of the blixer to be used is preferably about 6.5 or less, more preferably about 6 or less, so as to promote the desilvering of the material.

As silver halide emulsions and other elements (e.g., additives, etc.) of constituting the photographic material of the present invention, photographic layers of constituting the material (e.g., arrangement of layers), and methods of processing the material and additives usable in the processing methods, those described in the following patent publications, especially in European Patent 0,355,660A2 (corresponding to JP-A 2-139544), are preferably employed.

| Photographic Elements | JP-A 62-215272 | JP-A 2-33144 | EP 0,355,660A2 |
|---|---|---|---|
| Silver Halide Emulsions | From page 10, right upper column, line 6 to page 12, left lower column, line 5; and from page 12, right lower column, line 4 to page 13, left upper column, line 17 | From page 28, right upper column, line 16 to page 29, right lower column, line 11; and page 30, lines 2 to 5 | From page 45, line 53 to page 47, line 3; and page 47, lines 20 to 22 |
| Silver Halide Solvents | Page 12, left lower column, lines 6 to 14; and from page 13, left upper column, line 3 from below to page 18, left lower column, last line | — | — |
| Chemical Sensitizers | Page 12, from left lower column, line 3 from below to right lower column, line 5 from below; and from page 18, right lower column, line 1 to page 22, right upper column, line 9 from below | Page 29, right lower column, line 12 to last line | Page 47, lines 4 to 9 |
| Color Sensitizers (Color Sensitizing Methods) | From page 22, right upper column, line 8 from below to page 38, last line | Page 30, left upper column, lines 1 to 13 | Page 47, lines 10 to 15 |
| Emulsion Stabilizers | From page 39, left upper column, line 1 to page 72, right upper column, last line | Page 30, from left upper column, line 14 to right upper column, line 1 | Page 47, lines 16 to 19 |
| Development Promoters | From page 72, left lower column, line 1 to page 91, right upper column, line 3 | — | — |
| Color Couplers (Cyan, Magenta and Yellow Couplers) | From page 91, right upper column, line 4 to page 121, left upper column, line 6 | From page 3, right upper column, line 14 to page 18, left upper column, last line; and from page 30, right upper column, line 6 to page 35, right lower column, line 11 | Page 4, lines 15 to 27; from page 5, line 30 to page 8, last line; page 45, lines 29 to 31; and from page 47, line 23 to page 63, line 50 |

-continued

| Photographic Elements | JP-A 62-215272 | JP-A 2-33144 | EP 0,355,660A2 |
|---|---|---|---|
| Coloring Enhancers | From page 121, left upper column, line 7 to page 125, right upper column, line 1 | — | — |
| Ultraviolet Absorbents | From page 125, right upper column, line 2 to page 127, left lower column, last line | From page 37, right lower column, line 14 to page 38, left upper column, line 11 | Page 65, lines 22 to 31 |
| Anti-fading Agents (Color Image Stabilizers) | From page 127, right lower column, line 1 to page 137, left lower column, line 8 | From page 36, right upper column, line 12 to page 37, left upper column, line 19 | From page 4, line 30 to page 5, line 23; from page 29, line 1 to page 45, line 25; page 45, lines 33 to 40; and page 65, lines 2 to 21 |
| High Boiling Point and/or Low Boiling Point Organic Solvents | From page 137, left lower column, line 9 to page 144, right upper column, last line | From page 35, right lower column, line 14 to page 36, left upper column, line 4 from below | Page 64, lines 1 to 51 |
| Dispersing Methods of Photographic Additives | From page 144, left lower column, line 1 to page 146, right upper column, line 7 | From page 27, right lower column, line 10 to page 28, left upper column, last line; and from page 35, right lower column, line 12, to page 36, right upper column, line 7 | From page 63, line 51 to page 64, line 56 |
| Hardening Agents | From page 146, right upper column, line 8 to page 155, left lower column, line 4 | — | — |
| Developing Agent Precursors | Page 155, from left lower column, line 5 to right lower column, line 2 | — | — |
| Development Inhibitor Releasing Compounds | Page 155, right lower column, lines 3 to 9 | — | — |
| Constitution of Photographic Layers | Page 156, from left upper column, line 15 to right lower column, line 14 | Page 28, right upper column, lines 1 to 15 | Page 45, lines 41 to 52 |
| Dyes | From page 156, right lower column, line 15 to page 184, right lower column, last line | Page 38, from left upper column, line 12 to right upper column, line 7 | Page 66, lines 18 to 22 |
| Color Mixing Preventing Agents | From page 185, left upper column, line 1 to page 188, right lower column, line 3 | Page 36, right upper column, lines 8 to 11 | From page 64, line 57 to page 65, line 1 |
| Gradation Adjusting Agents | Page 188, right lower column, lines 4 to 8 | — | — |
| Stain Inhibitors | From page 188, right lower column, line 9 to page 193, right lower column, line 10 | Page 37, from left upper column, last line to right lower column, line 13 | From page 65, line 32 to page 66, line 17 |
| Surfactants | From page 201, left lower column, line 1 to page 210, right upper column, last one | From page 18, right upper column, line 1 to page 24, right lower column, last line; and page 27, from left lower column, line 10 from below to right lower column, line 9 | — |
| Fluorine-containing Compounds (as antistatic agents, coating aids, lubricants, and anti-blocking agents) | From page 210, left lower column, line 1 to page 222, left lower column, line 5 | From page 25, left upper column, line 1 to page 27, right lower column, line 9 | — |
| Binders (hydrophilic colloids) | From page 222, left lower column, line 6 to page 225, left upper column, last line | Page 38, right upper column, lines 8 to 18 | Page 66, lines 23 to 28 |
| Tackifiers | From page 225, right upper column, line 1 to page 227, right upper column, line 2 | — | — |
| Antistatic Agents | From page 227, right upper column, line 3 to page 230, left upper column, line 1 | — | — |
| Polymer Latexes | From page 230, left upper column, line 2 to page 239, last line | — | — |
| Mat Agents | Page 240, from left upper column, line 1 to right upper column, last line | — | — |
| Photographic Processing Methods (Processing steps and additives) | From page 3, right upper column, line 7 to page 10, right upper column, line 5 | From page 39, left upper column, line 4 to page 42, left upper column, last line | From page 67, line 14 to page 69, line 28 |

The cited specification of JP-A 62-215272 is one as amended by the letter of amendment filed on Mar. 16, 1987.

In addition to the above-mentioned couplers, so-called shortwave-type yellow couplers such as those described in JP-A 63-231451, 63-123047, 63-241547, 1-173499, 1-213648 and 1-250944 are also preferably used.

As yellow couplers, also preferably used in the present invention are acylacetamide yellow couplers where the acyl group has a 3-membered to 5-membered cyclic structure, such as those described in European Patent 0447969A1; malondianilide yellow couplers having a cyclic structure such as those described in European Patent 0482552A1; and acylacetamide yellow couplers having a dioxane structure such as those described in U.S. Pat. No. 5,118,599, in addition to the compounds described in the above-mentioned table. Above all, acylacetamide yellow couplers where the acyl group is an 1-alkylcyclopropane-1-carbonyl group, and malondianilide yellow couplers where one anilide constitutes an indoline ring are especially preferably used. These couplers may be used singly or as combined.

The magenta couplers usable in the present invention are 5-pyrazolone magenta couplers and pyrazoloazole magenta couplers such as those described in the above-mentioned patent publications. In particular, however, especially preferred are pyrazolotriazole couplers where a secondary or tertiary alkyl group is directly bonded to the 2, 3 or 6-position of the pyrazolotriazole ring, such as those described in JP-A 61-65245; pyrazoloazole couplers having a sulfonamido group in the molecule, such as those described in JP-A 61-65246; pyrazoloazole couplers having an alkoxyphenylsulfonamido ballast group, such as those described in JP-A 61-147254; and pyrazoloazole couplers having a 6-positioned alkoxy or aryloxy group, such as those described in European Patents 226,849A and 294,785A, in view of the color hue and the stability of images to be formed therefrom and of the coloring property of themselves.

The color developer to be used for developing the photographic material of the present invention preferably contains an organic preservative in place of hydroxylamine and sulfite ion.

The organic preservative as referred to herein includes all organic compounds which are added to processing solutions for color photographic materials so as to retard the deterioration of the aromatic primary amine color developing agents therein. In other words, they are organic compounds having a function of preventing color developing agents from being oxidized with air, etc. Above all, especially effective organic preservatives are hydroxylamine derivatives (excluding hydroxylamine), hydroxamic acids, hydrazines, hydrazides, α-amino acids, phenols, α-hydroxyketones, α-aminoketones, saccharides, monoamines, diamines, polyamines, quaternary ammonium salts, nitroxy radicals, alcohols, oximes, diamide compounds, condensed cyclic amines, etc. These are disclosed in JP-B 48-30496, JP-A 52-143020, 63-4235, 63-30845, 63-21647, 63-44655, 63-53551, 63-43140, 63-56654, 63-58346, 63-43138, 63-146041, 63-44657, 63-44656, U.S. Pat. Nos. 3,615,503, 2,494,903, JP-A 1-97953, 1-186939, 1-186940, 1-187557, 2-306244, European Patent Laid-Open No. 0530921A1, etc. As other preservatives, also employable, if desired, are various metals such as those described in JP-A 57-44148, 57-53749; salicylic acids such as those described in JP-A 59-180588; amines such as those described in JP-A 63-239447, 63-128340, 1-186939, 1-187557; alkanolamines such as those described in JP-A 54-3532; polyethyleneimines such as those described in JP-A 56-94349; and aromatic polyhydroxylamines such as those described in U.S. Pat. No. 3,746,544. In particular, especially preferred are alkanolamines such as triethanolamine; dialkylhydroxylamines such as N,N-diethylhydroxylamine and N,N-di(sulfoethyl)hydroxylamine; α-amino acid derivatives such as glycine, alanine, leucine, serine, threonine, valine and isoleucine; and aromatic polyhydroxyl compounds such as sodium catechol-3,5-disulfonate.

In particular, the combination of dialkylhydroxylamines and alkanolamines and the combination of dialkylhydroxylamines such as those described in European Patent Laid-Open No. 0530921A1, α-amino acid such as typically glycine, and alkanolamines are especially preferably employed, as improving the stability of color developers containing them and especially improving the stability thereof during continuous processing therewith.

The amount of the organic preservative to be added to developers may be such that the preservative added may have a function to prevent the deterioration of the color developing agent in the developer. Preferably, it is from 0.01 to 1.0 mol/liter, more preferably from 0.03 to 0.30 mol/liter.

To process the color photographic material of the present invention, the processing materials and the processing methods described in JP-A 2-207250, from page 26, right bottom column, line 1 to page 34, right top column, line 9 and JP-A 4-97355, from page 5, left top column, line 17 to page 18, right bottom column, line 20 are preferably employed, in addition to those referred to in the above-mentioned table.

The present invention will be explained in more detail by means of the following examples, which, however, are not intended to restrict the scope of the present invention. In the examples, unless otherwise indicated, all percents are by weight.

EXAMPLE 1

Preparation of Supports

Titanium dioxide was added to a low-density polyethylene having MRF of 3 at the proportion indicated in Table 1 below, and zinc stearate was added thereto at the proportion of 3.0% by weight to the titanium dioxide. The resulting mixture was kneaded along with ultramarine (DV-1, product of Dai-ichi Chemical Industry Co.) in a Bumbury's mixer and then shaped into pellets constituting a master batch. The grain size of the titanium dioxide used was from 0.15 μm to 0.35 μm, from electromicroscopic observation. The titanium dioxide grains used herein were those coated with aluminium oxide hydrate in an amount of 0.75% by weight, as $Al_2O_3$, relative to titanium dioxide.

A paper base having a weight of 170 g/m$^2$ was treated by corona discharging at 10 kVA, and the pellets prepared above were melt-extruded thereover at 320° C. through a multi-layer coating die to form a polyethylene laminate layer having the thickness as indicated in Table 1 below on the base. The surface of the polyethylene laminate layer was treated by glow discharging, and then a gelatin subbing layer containing sodium dodecylbenzenesulfonate was formed thereon.

TABLE 1

| | Constitution of Multi-layered Waterproof Resin Laminate Layer | | | | | | | |
|---|---|---|---|---|---|---|---|---|
| | Uppermost Layer | | Interlayer | | Lowermost Layer | | Mean $TiO_2$ | |
| Support | $TiO_2$ Content | Thickness | $TiO_2$ Content | Thickness | $TiO_2$ Content | Thickness | Content | Remarks |
| A | 15 wt. % | 30μ | — | — | — | — | 15.0 wt. % | comparative sample |
| B | 25 wt. % | 30μ | — | — | — | — | 25.0 wt. % | comparative sample |
| C | 10 wt. % | 1μ | 15 wt. % | 28μ | 10 wt. % | 1μ | 14.7 wt. % | sample of the invention |
| D | 25 wt. % | 15μ | — | — | 0 wt. % | 15μ | 12.5 wt. % | sample of the invention |
| E | 25 wt. % | 15μ | — | — | 5 wt. % | 15μ | 15.0 wt. % | sample of the invention |
| F | 35 wt. % | 15μ | — | — | 0 wt. % | 15μ | 17.5 wt. % | sample of the invention |
| G | 35 wt. % | 15μ | — | — | 15 wt. % | 15μ | 25.0 wt. % | sample of the invention |
| H | 35 wt. % | 15μ | — | — | 25 wt. % | 1μ | 30.0 wt. % | sample of the invention |
| I | 10 wt. % | 2μ | 25 wt. % | 26μ | 10 wt. % | 2μ | 23.0 wt. % | sample of the invention |

The $TiO_2$ content and the mean $TiO_2$ content as referred to in Table 1 above indicate % by weight of $TiO_2$ relative to the sum of $TiO_2$ and the resin of being 100% by weight.

Preparation of Photographic Material Samples:

Plural photographic constitutive layers each having the composition mentioned below were coated over one of the supports obtained as above to form a multi-layered color photographic paper (sample No. 101). The coating liquids used here were prepared in the manner mentioned below.

Preparation of Coating Liquid for Fifth Layer:

27.2 cc of ethyl acetate, 0.50 g of solvent (Solv-1) and 7.4 g of solvent (Solv-6) were added to 12.4 g of cyan coupler (ExC), 0.40 g of color image stabilizer (Cpd-9), 0.40 g of color image stabilizer (Cpd-8), 7.0 g of ultraviolet absorbent (UV-2), 9.5 g of color image stabilizer (Cpd-1), 0.40 g of color image stabilizer (Cpd-6), 0.40 g of color image stabilizer (Cpd-10) and 0.40 g of color image stabilizer (Cpd-11) to dissolve them, and the resulting solution was added to 270 cc of an aqueous 10% gelatin solution containing 8 cc of sodium dodecylbenzenesulfonate and emulsified and dispersed therein using an ultrasonic homogenizer. To the thus-obtained dispersion, added were silver chlorobromide emulsions $R_1$ and $R_2$ which were be mentioned below. These were mixed to prepare a coating liquid for the fifth layer.

Other coating liquids for the other layers than the fifth layer were prepared in the same manner as above. As gelatin hardening agents for each layer, added thereto were 1-hydroxy-3,5-dichloro-s-triazine sodium salt and 1,2-bis(vinylsulfonyl)ethane.

The layers contained 25.0 mg/m$^2$, as a whole, of Cpd-14 and 50 mg/m$^2$, as a whole, of Cpd-15.

The silver chlorobromide emulsions for the light-sensitive emulsion layers constituting Sample No. 101 contained the following color-sensitizing dyes.

Blue-sensitive Emulsion Layer:

Sensitizing Dye A:

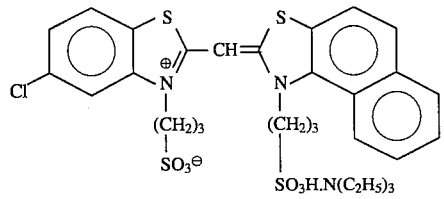

($2.0\times10^{-4}$ mol per mol of silver halide to large-size emulsion; and $2.5\times10^{-4}$ mol per mol of silver halide to small-size emulsion)

Sensitizing Dye B:

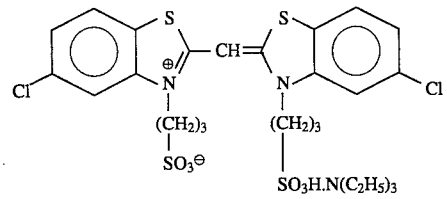

($2.0\times10^{-4}$ mol per mol of silver halide to large-size emulsion; and $2.5\times10^{-4}$ mol per mol of silver halide to small-size emulsion)

Green-sensitive Emulsion Layer:

Sensitizing Dye C:

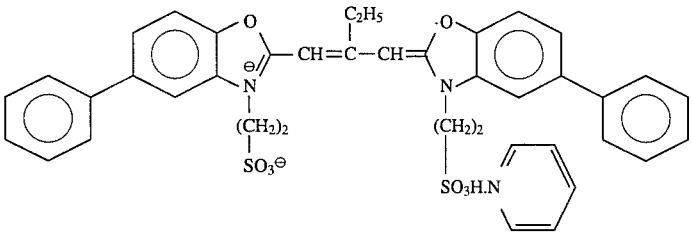

($4.0\times10^{-4}$ mol per mol of silver halide to large-size emulsion; and $5.6\times10^{-4}$ mol per mol of silver halide to small-size emulsion)

Sensitizing Dye D:

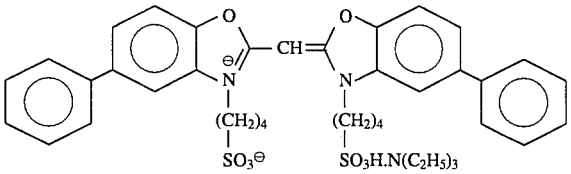

($7.0\times10^{-5}$ mol per mol of silver halide to large-size emulsion; and $1.0\times10^{-4}$ mol per mol of silver halide to small-size emulsion)

Red-sensitive Emulsion Layer:

Sensitizing Dye E:

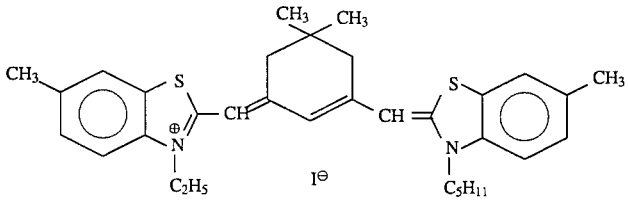

($0.9\times10^{-4}$ mol per mol of silver halide to large-size emulsion; and $1.1\times10^{-4}$ mol per mol of silver halide to small-size emulsion)

In addition, the following compound was added in an amount of $2.6\times10^{-3}$ mol per mol of silver halide.

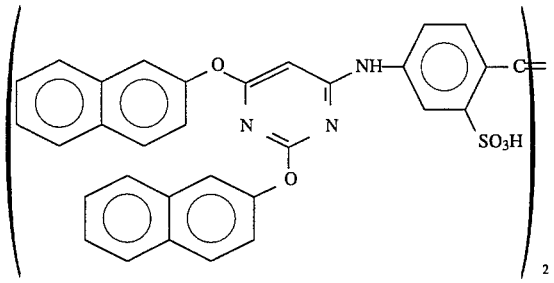

To the blue-sensitive emulsion layer, the green-sensitive emulsion layer and the red-sensitive emulsion layer was added 1-(5-methylureidophenyl)-5-mercaptotetrazole each in an amount of $3.4\times10^{-4}$ mol, $9.7\times10^{-4}$ mol and $5.5\times10^{-4}$ mol, per mol of silver halide, respectively.

To the blue-sensitive emulsion layer and the green-sensitive emulsion layer was added 4-hydroxy-6-methyl-1,3,3a,7-tetrazaindene each in an amount of $1\times10^{-4}$ mol and $2\times10^{-4}$ mol, per mol of silver halide, respectively. For anti-irradiation, the following dyes were added to the respective emulsion layers, the coated amount being parenthesized.

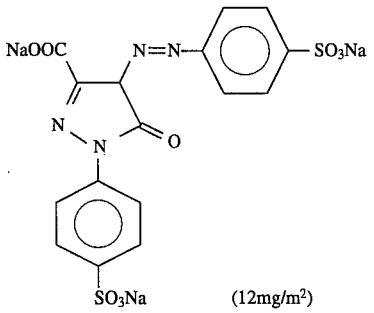

(12mg/m²)

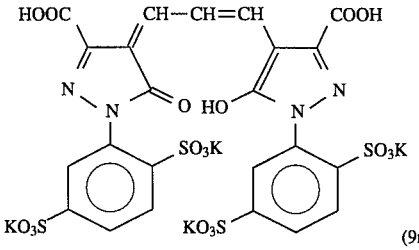

(9mg/m²)

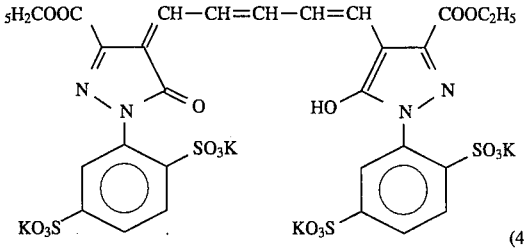

(40mg/m²)

and

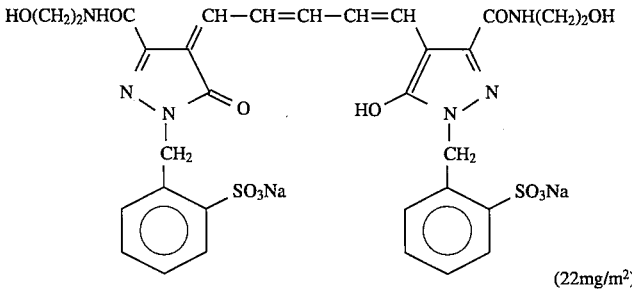

(22mg/m²)

Layer Constitution:

Compositions of the layers of constituting sample No. 101 are mentioned below, in which the numerical value indicates the amount coated (g/m²) and the amount of the silver halide coated is represented as silver therein. The pH value of the coated film was adjusted at 7.0, by suitably controlling the pH values of the coating liquids.

Support:

Support A mentioned above.

| First Layer: Yellow Coupler-containing Blue-sensitive Emulsion Layer | |
|---|---|
| Silver Chlorobromide Emulsion (5/5 (by mol of silver) mixture of large-size emulsion Bl of cubic grains with a mean grain size of 0.8 μm and small-size emulsion B2 of cubic grains with a mean grain size of 0.5 μm; the fluctuation coefficient of the grain size distribution of the two emulsions was 0.08 and 0.09, respectively; the silver halide grains in the both emulsions had 0.4 mol % of silver bromide locally on a part of the surface of each grain comprising silver chloride) | 0.27 |
| Gelatin | 1.21 |
| Yellow Coupler (ExY) | 0.79 |
| Color Image Stabilizer (Cpd-1) | 0.06 |
| Color Image Stabilizer (Cpd-2) | 0.04 |
| Color Image Stabilizer (Cpd-3) | 0.08 |
| Solvent (Solv-1) | 0.10 |
| Solvent (Solv-2) | 0.16 |
| Second Layer: Color Mixing Preventing Layer | |
| Gelatin | 0.95 |
| Color Mixing Preventing Agent (Cpd-4) | 0.08 |
| Solvent (Solv-2) | 0.20 |
| Solvent (Solv-3) | 0.25 |
| Solvent (Solv-7) | 0.01 |
| Third Layer: Magenta Coupler-containing Green-sensitive Emulsion Layer | |
| Silver Chlorobromide Emulsion (6/4 (by mol of Ag) mixture of large-size emulsion Gl of cubic grains with a mean grain size of 0.55 μm and small-size | 0.13 |

| | |
|---|---|
| emulsion G2 of cubic grains with a mean grain size of 0.39 μm; the two emulsions each had a fluctuation coefficient of the grain size distribution of 0.10 and 0.08, respectively; the large-size emulsion contained 0.8 mol % of AgBr locally on a part of the surface of each grain comprising silver chloride, and the small-size emulsion contained 1.0 mol % of AgBr locally on a part of the surface of each grain comprising silver chloride) | |
| Gelatin | 1.38 |
| Magenta Coupler (ExM) | 0.16 |
| Color Image Stabilizer (Cpd-2) | 0.03 |
| Color Image Stabilizer (Cpd-5) | 0.07 |
| Color Image Stabilizer (Cpd-6) | 0.01 |
| Color Image Stabilizer (Cpd-7) | 0.01 |
| Color Image Stabilizer (Cpd-8) | 0.07 |
| Solvent (Solv-3) | 0.30 |
| Solvent (Soly-5) | 0.10 |
| Solvent (Solv-8) | 0.20 |
| Solvent (Solv-9) | 0.10 |
| Fourth Layer: Color Mixing Preventing Layer | |
| Gelatin | 0.65 |
| Color Mixing Preventing Agent (Cpd-4) | 0.06 |
| Solvent (Solv-2) | 0.15 |
| Solvent (Solv-3) | 0.18 |
| Solvent (Solv-7) | 0.01 |
| Fifth Layer: Cyan Coupler-containing Red-sensitive Emulsion Layer | |
| Silver Chlorobromide Emulsion (7/3 (by mol of Ag) mixture of large-size emulsion R1 of cubic grains with a mean grain size of 0.58 μm and small-size emulsion R2 of cubic grains with a mean grain size | 0.20 |

| | |
|---|---|
| of 0.45 μm; the two emulsions each had a fluctuation coefficient of the grain size distribution of 0.09 and 0.11, respectively; the large-size emulsion contained 0.6 mol % of AgBr locally on a part of the surface of each grain comprising silver chloride, and the small-size emulsion contained 0.8 mol % of AgBr locally on a part of the surface of each grain comprising silver chloride) | |
| Gelatin | 0.84 |
| Cyan Coupler (ExC) | 0.32 |
| Ultraviolet Absorbent (UV-2) | 0.18 |
| Color Image Stabilizer (Cpd-1) | 0.25 |
| Color Image Stabilizer (Cpd-6) | 0.01 |
| Color Image Stabilizer (Cpd-8) | 0.01 |
| Color Image Stabilizer (Cpd-9) | 0.01 |
| Color Image Stabilizer (Cpd-10) | 0.01 |
| Color Image Stabilizer (Cpd-11) | 0.01 |
| Solvent (Solv-1) | 0.01 |
| Solvent (Solv-6) | 0.19 |
| Sixth Layer: Ultraviolet Absorbing Layer | |
| Gelatin | 0.53 |
| Ultraviolet Absorbent (UV-1) | 0.38 |
| Color Image Stabilizer (Cpd-12) | 0.15 |
| Seventh Layer: Protective Layer | |
| Gelatin | 1.12 |
| Acryl-modified Copolymer of Polyvinyl Alcohol (modification degree 17%) | 0.07 |
| Liquid Paraffin | 0.01 |
| Color Image Stabilizer (Cpd-13) | 0.01 |

The compounds used above are mentioned below.

(ExY) Yellow Coupler:
1/1 (by mol) mixture of the following):

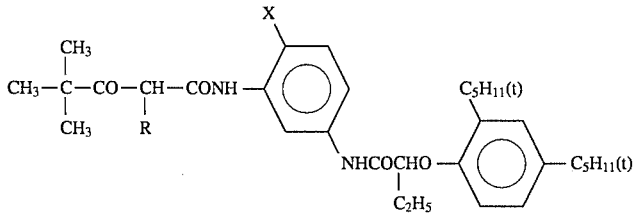

R =

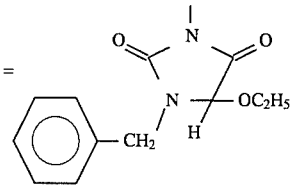

, X=Cl and

R =

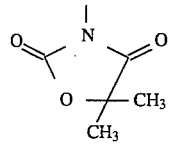

, X=$OCH_3$ (ExM) Magenta Coupler:
1/1 (by mol) mixture of the following:

-continued
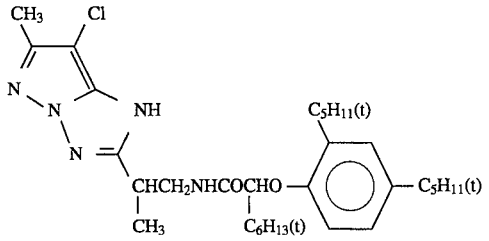
and
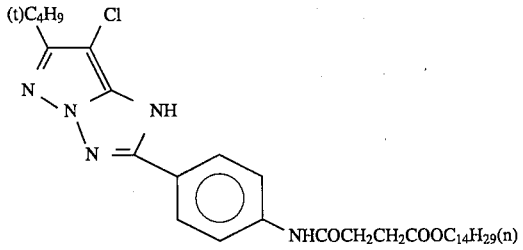
(ExC) Cyan Coupler:
3/7 (by mol) mixture of the following:
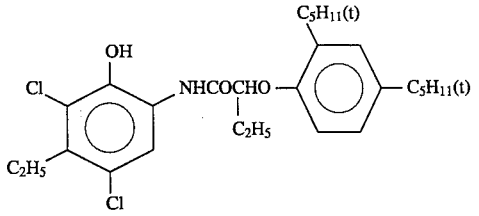
and
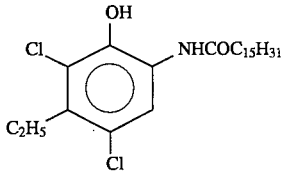
(Cpd-1) Color Image Stabilizer:
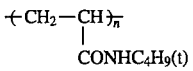
(mean molecular weight: 60,000)
(Cpd-2) Color Image Stabilizer:
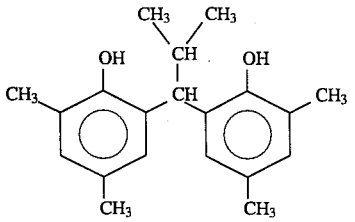
(Cpd-3) Color Image Stabilizer:
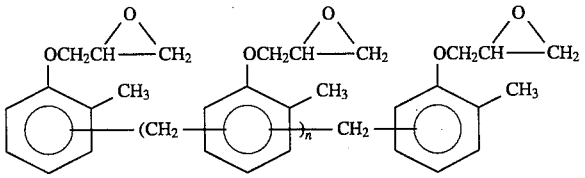
n =7 to 8 (mean value)

-continued
(Cpd-4) Color Mixing Preventing Agent:
1/1 (by weight) mixture of the following (1) and (2):
(1)
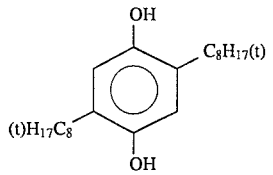
(2)
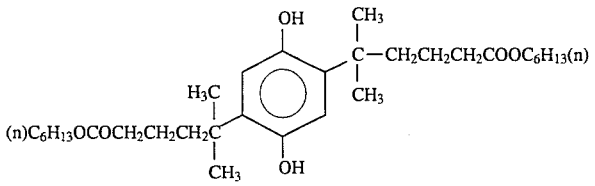
(Cpd-5) Color Image Stabilizer:
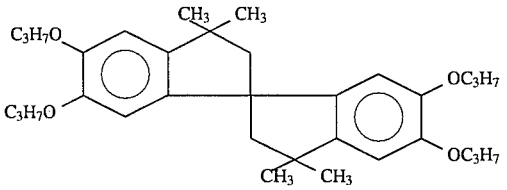
(Cpd-6) Color Image Stabilizer:
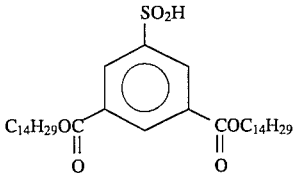
(Cpd-7) Color Image Stabilizer:
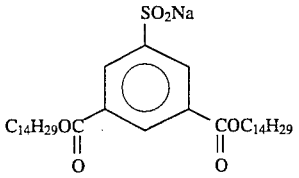
(Cpd-8) Color Image Stabilizer:
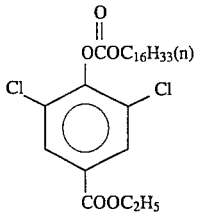
(Cpd-9) Color Image Stabilizer:
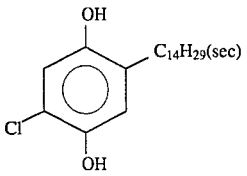

-continued
(Cpd-10) Color Image Stabilizer:
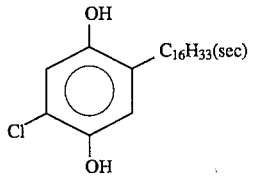
(Cpd-11) Color Image Stabilizer:
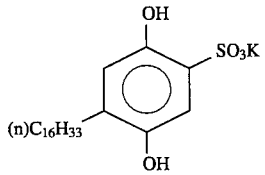
(Cpd-12) Color Image Stabilizer:
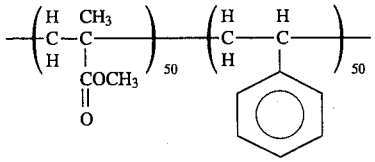
(mean molecular weight: about 60,000)
(Cpd-13) Color Image Stabilizer:
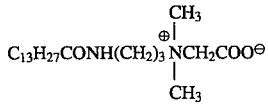
(Cpd-14) Antiseptic:
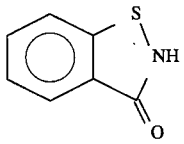
(Cpd-15) Antiseptic:
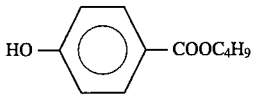
(UV-1) Ultraviolet Absorbent:
1/5/10/5 (by weight) mixture of the following (1), (2), (3) and (4):
(1)
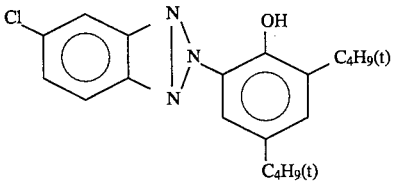

-continued
(2)
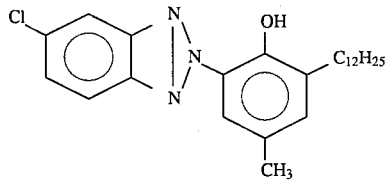
(3)
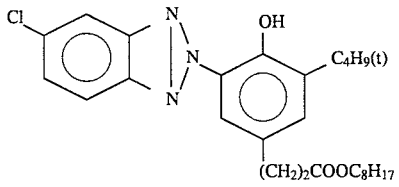
(4)
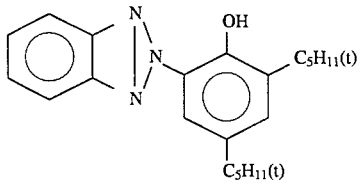
(UV-2) Ultraviolet Absorbent:
1/2/2 (by weight) mixture of the following (1), (2) and (3):
(1)
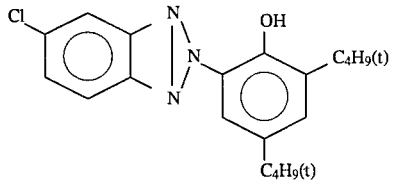
(2)
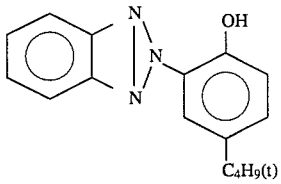
(3)
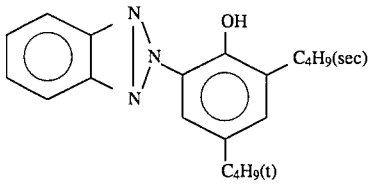
(Solv-1) Solvent:
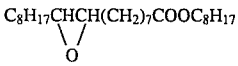

-continued (Solv-2) Solvent:

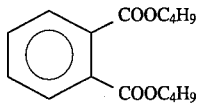

(Solv-3) Solvent:

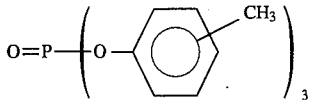

(Solv-4) Solvent:

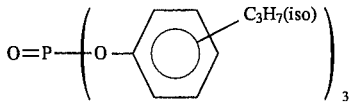

(Solv-5) Solvent:

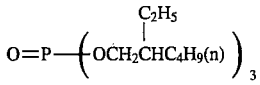

(Solv-6) Solvent:

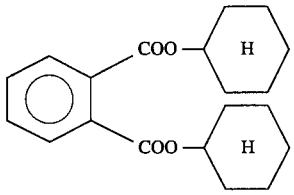

(Solv-7) Solvent:

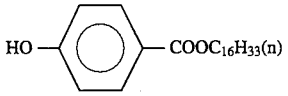

(Solv-8) Solvent:

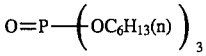

(Solv-9) Solvent:

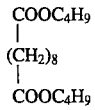

Other samples (Nos. 102 to 131) were prepared in the same manner as in preparation of sample No. 101, except that the support, the cyan coupler and the pH value of the coated film were varied to those indicated in Table 2 below.

Sample No. 101 was imagewise printed and then processed continuously (running processing) according to the process mentioned below while a replenisher mentioned below was replenished to the developer tank, until the amount of the replenisher to the developer tank became two times the capacity of the developer tank.

Process for Color Development:

| Processing Step | Temperature | Time | Amount of Replenisher (*) |
|---|---|---|---|
| Color Development | 35° C. | 45 sec | 161 ml |
| Blixation | 35° C. | 45 sec | 218 ml |
| Rinsing ① | 35° C. | 30 sec | — |
| Rinsing ② | 35° C. | 30 sec | — |
| Rinsing ③ | 35° C. | 20 sec | 360 ml |
| Drying | 80° C. | 60 sec | |

(*)per $m^2$ of sample being processed.

-continued

Process for Color Development:

| Processing Step | Temperature | Time | Amount of Replenisher (*) |
|---|---|---|---|

(Rinsing was effected by three-tank countercurrent cascade system from ③ to ①.)

Compositions of the processing solutions used above are mentioned below.

| Color Developer | Tank Solution | Replenisher |
|---|---|---|
| Water | 800 ml | 800 , ml |
| Ethylenediamine-tetraacetic Acid | 3.0 g | 3.0 g |
| Disodium 4,5-Dihydroxybenzene-1,3-disulfonate | 0.5 g | 0.5 g |
| Triethanolamine | 12.0 g | 12.0 g |
| Potassium Chloride | 2.5 g | — |
| Potassium Bromide | 0.01 g | — |
| Potassium Carbonate | 27.0 g | 27.0 g |
| Sodium Sulfite | 0.1 g | 0.2 g |
| N-ethyl-N-(β-methanesulfonamidoethyl)-3-methyl-4-aminoaniline 3/2 Sulfate 1 Hydrate | 5.0 g | 7.1 g |
| Diethylhydroxylamine | 5.0 g | 8.0 g |
| Brightening Agent(WHITEX-4, product of Sumitomo Chemical Co.) | 1.0 g | 2.5 g |
| Water to make | 1000 ml | 1000 ml |
| pH(adjusted with potassium hydroxide and sulfuric acid) | 10.05 | 10.45 |
| Blixing Solution (The tank solution and the replenisher were the same.) | | |
| Water | | 600 ml |
| Ammonium Thiosulfate (750 g/liter) | | 93 ml |
| Ammonium Sulfite | | 40 g |
| Ammonium Ethylenediaminetetraacetato/Iron(III) | | 55 g |
| Disodium Ethylenediaminetetraacetate | | 5 g |
| Nitric Acid (67%) | | 30 g |
| Water to make | | 1000 ml |
| pH (adjusted with acetic acid and aqueous ammonia) | | 5.8 |
| Rinsing Solution (The tank solution and the replenisher were the same.) | | |
| Sodium Chloroisocyanurate | | 0.02 g |
| Deionized Water (with electroconductivity of 5 μS/cm or less) | | 1000 ml |
| pH | | 6.5 |

After the running processing as above above, each the above-mentioned 31 samples (Sample Nos. 101 to 131) was exposed for 1/10 second through a red filter and then processed, using the processor that had been subjected to the above-mentioned running processing. This is to check the side-absorption characteristic of the colored cyan dye in each sample in a short wavelength range.

The color density of each of the thus-processed samples was measured, using a photodensitometer X-rite 310 Model (made by X-rite Co.) under the instructed status-A condition. Precisely, the magenta density was measured in each sample at the part that had been measured to have a cyan density of 1.0, as the value to evaluate the cyan color hue in the same part. The thus-measured value is shown in Table 2, indicating the cyan color hue of each sample. The value indicates the proportion of the unnecessary absorption in the green area to the main absorption of the formed dye. The smaller the value, the better the cyan color hue.

Next, the pressure resistance of each sample was checked in the manner mentioned below. Each sample was stored at 35° C. and 55% RH for 10 days. Each of the fresh samples and the thus-stored samples was scratched with a sapphire needle (its point had a radius of curvature of 0.03 mm) to which a load of 2 g, 4 g or 8 g had been imparted, while the needle was moved at a rate of 5 cm/sec on each sample. These samples were then developed according to the process mentioned above, and the cyan stress marks, if any, appeared on the processed samples were checked with the naked eye. The degree of the stress marks, if any, was evaluated according to the following ranks:

| Evaluation: | Degree of Stress Marks |
|---|---|
| xx: | Clear stress marks appeared, when a load of 2 g was imparted to the needle. |
| x: | Clear stress marks appeared, when a load of 4 g was imparted to the needle. |
| o: | Clear stress marks appeared, when a load of 8 g was imparted to the needle. |
| ⊙: | No stress mark appeared, when a load of 8 g was imparted to the needle. |

The sharpness of each sample was evaluated in the manner mentioned below. Precisely, each sample was exposed to a red light, while a rectangular pattern having a varying space frequency to have a difference in the density of 0.5, that had been deposited on a glass support, was closely attached thereto, and the thus-exposed sample was developed according to the process mentioned above, using the processing solutions also mentioned above. The exposure was effected in such a way that the background density of each sample might be 1.0. The density of the thus-obtained rectangular image was measured precisely with a microdensitometer, from which obtained was the CTF value of each sample at a space frequency of 6.0 cycles/mm. The value is an index of the sharpness of each sample.

The results of the above-mentioned tests are shown in Table 2. In these tests, it was known that the maximum cyan color density of the samples each containing the cyan coupler of the present invention was higher than the comparative samples each containing the comparative coupler.

TABLE 2

| Sample No. | Support Code | Support Mean $TiO_2$ Content (wt. %) | Cyan Coupler | Hue of Cyan Color Formed | pH of Coated Film | Stress Marks Before Stored | Stress Marks After Stored | CTF | Remarks |
|---|---|---|---|---|---|---|---|---|---|
| 101 | A | 15.0 | ExC | 0.39 | 7.0 | ⊙ | ⊙ | 0.74 | comparative sample |

TABLE 2-continued

| Sample No. | Support Code | Support Mean $TiO_2$ Content (wt. %) | Cyan Coupler | Hue of Cyan Color Formed | pH of Coated Film | Stress Marks Before Stored | Stress Marks After Stored | CTF | Remarks |
|---|---|---|---|---|---|---|---|---|---|
| 102 | A | 15.0 | ExC | 0.39 | 6.5 | ◎ | ◎ | 0.75 | comparative sample |
| 103 | A | 15.0 | ExC | 0.40 | 5.9 | ◎ | ◎ | 0.75 | comparative sample |
| 104 | D | 12.5 | ExC | 0.39 | 7.0 | ◎ | ◎ | 0.76 | comparative sample |
| 105 | D | 12.5 | ExC | 0.40 | 6.5 | ◎ | ◎ | 0.75 | comparative sample |
| 106 | D | 12.5 | ExC | 0.40 | 5.9 | ◎ | ◎ | 0.75 | comparative sample |
| 107 | A | 15.0 | (11) | 0.32 | 6.9 | ◎ | ○ | 0.75 | comparative sample |
| 108 | A | 15.0 | (11) | 0.31 | 6.5 | ◎ | ◎ | 0.75 | comparative sample |
| 109 | A | 15.0 | (11) | 0.32 | 5.8 | ◎ | ◎ | 0.76 | comparative sample |
| 110 | D | 12.5 | (11) | 0.32 | 6.9 | ○ | X | 0.77 | comparative sample |
| 111 | D | 12.5 | (11) | 0.32 | 6.5 | ◎ | ◎ | 0.78 | sample of the invention |
| 112 | D | 12.5 | (11) | 0.31 | 5.8 | ◎ | ◎ | 0.77 | sample of the invention |
| 113 | B | 25.0 | (11) | 0.32 | 6.9 | ◎ | ○ | 0.80 | comparative sample |
| 114 | B | 25.0 | (11) | 0.32 | 5.8 | ◎ | ◎ | 0.81 | comparative sample |
| 115 | C | 14.7 | (11) | 0.31 | 6.9 | ○ | X | 0.78 | comparative sample |
| 116 | C | 14.7 | (11) | 0.32 | 5.8 | ◎ | ◎ | 0.79 | sample of the invention |
| 117 | E | 15.0 | (11) | 0.32 | 6.9 | ○ | X | 0.79 | comparative sample |
| 118 | E | 15.0 | (11) | 0.32 | 6.2 | ◎ | ○ | 0.80 | sample of the invention |
| 119 | F | 17.5 | (11) | 0.32 | 6.9 | ○ | XX | 0.81 | comparative sample |
| 120 | F | 17.5 | (11) | 0.32 | 5.8 | ◎ | ◎ | 0.81 | sample of the invention |
| 121 | G | 25.0 | (11) | 0.32 | 6.9 | ○ | XX | 0.83 | comparative sample |
| 122 | G | 25.0 | (11) | 0.32 | 5.8 | ◎ | ◎ | 0.84 | sample of the invention |
| 123 | G | 25.0 | (27) | 0.32 | 6.2 | ◎ | ○ | 0.84 | sample of the invention |
| 124 | G | 25.0 | (31) | 0.31 | 6.3 | ◎ | ○ | 0.84 | sample of the invention |
| 125 | G | 25.0 | (35) | 0.30 | 6.3 | ◎ | ◎ | 0.85 | sample of the invention |
| 126 | G | 25.0 | (36) | 0.29 | 6.2 | ◎ | ○ | 0.84 | sample of the invention |
| 127 | G | 25.0 | (36) | 0.29 | 5.9 | ◎ | ◎ | 0.85 | sample of the invention |
| 128 | H | 30.0 | (11) | 0.32 | 6.9 | ◎ | XX | 0.87 | comparative sample |
| 129 | H | 30.0 | (11) | 0.33 | 5.8 | ◎ | ○ | 0.88 | sample of the invention |
| 130 | I | 23.0 | (11) | 0.32 | 5.8 | ◎ | ◎ | 0.86 | sample of the invention |
| 131 | I | 23.0 | (35) | 0.29 | 5.9 | ◎ | ◎ | 0.86 | sample of the invention |

From Table 2 above, it is known that the cyan couplers contained in the samples of the present invention are better than the comparative coupler (ExC) in that the the unnecessary absorption of the dyes formed from the former is less than that of the dye formed from the latter.

Considering the sharpness of the images formed, it is known that the samples having support D (having a mean $TiO_2$ content of 12.5 wt. %) are comparable to or better than those having support A (having a mean $TiO_2$ content of 15 wt. %) and that the samples having support E (having a mean $TiO_2$ content of 15 wt. %) are better than those having support B (having a mean $TiO_2$ content of 25 wt. %). This means that the samples each having the support of the present invention may have a reduced total amount of the white pigment to be in the waterproof resin coat layer on the support while the sharpness of the images to be formed is kept good. In addition, it is also noted that the samples having the cyan coupler of the present invention have somewhat improved sharpness, as compared with those having the comparative cyan coupler (compare Sample Nos. 101 to 103 and Sample Nos. 107 to 109, and Sample Nos. 104 to 106 and Sample Nos. 110 to 112). This effect is enhanced, when the cyan coupler and the support are combined according to the present invention. Therefore, the combination of the support and the coupler defined by the present invention is effective in maintaining and improving the sharpness of the images to be formed.

However, even though the coupler and the support are combined according to the present invention, if the pH value of the film coated on the support is higher than 6.5, the pressure resistance of the samples is worsened after storage so that the samples cannot be put to practical use (see Sample Nos. 110, 115, 117, 119, 121, 128).

Summarizing these results, it is known that the photographic material of the present invention is excellent in that it gives an image having excellent cyan color hue and that the content of the white pigment in the support of the material may be reduced, while the sharpness of the image formed is maintained or is even improved. In the technical level in the prior art, the combination of the support and the coupler as defined by the present invention resulted in the increase in the stress marks after the photographic material was stored. According to the present invention, however, the photographic material having the claimed combination of the support and the coupler is free from the increase in the stress marks even after stored.

EXAMPLE 2

Using a Fuji Color negative film, Super G400, pictures of a distant view of a new town with a background of fresh green mountains were taken. This was printed on each of Sample Nos. 103, 106, 109, 112, 114, 116, 118, 120, 122, 124, 126, 129 and 131 that had been prepared in Example 1. The color prints thus obtained were sensually examined by 10 panelists, with respect to the color hue and the sharpness of each image. The sensual evaluation on the color hue and the sharpness of the images formed was effected according to the point mentioned below, based on Sample No. 103, and the total point of each sample was obtained.

| Point: | Evaluation |
|---|---|
| 0: | Much worse than Sample No. 103 |
| 1: | Worse than Sample No. 103 |
| 2: | Comparable to Sample No. 103 |
| 3: | Better than Sample No. 103 |
| 4: | Much better than Sample No. 103 |

The results are shown in Table 3.

TABLE 3

| | Point of Evaluation of Image Quality | | |
|---|---|---|---|
| Sample No. | Color Hue | Sharpness | Remarks |
| 103 | 20 | 20 | comparative sample |
| 106 | 21 | 24 | comparative sample |
| 109 | 32 | 24 | comparative sample |
| 112 | 33 | 30 | sample of the invention |
| 114 | 32 | 32 | sample of the invention |
| 116 | 32 | 28 | sample of the invention |
| 118 | 32 | 30 | sample of the invention |

TABLE 3-continued

| | Point of Evaluation of Image Quality | | |
|---|---|---|---|
| Sample No. | Color Hue | Sharpness | Remarks |
| 120 | 33 | 34 | sample of the invention |
| 122 | 34 | 37 | sample of the invention |
| 124 | 36 | 40 | sample of the invention |
| 126 | 37 | 40 | sample of the invention |
| 129 | 34 | 42 | sample of the invention |
| 131 | 38 | 42 | sample of the invention |

From Table 3 above, it is known that the samples each having the coupler of the present invention have larger points of the evaluation of the color hue of the images formed and that the sharpness of the image reflects the evaluation of the CTF value in Table 2 above. From these results, it is obvious that the samples of the present invention give images having better color hue and that the content of the white pigment in the waterproof resin coat layer constituting the support of the sample of the present invention may be reduced, while the visual sharpness of the image to be formed is kept good, with the result that the cost for producing the photographic material of the present invention may be reduced.

EXAMPLE 3

The samples prepared in Example 1 were processed according to the process mentioned below, using the processing solutions also mentioned below. The thus-processed samples were evaluated in the same manner as in Example 1, by which the same results as in Example 1 were obtained.

| | Process for Color Development: | | |
|---|---|---|---|
| Processing Step | Temperature | Time | Amount of Replenisher (*) |
| Color Development | 38.5° C. | 45 sec | 73 ml |
| Blixation | 38.5° C. | 45 sec | 60 ml(**) |
| Rinsing ① | 35 to 40° C. | 15 sec | — |
| Rinsing ② | 35 to 40° C. | 15 sec | — |
| Rinsing ③ | 30 to 40° C. | 15 sec | 360 ml |
| Drying | 80° C. | 20 sec | |

(*)per $m^2$ of the sample being processed.
(**)In addition to 60 ml mentioned above, 120 ml, per $m^2$ of the sample, of the carryover from the rinsing bath ① was introduced into the blixation bath. Rinsing was effected by three-tank countercurrent cascade system from ③ to ①.

Compositions of the processing solutions used above are mentioned below.

| | Tank Solution | Replenisher |
|---|---|---|
| Color Developer | | |
| Water | 800 ml | 800 ml |
| Sodium Triisopropylnaphthalene(β)sulfonate | 0.1 g | 0.1 g |
| Ethylenediaminetetraacetic Acid | 3.0 g | 3.0 g |
| Disodium 1,2-Dihydroxybenzene-4,6-disulfonate | 0.5 g | 0.5 g |

-continued

| | Tank Solution | Re-plenisher |
|---|---|---|
| Triethanolamine | 12.0 g | 12.0 g |
| Potassium Chloride | 6.5 g | — |
| Potassium Bromide | 0.03 g | — |
| Potassium Carbonate | 27.0 g | 27.0 g |
| Brightening Agent(WHITEX 4B, made by Sumitomo Chemical Co.) | 1.0 g | 1.0 g |
| Sodium Sulfite | 0.1 g | 0.1 g |
| Disodium N,N-bis(sulfonatoethyl)hydroxylamine | 10.0 g | 13.0 g |
| N-ethyl-N-(β-methanesulfonamidoethyl)-3-methyl-4-aminoaniline Sulfate | 5.0 g | 11.5 g |
| Water to make | 1000 ml | 1000 ml |
| pH (25° C.) | 10.00 | 11.00 |
| Blix Solution | | |
| Water | 600 ml | 150 ml |
| Aqueous Solution of Ammonium Thiosulfate (700 g/liter) | 93 ml | 230 ml |
| Ammonium Sulfite | 40 g | 100 g |
| Ammonium Ethylenediaminetetraacetato/Iron(III) | 55 g | 135 g |
| Ethylenediaminetetraacetatic Acid | 5 g | 12.5 g |
| Nitric Acid (67%) | 30 g | 65 g |
| Water to make | 1000 ml | 1000 ml |
| pH (25° C.), adjusted with acetic acid or aqueous ammonia | 5.8 | 5.6 |
| Rinsing Solution: | | |
| Ion-exchanged Water (having calcium and magnesium content of 3 ppm or less each). | | |

-continued

| | | |
|---|---|---|
| Potassium Bromide | 0.03 g | 0.025 g |
| Diethylhydroxylamine | 4.6 g | 7.2 g |
| Glycine | 5.2 g | 8.1 g |
| Threonine | 4.1 g | 6.4 g |
| Potassium Carbonate | 27 g | 27 g |
| Potassium Sulfite | 0.1 g | 0.2 g |
| N-ethyl-N-(β-methanesulfonamidoethyl)-3-methyl-4-aminoaniline 3/2 Sulfate 1 Hydrate | 4.5 g | 7.3 g |
| Brightening Agent (4,4'-diaminostilbene compound) | 2.0 g | 3.0 g |
| Water to make | 1000 ml | 1000 ml |
| pH, adjusted with potassium hydroxide and sulfuric acid | 10.12 | 10.70 |
| Blixing Solution (The tank solution and the replenisher were the same.) | | |
| Water | | 400 ml |
| Aqueous Solution of Ammonium Thiosulfate (750 wt/vol %) | | 100 ml |
| Sodium Sulfite | | 17.0 g |
| Ammonium Ethylenediaminetetraacetato/Iron(III) | | 55.0 g |
| Disodium Ethylenediaminetetraacetate | | 5.0 g |
| Glacial Acetic Acid | | 9.0 g |
| Water to make | | 1000 ml |
| pH (adjusted with acetic acid and ammonia) | | 5.40 |
| Rinsing Solution (The tank solution and the replenisher were the same.) | | |
| 1,2-Benzoisothiazolin-3-one | | 0.02 g |
| Polyvinyl Pyrrolidone | | 0.05 g |
| Water to make | | 1000 m |
| pH | | 7.0 |

EXAMPLE 4

The samples prepared in Example 1 were processed according to the process mentioned below, using the processing solutions also mentioned below. The thus-processed samples were evaluated in the same manner as in Example 1, by which the same results as in Example 1 were obtained.

Process for Color Development:

| Processing Step | Temperature | Time | Amount of Replenisher (*) |
|---|---|---|---|
| Color Development | 35° C. | 45 sec | 161 ml |
| Blixation | 35° C. | 45 see | 215 ml |
| Rinsing ① | 35° C. | 20 sec | — |
| Rinsing ② | 35° C. | 20 sec | — |
| Rinsing ③ | 35° C. | 20 sec | — |
| Rinsing ④ | 35° C. | 20 sec | 248 ml |
| Drying | 80° C. | 60 sec | |

(*)per $m^2$ of sample being processed.
(Rinsing was effected by four-tank countercurrent cascade system from ④ to ①.)

Compositions of the processing solutions used above are mentioned below.

| Color Developer | Tank Solution | Re-plenisher |
|---|---|---|
| Water | 800 ml | 800 , ml |
| Lithium Polystyrenesulfonate Solution (30 %) | 0.25 ml | 0.25 ml |
| 1-Hydroxyethylidene-1,1-diphosphonic Acid Solution (60%) | 0.8 ml | 0.8 ml |
| Lithium Sulfate Anhydride | 2.7 g | 2.7 g |
| Triethanolamine | 8.0 g | 8.0 g |
| Potassium Chloride | 1.8 g | — |

EXAMPLE 5

The samples prepared in Example 1 were exposed in the manner mentioned below and then processed in the same manner as in Example 1. The thus-processed samples were evaluated in the same manner as in Example 1, by which the same results as in Example 1 were obtained.

Exposure of Samples:

The samples were exposed by scanning exposure. As the light source, used were a light of 473 nm that had been prepared by converting the wavelength of a YAG solid laser (oscillating wavelength: 946 nm) combined with an exciting light source of a semiconductor laser GaAlAs (oscillating wavelength: 808.5 nm), using SHG crystals of $KNbO_3$; a light of 532 nm that had been prepared by converting the wavelength of a $YVO_4$ solid laser (oscillating wavelength: 1064 nm) combined with an exciting light source of a semiconductor laser GaAlAs (oscillating wavelength: 808.7 nm), using SHG crystals of KTP; and a semiconductor laser AlGaInP (TOLD 9211 Model, made by Toshiba Co.; oscillating wavelength: about 670 nm). The scanning exposure device used here was such that the laser rays were successively applied to the color printing paper, which were being moved in the direction vertical to the scanning direction, by the motion of a rotary polyhedron. Using the device, the samples were exposed while the quantity of light was varied, and the relation (D-logE) between the density (D) of the processed sample and the quantity of light applied (E) was obtained. The three laser rays each having a different wavelength as mentioned above were modulated so as to vary the quantity of light from each ray, using an external modulator, by which the amount of exposure of each sample was controlled. The scanning exposure was effected at 400 dpi, and the mean exposure time was about $5\times10^{-8}$ seconds per one pixel. Using a Peltier device, the temperatures of the semiconductor lasers were kept constant in order to prevent the temperature-dependent fluctuation of the quantity of light from each laser.

According to the present invention which has been explained in detail hereinabove, there is provided a low-priced color photographic material having a good coloring property, excellent color reproducibility and high sharpness. As the material has sufficient pressure resistance, it has few stress marks even after stored. The present invention also provides a method for forming a color image, using the photographic material.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material having, on a reflective support, at least one yellow dye-forming coupler-containing silver halide emulsion layer, at least one magenta dye-forming coupler-containing silver halide emulsion layer and at least one cyan dye-forming coupler-containing silver halide emulsion layer each having a different color sensitivity, wherein said reflective support is composed of a base and two or more waterproof resin coat layers each having a different white pigment content, the resin coat layers being provided on the surface side of the base where the silver halide emulsion layers are coated thereover, the waterproof resin coat layer that is nearest to the base having a lower white pigment content than at least one of the waterproof resin coat layers positioned farther from the base;

wherein said yellow dye-forming coupler-containing silver halide emulsion layer is adjacent to the waterproof resin coat layer that is farthest away from said base; said cyan dye-forming coupler-containing silver halide emulsion layer contains at least one cyan dye-forming coupler compound of the following general formula (Ia); and the coated layers of the photographic material, combined, have a pH that falls within the range of from 4.0 to 6.5:

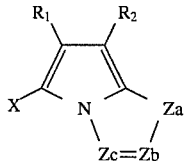

(Ia)

wherein Za represents —NH— or —CH($R_3$)—;

Zb and Zc each represent —C($R_4$)= or —N=;

$R_1$, $R_2$ and $R_3$ each represent an electron-attracting group having a Hammett's substituent constant σp of 0.20 or more, provided that the sum of the σp values of $R_1$ and $R_2$ is 0.65 or more;

$R_4$ represents a hydrogen atom, a halogen atom, an aliphatic group, an aryl group, a heterocyclic group, an alkoxy group, an aryloxy group, a heterocyclic-oxy group, an alkyl-, aryl- or heterocyclic-thio group, an acyloxy group, a carbamoyloxy group, a silyloxy group, a sulfonyloxy group, an acylamino group, an alkylamino group, an arylamino group, an ureido group, a sulfamoylamino group, an alkenyloxy group, a formyl group, an alkyl-, an aryl- or heterocyclic-acyl group, an alkyl-, aryl- or heterocyclic-sulfonyl group, an alkyl-, aryl- or heterocyclic-sulfinyl group, an alkyl-, aryl- or heterocyclic-oxycarbonyl group, an alkyl-, aryl- or heterocyclic-oxycarbonylamino group, a sulfonamido group, a carbamoyl group, a sulfamoyl group, a phosphonyl group, a sulfamido group, an imido group, a hydroxyl group, a cyano group, a carboxyl group, a nitro group, a sulfo group or an unsubstituted amino group, provided that when the formula has two $R_4$'s, they are the same or different;

X represents a hydrogen atom or a group capable of splitting off from the compound by the coupling reaction with an oxidation product of an aromatic primary amine color developing agent; and when $R_1$, $R_2$, $R_3$, $R_4$ or X is a divalent group, the compound may be a dimer or a higher polymer, or the divalent group may be bonded to a polymer chain to form a homopolymer or copolymer.

2. The silver halide color photographic material as claimed in claim 1, in which the cyan dye-forming coupler compound of formula (Ia) is selected from the group consisting of cyan dye-forming coupler compounds of general formulae (IIa) to (VIIIa):

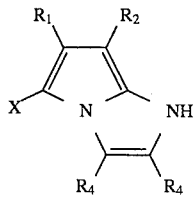

(IIa)

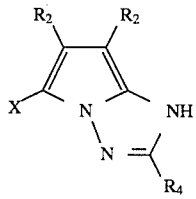

(IIIa)

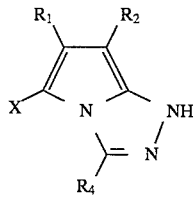

(IVa)

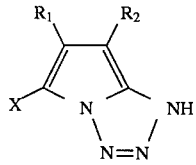

(Va)

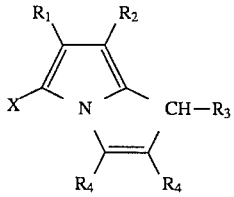

(VIa)

-continued

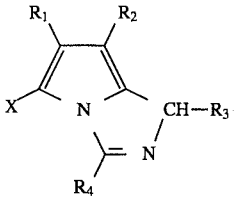

(VIIa)

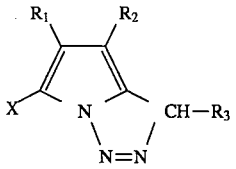

(VIIIa)

wherein $R_1$, $R_2$, $R_3$, $R_4$ or X have the same meanings as those in formula (Ia).

3. The silver halide color photographic material as claimed in claim 1, in which the cyan dye-forming coupler compound of formula (Ia) is a cyan dye-forming coupler compound of a general formula (Ib):

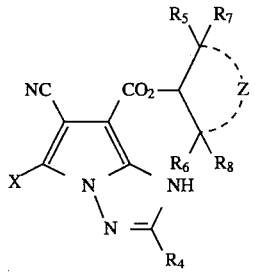

(Ib)

wherein $R_5$, $R_6$, $R_7$, $R_8$ and $R_9$ each independently represent a hydrogen atom, a halogen atom, an aliphatic group, an aryl group, a heterocyclic group, an alkoxy group, an aryloxy group, a heterocyclic-oxy group, an alkyl-, aryl- or heterocyclic-thio group, an acyloxy group, a carbamoyloxy group, a silyloxy group, a sulfonyloxy group, an acylamino group, an alkylamino group, an arylamino group, an ureido group, a sulfamoylamino group, an alkenyloxy group, a formyl group, an alkyl-, an aryl- or heterocyclic-acyl group, an alkyl-, aryl- or heterocyclic-sulfonyl group, an alkyl-, aryl- or heterocyclic-sulfinyl group, an alkyl-, aryl- or heterocyclic-oxycarbonyl group, an alkyl-, aryl- or heterocyclic-oxycarbonylamino group, a sulfonamido group, a carbamoyl group, a sulfamoyl group, a phosphonyl group, a sulfamido group, an imido group, a hydroxyl group, a cyano group, a carboxyl group, a nitro group, a sulfo group or an unsubstituted amino group;

Z represents a non-metallic atomic group necessary for forming a substituted or unsubstituted ring, said ring substituents being selected from the group consisting of a halogen atom, an aliphatic group, an aryl group, a heterocyclic group, an alkoxy group, an aryloxy group, a heterocyclic-oxy group, an alkyl-, aryl- or heterocyclic-thio group, an acyloxy group, a carbamoyloxy group, a silyloxy group, a sulfonyloxy group, an acylamino group, an alkylamino group, an arylamino group, an ureido group, a sulfamoylamino group, an alkenyloxy group, a formyl group, an alkyl-, an aryl- or heterocyclic-acyl group, an alkyl-, aryl- or heterocyclic-sulfonyl group, an alkyl-, aryl- or heterocyclic-sulfinyl group, an alkyl-, aryl- or heterocyclic-oxycarbonyl group, an alkyl-, aryl- or heterocyclic-oxycarbonylamino group, a sulfonamido group, a carbamoyl group, a sulfamoyl group, a phosphonyl group, a sulfamido group, an imido group, a hydroxyl group, a cyano group, a carboxyl group, a nitro group, a sulfo group or an unsubstituted amino group; provided that when the ring is an aromatic ring or an aromatic heterocyclic ring, the formula does not have $R_7$, $R_8$ and $R_9$;

$R_5$, $R_6$, $R_7$, $R_8$ and $R_9$ and the substituent(s), if any, on Z may be bonded to each other to form ring(s); and $R_4$ and X have the same meanings as those in formula (Ia).

4. The silver halide color photographic material as claimed in claim 1, in which, in the reflective support composed of a base and two or more waterproof resin coat layers each having a different white pigment content, the waterproof resin coat layer that is nearest to the silver halide emulsion layers has the highest white pigment content.

5. The silver halide color photographic material as claimed in claim 1, in which the reflective support has, on the base, at least three or more waterproof resin coat layers each having a different white pigment content; a waterproof resin coat layer located between the waterproof resin coat layer nearest to the silver halide emulsion layers and the waterproof resin coat layer nearest to the base has the highest white pigment content.

6. The silver halide color photographic material as claimed in claim 1, in which the white pigment in the waterproof resin coat layers constituting the reflective support is titanium dioxide and the ratio by weight of the white pigment to the resin is 15/85 (titanium dioxide/resin) or more in the waterproof resin coat layer having the highest white pigment content.

7. The silver halide color photographic material as claimed in claim 1, in which said cyan dye-forming coupler-containing silver halide emulsion layer contains at least one compound selected from the group consisting of oleophilic compounds of the following general formulae (A), (B) and (C), that chemically bond to an aromatic primary amine color developing agent under the condition of pH 8 or less to give substantially colorless products, and oleophilic compounds of the following general formula (D) that chemically bond to an oxidation product of an aromatic primary amine color developing agent under the condition of pH 8 or less to give substantially colorless products:

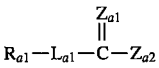

(A)

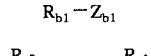

(B)

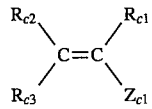

(C)

(D)

wherein, in formula (A), $L_{a1}$ represents a single bond, —O—, —S—, —CO— or —N($R_{a2}$)—, wherein $R_{a2}$ represents an aliphatic group, an aromatic group, a heterocyclic group, a hydrogen atom, an acyl group, a sulfonyl group, a carbamoyl group or a sulfamoyl group; $R_{a1}$ represents an aliphatic group, an aromatic group, or a heterocyclic group; $Z_{a1}$ represents an oxygen atom or a sulfur atom; $Z_{a2}$ represents a hydrogen atom, —O—$R_{a3}$, —S—$R_{a4}$, —$L_{a2}$—C(=$Z_{a1}$')$R_{a5}$, or a heterocyclic group bonding to the formula via a nitrogen atom; $R_{a3}$ and $R_{a4}$ are the same or different and each represents a vinyl group, an aromatic group or a heterocyclic group; $L_{a2}$ represents —O— or —S—; $Z_{a1}$' has the same meaning as $Z_{a1}$; $R_{a5}$ represents an aliphatic group, an aromatic group or a heterocyclic group; alternatively, at least two of $R_{a1}$, $R_{a2}$ and $Z_{a2}$ are bonded to each other to form a 5-membered to 7-membered ring;

in formula (B), $R_{b1}$ represents an aliphatic group; and $Z_{b1}$ represents a halogen atom;

in formula (C), $Z_{c1}$ represents a cyano group, an acyl group, a formyl group, an aliphatic-oxycarbonyl group, an aromatic-oxycarbonyl group, a carbamoyl group, a sulfamoyl group, or a sulfonyl group; $R_{c1}$, $R_{c2}$ and $R_{c3}$ are the same or different and each represents a hydrogen atom, an aliphatic group, an aromatic group, a heterocyclic group or $Z_{c1}$; alternatively at least two of $R_{c1}$, $R_{c2}$, $R_{c3}$ and $Z_{c1}$ are bonded to each other to form a 5-membered to 7-membered ring;

in formula (D), $R_{d1}$ represents an aliphatic group or an aromatic group; $Z_{d1}$ represents a mercapto group or —$SO_2Y$, wherein Y represents a hydrogen atom, an atom or atomic group for forming an inorganic or organic salt, —NHN=C($R_{d2}$)$R_{d3}$, —N($R_{d4}$)—N($R_{d5}$)—$SO_2R_{d6}$, —N($R_{d7}$)—N($R_{d8}$)—$COR_{d9}$ or —C($R_{d10}$)($OR_{d11}$)—$COR_{d12}$; $R_{d2}$ and $R_{d3}$ are the same or different and each represents a hydrogen atom, an aliphatic group, an aromatic group or a heterocyclic group; alternatively $R_{d2}$ and $R_{d3}$ are bonded to each other to form a 5-membered to 7-membered ring; $R_{d4}$, $R_{d5}$, $R_{d7}$ and $R_{d8}$ are the same or different and each represents a hydrogen atom, an aliphatic group, an aromatic group, a heterocyclic group, an acyl group, an aliphatic-oxycarbonyl group, a sulfonyl group, an ureido group or an urethane group, provided that at least one of $R_{d4}$ and $R_{d5}$ and at least one of $R_{d7}$ and $R_{d8}$ are hydrogen atoms; $R_{d6}$ represents a hydrogen atom, an aliphatic group, an aromatic group, a heterocyclic group, an aliphatic amino group, an aromatic amino group, an aliphatic-oxy group, an aromatic-oxy group, an acyl group, an aliphatic-oxycarbonyl group or an aromatic-oxycarbonyl group; $R_{d9}$ represents a hydrogen atom, an aliphatic group, an aromatic group, or a heterocyclic group; alternatively at least two of $R_{d4}$, $R_{d5}$ and $R_{d6}$ are bonded to each other to form a 5-membered to 7-membered ring, or at least two of $R_{d7}$, $R_{d8}$ and $R_{d9}$ are bonded to each other to form a 5-membered to 7-membered ring; $R_{d12}$ represents a hydrogen atom, an aliphatic group, an aromatic group or a heterocyclic group; $R_{d10}$ represents a hydrogen atom, an aliphatic group, an aromatic group, a halogen atom, an acyloxy group, or a sulfonyl group; and $R_{d11}$ represents a hydrogen atom or a hydrolyzable group.

8. The silver halide color photographic material as claimed in claim 7, in which said compounds of formula (A) are selected from the group consisting of compounds represented by one of the following formula (A-I) to (A-V):

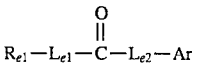

(A-I)

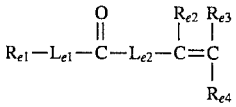

(A-II)

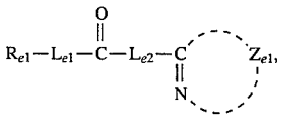

(A-III)

-continued

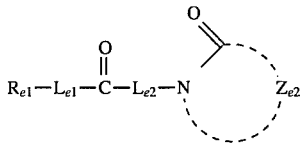

(A-IV)

and

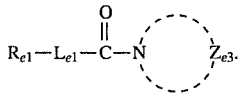

(A-V)

wherein in formulae (A-I) to (A-V), $R_{e1}$ has the same meaning as $R_{a1}$ in formula (A); $L_{e1}$ represents a single bond or —O—; $L_{e2}$ represents —O— or —S—; Ar represents an aromatic group; $R_{e2}$ to $R_{e4}$ are the same or different and each represents a hydrogen atom, an aliphatic group, an aromatic group, a heterocyclic group, an aliphatic-oxy group, an aromatic-oxy group, a heterocyclic-oxy group, an aliphatic-thio group, an aromatic-thio group, a heterocyclic-thio group, an amino group, an aliphatic amino group, an aromatic amino group, a heterocyclic amino group, an acyl group, an amido group, a sulfonamido group, a sulfonyl group, an aliphatic-oxycarbonyl group, an aromatic-oxycarbonyl group, a sulfo group, a carboxyl group, a formyl group, a hydroxyl group, an acyloxy group, an ureido group, an urethane group, a carbamoyl group or a sulfamoyl group; alternatively at least two of $R_{e2}$ to $R_{e4}$ are bonded to each other to form a 5-membered to 7-membered ring; $Z_{e1}$ and $Z_{e2}$ each represent a non-metallic atomic group necessary for forming a 5-membered to 7-membered ring; $Z_{e3}$ represents a non-metallic atomic group necessary for forming a 5-membered to 7-membered aromatic ring.

9. The silver halide color photographic material as claimed in claim 8, wherein said oleophilic compound is a compound of fomula (A-I) or (A-III) and is selected from the group consisting of:

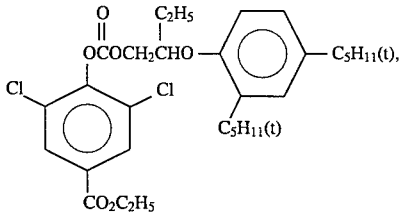

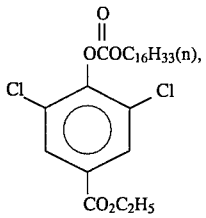

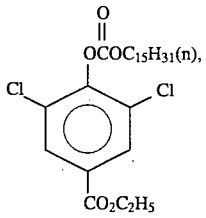

-continued

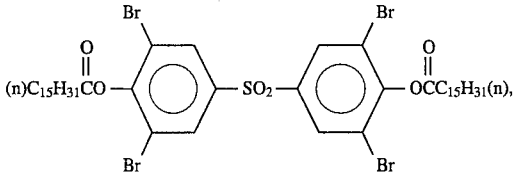

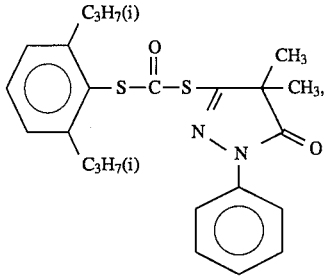

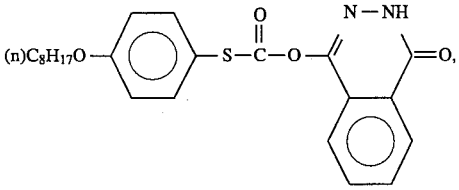

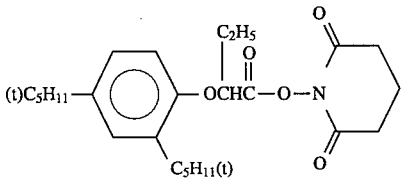

-continued and

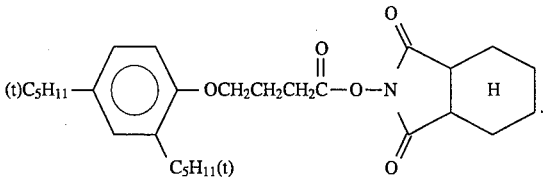

10. The silver halide color photographic material as claimed in claim 7, wherein Y represents an inorganic or organic salt that is selected from the group consisting of Li, Na, K, Ca, Mg, triethylamine, methylamine, and ammonia.

11. The silver halide color photographic material as claimed in claim 7, wherein $R_{d11}$ represents a hydrolyzable group that is selected from the group consisting of an acyl group, a sulfonyl group, an oxalyl group, and a silyl group.

12. The silver halide color photographic material as claimed in claim 1, wherein the silver halide grains are silver chlorobromide or silver chloroiodobromide grains, each having at least 95 mol % silver chloride, or silver chloride grains.

13. The silver halide color photographic material, as claimed in claim 1, wherein said pH is in the range of from 5.0 to 6.0.

* * * * *